United States Patent [19]

Takahashi et al.

[11] Patent Number: 5,006,453

[45] **Date of Patent: * Apr. 9, 1991**

[54] SILVER HALIDE COLOR PHOTOGRAPHIC MATERIAL HAVING IMPROVED DYE IMAGE STABILITY

[75] Inventors: Osamu Takahashi; Minoru Sakai; Genichi Furusawa; Tsumoru Hirano, all of Kanagawa, Japan

[73] Assignee: Fuji Photo Film Co. Ltd., Tokyo, Japan

[ * ] Notice: The portion of the term of this patent subsequent to Aug. 15, 2006 has been disclaimed.

[21] Appl. No.: 181,289

[22] PCT Filed: Jul. 9, 1987

[86] PCT No.: PCT/JP87/00492

§ 371 Date: May 10, 1988

§ 102(e) Date: May 10, 1988

[87] PCT Pub. No.: WO88/00723

PCT Pub. Date: Jan. 28, 1988

[30] Foreign Application Priority Data

Jul. 10, 1986 [JP] Japan ..... 61-162813

[51] Int. Cl.[5] ..... G03C 1/08; G03C 7/32

[52] U.S. Cl. ..... 430/546; 430/505; 430/551; 430/552; 430/553; 430/558

[58] Field of Search ..... 430/505, 546, 551, 553, 430/545, 549, 558, 552

[56] References Cited

U.S. PATENT DOCUMENTS

| | | | |
|---|---|---|---|
| 2,269,158 | 1/1942 | Martinez | 430/507 |
| 2,272,191 | 2/1942 | Fierke | 430/377 |
| 4,120,725 | 10/1978 | Nakazyo et al. | 430/545 |
| 4,201,589 | 5/1980 | Sakaguchi et al. | 430/139 |
| 4,203,716 | 5/1980 | Chen | 430/207 |
| 4,239,851 | 12/1980 | Aoki et al. | 430/377 |
| 4,278,757 | 7/1981 | Mukunoki et al. | 430/512 |
| 4,368,258 | 1/1983 | Fujiwhara et al. | 430/493 |
| 4,710,456 | 12/1987 | Naoi et al. | 430/564 |
| 4,801,521 | 1/1989 | Ohki et al. | |
| 4,857,449 | 8/1989 | Ogawa et al. | 430/546 |

FOREIGN PATENT DOCUMENTS

| | | | |
|---|---|---|---|
| AO164961 | 12/1985 | European Pat. Off. | |
| 27737 | 3/1976 | Japan | |
| 7639853 | 11/1976 | Japan | |
| 85140344 | 7/1979 | Japan | |
| 76134627 | 10/1979 | Japan | |
| 85107642 | 10/1980 | Japan | |
| 110327 | 3/1982 | Japan | |
| 62203160 | 9/1987 | Japan | 430/545 |

*Primary Examiner*—Charles L. Bowers, Jr.
*Assistant Examiner*—Janet C. Baxter
*Attorney, Agent, or Firm*—Sughrue, Mion, Macpeak & Seas

[57] ABSTRACT

The present invention calls for a silver halide color photographic material comprising a support having thereon at least one silver halide photographic emulsion layer containing a dispersion of oleophilic fine particles containing at least one diffusion resistant oil-soluble coupler which forms a substantially nondiffusible dye upon coupling with an oxidation product of an aromatic primary amine developing agent and at least one water-immiscible coupler solvent having a melting point of not more than 100° C. and a boiling point of not less than 140° C., wherein said oil-soluble coupler is represented by formula (Cp-I), (Cp-II) or (Cp-III) the dispersion of oleophilic fine particles is a dispersion obtained by emulsifying or dispersing a mixture containing at least one of the above couplers, at least one of the above coupler solvents and at least one water-insoluble and organic solvent-soluble homopolymer or copolymer composed of at least one repeating unit which does not have an acid group in the main chain or side chain thereof.

The silver halide color photographic material can provide dye images, the prevention from light fading and dark fading of which is well balanced, and which exhibit excellent image preservability when exposed to high temperature and high humidity as well as when exposed to light.

5 Claims, No Drawings

SILVER HALIDE COLOR PHOTOGRAPHIC MATERIAL HAVING IMPROVED DYE IMAGE STABILITY

FIELD OF THE INVENTION

The present invention relates to a silver halide color photographic material, and more particularly relates to a silver halide color photographic material which provides dye images having improved preservability.

BACKGROUND OF THE INVENTION

It is known that dye images formed from silver halide color photographic materials are sometimes permitted to be exposed to irradiation by light for a long period of time or are left in a dark place for a long time with only a short period of irradiation to light. These conditions can cause severe fading of the dye image. In general, fading under the first circumstance is known as light fading and fading under the second circumstance is called dark fading. When records formed from color photographic light-sensitive material are semipermanently stored, control over such light fading and dark fading to as great an extent as possible and maintenance of three color balance in the fading of yellow, magenta and cyan dye images are necessary so that the initial state of color balance is maintained. However, the degree of light fading and dark fading of yellow, magenta and cyan dye images are different from each other and, thus, the three color balance of yellow, magenta and cyan dye images is destroyed, resulting in degradation of image quality.

Although the degree of light fading and dark fading is naturally different depending on the particular color couplers employed and other factors, in many cases dark fading is apt to occur in the order of cyan dye images, yellow dye images and magenta dye images, and the degree of dark fading in cyan dye images is particularly great compared with that of other dye images. Light fading also tends to occur in the order of cyan dye images, yellow dye images and magenta dye images, particularly when the light source is emitting a large amount of ultraviolet rays.

Therefore, maximum prevention of light fading and dark fading of cyan dye images is necessary in order to maintain three color balance between yellow, magenta and cyan dye images for a long period of time. For the purpose of preventing light fading and dark fading of dye images, various kinds of investigations have been heretofore made, which mainly have followed to approaches to the problem. One approach has been to develop novel couplers which can form dye images having less a tendency to fade. The other approach has been to develop novel additives capable of preventing fading.

A large number of phenol type cyan couplers which form cyan dyes are known. However, 2-(α-2,4-di-tert-amylphenoxybutanamido)-4,6-dichloro-5-methylphenol as described in U.S. Pat. No. 2,801,171, for example, has the disadvantage that the dye formed therefrom has poor heat fastness while it has good light fastness.

Further, cyan couplers having an alkyl group containing 2 or more carbon atoms substituted on the 3-position or 5-position of phenol are described, for example, in Japanese Patent Publication No. 11572/74, Japanese Patent Application (OPI) Nos. 209735/85 and 205447/85 (the term "OPI" as used herein refers to a "published unexamined Japanese patent application"), etc. The heat fastness of cyan images formed from these couplers is improved to some extent but still insufficient.

Moreover, 2,5-diacylaminophenol type cyan couplers in which the 2-position and 5-position of the phenol are substituted with an acylamino group are described, for example, in U.S. Patents 2,369,929, 2,772,162 and 2,895,826, Japanese Patent Application (OPI) Nos. 112038/75, 109630/78 and 163537/80, etc. Although the heat fastness of cyan images formed from these 2,5-diacylaminophenol type cyan couplers is improved, their color forming property is poor, cyan images formed therefrom are sensitive to light fading and yellow stain is apt to occur due to irradiation or the unreacted cyan couplers to light. Also, further improvement in heat fastness is required.

1-Hydroxy-2-naphthamide type cyan couplers are generally not satisfactory with regard to both light fading and dark fading.

Further, 1-hydroxy-2-acylaminocarbostyryl type cyan couplers as described in Japanese Patent Application (OPI) No. 104333/81 are excellent in fastness to light and heat, but the spectral absorption characteristics of the color images formed therefrom are not preferred for color reproduction.. In addition, they have the problem that pink stain occurs upon irradiation to light.

Moreover, cyan polymer couplers as described in U.S. Pat. No. 3,767,412, Japanese Patent Application (OPI) Nos. 65844/84 and 39044/86, etc., are excellent in heat fastness under dry conditions, but are poor in heat fastness and color forming property under high humidity.

Furthermore, a method wherein a hydrophobic substance such as an oil-soluble coupler is dissolved in a water-miscible organic solvent and the solution is mixed with a loadable polymer latex whereby the hydrophobic substance is loaded in the polymer latex is described in U.S. Pat. No. 4,203,716, etc. However, the method using such a loadable polymer latex has the disadvantage that cyan images are particularly inferior in light fastness in comparison with a water-immiscible coupler solvent having a high boiling point. In addition, it is necessary to employ the polymer in a large amount in order to load a sufficient amount of coupler to obtain a sufficiently high maximum color density. Still further, Japanese Patent Publication No. 30494/73 describes a photographic material containing a coupler dispersion (diameter of dispersion particles being about 0.5 μm to 5 μm) which is prepared by using an organic solvent-soluble homopolymer of a hydrophobic monomer having a specific structure or copolymer of a hydrophobic monomer having a specific structure and a hydrophobic monomer having a specific structure in place of the coupler solvent having a high boiling point. Improved physical properties of the layer, improved recoloring ability, light fastness and preservability before photographic processing, etc., are achieved. However, in the case wherein the homopolymer of a hydrophobic monomer as described in Japanese Patent Publication No. 30494/73 is employed in place of the coupler solvent, low color forming ability is encountered. This tendency particularly manifests itself (when a color developing solution which does not substantially contain a color forming accelerator such as benzyl alcohol is used), as disclosed in the examples of the above-described patent publication. Another problem is that the stability of the emulsified dispersion is poor.

On the other hand, when using a copolymer containing a hydrophilic monomer such as acrylic acid, etc., the stability of the emulsified dispersion and color forming ability are improved to some extent, but are still insufficient. Further, when the ratio of hydrophilic monomer in the copolymer is increased in order to improve color forming ability, fading, (particularly heat fading at high humidity), is accelerated. In addition, both polymers have the problem of crystallization of couplers during storage of the emulsified dispersion, etc., because the polymers are inferior in preventing the crystallization of couplers.

Further, when the method as described in Japanese Patent Publication No. 30494/73 is applied to cyan couplers, light fastness is severely degraded (1.5 to 3 times) compared with when the couplers are dispersed using a conventional solvent having a high boiling point (known as the oil dispersing method).

In addition, with the method as described in Japanese Patent Publication No. 30494/73, further problem is that the hue of cyan dyes changes over time. More specifically, the spectral absorption of cyan dyes formed upon color development is in a longer wavelength range just after development processing but readily shifts to a shorter wavelength during storage, particularly when exposed to high temperatures.

As described above, couplers that prevent dark fading because of modification of their structure have significant disadvantages with regard to hue, color forming ability, stain, and/or light fastness. Therefore, a novel way to avoid these problems has been desired.

Also, a way to prevent dark fading using other additives or dispersing methods which are known has certain problems and an effective means free from such disadvantages has not been found heretofore.

With regard to color development of silver halide color photographic materials containing oleophilic diffusion resistant type (oil protected type) couplers, various permeating agents for color developing agents have been investigated in order to increase their color forming ability and to shorten processing time. In particular, adding benzyl alcohol to a color developing solution has a large accelerating effect on color formation and, therefore, is widely utilized at present in the processing of color paper, color reversal paper or color positive films for display, etc.

When this approach is used, a further solvent such as diethylene glycol, triethylene glycol, an alkanolamine, etc., is required in order to assist dissolution, since benzyl alcohol has low water solubility. This combination of benzyl alcohol with additional solvents places a high load on the environment due to environmental pollution such as BOD (biochemical oxygen demand) and COD (chemical oxygen demand). Therefore, it is desirable to eliminate these compounds from the processing solution for the purpose of protection of the environment.

Also, it takes a long time to dissolve benzyl alcohol in a developing solution even when such a solvent is employed and, thus, it is preferable not to utilize benzyl alcohol in order to simplify preparation of the solution.

Further, when benzyl alcohol is carried over into the bath following the color developing solution such as a bleaching bath or a bleach-fixing bath, it can cause the formation of leuco dyes of cyan dyes resulting in decreased color density. Moreover, benzyl alcohol retards the rate for running components contained in the developing solution out of photographic materials and sometimes deteriorates the preservability of images in the photographic materials after processing. For these reasons, it is desirable that benzyl alcohol not be used.

Accordingly, a coupler dispersion having improved image preservability as well as excellent color forming property without using benzyl alcohol has been desired.

Therefore, a first object of the present invention is to provide a silver halide color photographic material which can form dye images in which light fading and dark fading are controlled in good balance and which exhibits excellent image preservability particularly when exposed to high temperature and high humidity.

A second object of the present invention is to provide a silver halide color photographic material which can form dye images having good color balance in the fading of yellow, magenta and cyan color images by controlling the degree of fading, whereby excellent preservability is obtained when the photographic material is stored for a long period of time.

Third object of the present invention is to provide a silver halide color photographic material which can form dye images having improved image preservability without adversely affecting the desired properties of the photographic material.

A fourth object of the present invention is to provide a silver halide color photographic material having excellent image preservability which contains a coupler emulsified dispersion which exhibits sufficiently high color forming property even when processed with a color developing solution which does not substantially contain benzyl alcohol and has good stability.

A fifth object of the present invention is to provide a silver halide color photographic material having improved dark fastness without degradation of light fastness of cyan dye images.

DESCRIPTION OF THE INVENTION

As a result of various investigations, it has been found that these objects of the present invention can be accomplished with a silver halide color photographic material comprising a support having thereon at least one silver halide photographic emulsion layer containing a dispersion of oleophilic fine particles containing at least one diffusion resistant oil-soluble coupler which forms a substantially nondiffusible dye upon coupling with an oxidation product of an aromatic primary amine developing agent and at least one water-immiscible coupler solvent having a melting point of not more than 100° C. and a boiling point of not less than 140° C., wherein said oil-soluble coupler is represented by formula (Cp-I), (Cp-II) or (Cp-III) as defined below and the dispersion of oleophilic fine particles is a dispersion obtained by emulsifying or dispersing a mixture solution containing at least one of the couplers, at least one of the coupler solvents and at least one water-insoluble and organic solvent-soluble homopolymer or copolymer composed of at least one repeating unit in an amount of not less than 35 mol% which does not have an acid group in the main chain or side chain thereof;

General formula (Cp-I)

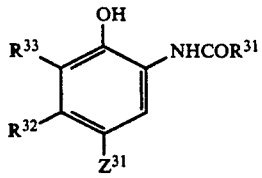

wherein $R^{31}$ represents an alkyl group, a cycloalkyl group, an aryl group or a heterocyclic group; $R^{32}$ represents an acylamino group, or an alkyl group having 2 or more carbon atoms; $R^{33}$ represents a hydrogen atom, a halogen atom, an alkyl group or an alkoxy group; with proviso $R^{31}$ represents an aryl group when $R^{32}$ is an acylamino group; $Z^{31}$ represents a hydrogen atom, or a releasable group when $Z^{31}$ reacts with an oxidation products of an aromatic primary amine color developing agent.

General formula (Cp-II)

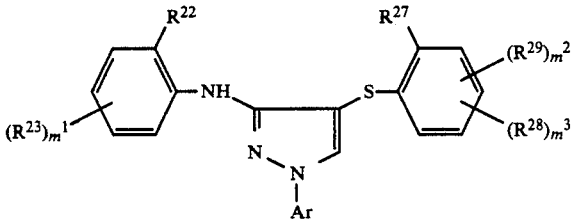

wherein Ar represents an aryl group; $R^{21}$ represents a hydrogen atom, an acyl group, or an aliphatic or aromatic sulfonyl group; $R^{22}$ represents a halogen atom, or an alkoxy group; $R^{23}$ represents an alkyl group, an aryl group, a halogen atom, an alkoxy group, an aryloxy group, an acylamino group, an imido group, a sulfonamido group, an alkoxycarbonyl group, a carbamoyl group, a sulfamoyl group, an alkylthio group, or a sulfonyl group; $R^{27}$ represents an alkyl group, an alkoxy group, or an aryloxy group; $R^{29}$ represents a hydrogen atom, a halogen atom, a hydroxyl group, an alkyl group, an alkoxy group, or an aryl group; $R^{28}$ represents an amino group, acylamino group, an ureido group, an alkoxy carbonylamino group, an imido group, a sulfonamido group, a sulfamoylamino group, an alkoxycarbonyl group, a carbamoyl group, an acyl group, a cyano group, or an alkylthio group; provided that at least one of $R^{27}$ and $R^{29}$ represents an alkoxy group; $m^1$ and $m^2$ each represents an integer of 1 to 4; and $m^3$ represent 0 or an integer of 1 to 3.

General formula (Cp-III)

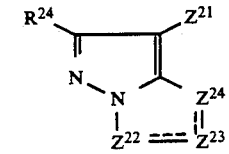

wherein $R^{24}$ represents a hydrogen atom or a substituent group; $Z^{21}$ represents a hydrogen atom or a releasable group when $Z^{21}$ reacts with an oxidatized product of an aromatic primary amine color developing agent; $Z^{22}$, $Z^{23}$ and $Z^{24}$ each represents

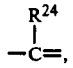

—N= or —NH—, including that at least one of bondings $Z^{24}$—$Z^{23}$ and $Z^{23}$—$Z^{22}$ is double-bond and the rest thereof is a single-bond, and a bonding $Z^{23}$—$Z^{22}$ is a part of an aromatic ring when $Z^{23}$—$Z^{22}$ is a carbon to carbon double-bond.

The term "acid group" as used herein with respect to the polymer means the remainder which is formed by eliminating a hydrogen atom capable of being substituted with a metal from an acid molecule and constitutes a negative portion of a salt.

The repeating unit which does not have an acid group includes a repeating unit which does not contain a carboxylic acid group, a sulfonic acid group, a phenol or naphthol moiety having at least one electron withdrawing group at the ortho position and the para position to the hydroxy group thereof and a pKa of not more than about 10, and an active methylene moiety, or a salt thereof. Therefore, a coupler moiety is deemed as the acid group in the present invention.

BEST MODE TO CARRY OUT THE INVENTION

In the present invention, followings are illustrated as preferred embodiments.

(1) A silver halide color photographic material wherein the repeating unit which does not contain an acid group has a group of

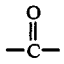

in a main or side chain.

(2) A silver halide color photographic material wherein the repeating unit which does not contain an acid group has a group of

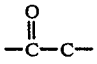

in a main or side chain.

(3) A silver halide color photographic material wherein the repeating unit which does not contain an acid group has a group of

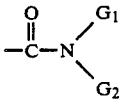

(wherein $G_2$ and $G_2$ each represents a hydrogen atom, substituted or unsubstituted alkyl group, or substituted or unsubstituted aryl group).

(4) A silver halide color photographic material, wherein said repeating units of polymer free of acid radical is a repeating unit having the following definition (A):

Definition (A): The glass transition point (Tg) of a monopolymer with a molecular weight of 20,000 or more containing only said repeating units is 50° C. or above.

(5) A silver halide color photographic material, containing at least one coupler of the general formula (Cp-I) as a cyan coupler and at least one coupler of the general formula (Cp-II) and/or the general formula (Cp-III) as a magenta coupler among said oil-soluble couplers.

(6) A silver halide color photographic material wherein the coupler solvent is represented by the following formula (III), (IV), (V), (VI), (VII) or (VIII):

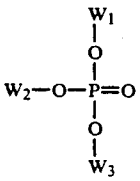

General formula (III)

$W_1—COOW_2$ General formula (IV)

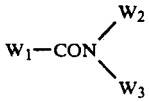

General formula (V)

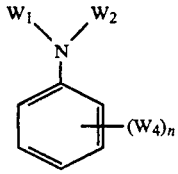

General formula (VI)

$W_1—O—W_2$ General formula (VII)

$HO—W_6$ General formula (VIII)

wherein $W_1$, $W_2$ and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; W4 represents $W_1$, —O—$W_1$ or —S—$W_1$; n represents an integer from 1 to 5 and when n is two or more, two or more $W_4$'s may be the same or different; $W_1$ and $W_2$ in the formula (VII) maY combine to form a condensed ring; $W_6$ represents a substituted or unsubstituted alkyl group or a substituted or unsubstituted aryl group and the total number of carbon atoms in $W_6$ is not less than 12.

(7) A silver halide color photographic material wherein the silver halide photographic material is treated with a developing agent which does not substantially contain a benzyl alcohol after exposure to a light, in which a color developing agent herein means a color developing solution contains a benzyl alcohol in a concentration of 0.5 ml/l or lesser in the developing solution, and preferably, no benzyl alcohol contains.

The polymer which can be employed in the present invention may be any polymer composed of at least one repeating unit which does not contain the acid group in the main chain or side chain thereof and being water-insoluble and organic solvent-soluble. Of those polymers, those composed of a repeating unit having a linkage of

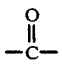

are preferred in view of color forming property and effect on preventing fading.

On the contrary, when a polymer composed of a monomer containing the acid group is employed, the effect on the prevention from fading due to the polymer is greatly reduced and such a polymer is not desirable. The reason for this is not clear.

Monomers providing a repeating unit having no acid group are preferably selected from compounds whose homopolymers (having a molecular weight of at least 20,000) have a glass transition point (Tg) of 50° C. or higher, and more preferably 80° C. or higher. Polymers comprising monomers whose homopolymers have a Tg of less than 50° C. surely produce an effect on improvement of image fastness in accelerated deterioration test at a high temperature (above 80° C.). However, as the temperature approaches to room temperature, the effect is reduced and becomes insubstantial as if no polymer is added. To the contrary, when polymers. comprising monomers whose homopolymers have a Tg of about 50° C. or higher are used, the effect as attained under a high temperature condition can be held or even heightened as the temperature approaches to room temperature. In particular, the improving effect is markedly enhanced when polymers comprising monomers whose homopolymers have a high Tg (80° C. or higher). This favorable trend is acrylamide monomers or methacrylamide monomers.

Further, polymers producing greater effects on improvement of heat-fastness tend to have so much effects on improvement of light-fastness. The improving effects are particularly pronounced in low density areas.

The proportion of the repeating unit having no acid radical in the polymers of the present invention is at least 35 mol%, preferably at least 50 mol%, and more preferably from 70 to 100 mol%.

The polymers which can be used in the present invention are explained in more detail with reference to specific examples thereof, but the present invention should not be construed as being limited to these polymers.

(A) Vinyl polymers:

Monomers for forming a vinyl polymer used in the present invention include an acrylic acid ester, a methacrylic acid ester, a vinyl ester, an acrylamide, a methacrylamide, an olefin, a styrene, a vinyl ether and other vinyl monomers.

Specific examples of acrylic acid esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2chlorocyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2methoxyethyl acrylate, 3-methoxybutyl acrylate, 2ethoxyethyl acrylate, 2-isopropoxy acrylate, 2butoxyethyl acrylate, 2-(2-methoxyethoxy)ethyl acrylate, 2-(2-butoxyethoxy)ethyl acrylate, ω-methoxypolyethylene glycol acrylate (addition molar number n =9), 1-bromo-2-methoxyethyl acrylate, 1,1-dichloro-2-ethoxyethyl acrylate, etc.

Methacrylic acid esters: Specific examples thereof methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2(2-butoxyethoxy)ethyl methacrylate, ω-methoxypolyethylene glycol methacrylate (addition molar number u =6), allyl methacrylate, dimethylaminoethyl methacrylate methyl chloride salt, etc.

Vinyl esters: Specific examples thereof include vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, etc.

Acrylamides: Specific examples thereof include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, diacetonacrylamide, etc.

Methacrylamide: Specific examples thereof include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetoacetoxyethyl)-methacrylamide, etc.

Olefins: Specific examples thereof include dicyclopentadiene, ethylene, propylene, 1-butene, 1-pentene, vinyl chloride, vinylidene chloride, isoprene, chloroprene, butadiene, 2,3-dimethylbutadiene, etc.

Specific examples of styrenes include styrene, methylstyrene, dimethylstyrene, trimethylstyrene, isopropylstyrene, chloromethylstyrene, methoxystyrene, acetoxystyrene, chlorostyrene, dichlorostyrene, bromostyrene, vinyl benzoic acid methyl ester, etc.

Vinyl ethers: Specific examples thereof include methyl vinyl ether, butyl vinyl ether, hexyl vinyl ether, methoxyethyl vinyl ether, dimethylaminoethyl vinyl ether, etc.

Specific examples of other vinyl monomers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, methoxyethyl vinyl ketone, glycidyl acrylate, glycidyl methacrylate, N-vinyl oxazolidone, N-vinyl pyrrolidone, acrylonitrile, methacrylonitrile, vinylidene chloride, methylene malononitrile, vinylidene, etc.

Two or more kinds of monomers (for example, those as described above) can be employed as comonomer to prepare the polymers according to the present invention depending on the particular objective to be satisfied (for example, improvement in the solubility thereof, etc.). Further, for the purpose of adjusting color forming ability and solubility of the polymers, a monomer having an acid group as illustrated below can be employed as a comonomer within the scope of the present invention so long as the copolymer obtained is not rendered watersoluble.

Specific examples of such monomers having an acid group include acrylic acid; methacrylic acid; itaconic acid; maleic acid; a monoalkyl itaconate, for example monomethyl itaconate, monethyl itaconate, monobutyl itaconate, etc.; a monoalkyl maleate, for example, monomethyl maleate, monoethyl maleate, monobutyl maleate, etc.; citraconic acid; styrene sulfonic acid; vinylbenzylsulfonic acid; vinylsulfonic acid; an acryloyloxyalkylsulfonic acid, for example acryloyloxymethylsulfonic acid, acryloyloxyethylsulfonic acid, acryloyloxypropylsulfonic acid, etc.; a methacryloyloxyalkylsulfonic acid, for example methacryloyloxymethylsulfonic acid, methacryloyloxyethylsulfonic acid, methacryloyloxypropylsulfonic acid, etc.; an acrylaminoalkylsulfonic acid, for example, 2-acrylamido-2-methylethanesulfonic acid, 2-acrylamido-2-methylpropanesulfonic acid, 2-acrylamido-2-methylbutanesulfonic acid, etc.; a methacrylamidoalkylsulfonic acid, for example, 2-methacrylamido-2-methylethanesulfonic acid, 2-methacrylamido-2-methylpropanesulfonic acid, 2-methacrylamido-2-methylbutanesulfonic acid, etc.; etc.

The acid may be in the form of a salt of an alkali metal, for example, sodium, potassium, etc., or an ammonium ion.

In the case where the vinyl monomer described above and a hydrophilic vinyl monomer (which forms a hydrophilic homopolymer used in the present invention is employed) as a comonomer, a ratio of the hydrophilic monomer contained in the copolymer is not strictly limited so long as the copolymer is not rendered watersoluble. The percent hydrophilic monomer contained in the copolymer is preferably not more than 40% per mol copolymer, more preferably not more than 20% per mol copolymer, and further more preferably not more than 10% per mol copolymer. Further, when a hydrophilic comonomer copolymerizable with the monomer of the present invention has an acid group, the percent comonomer having an acid group contained in the copolymer is usually not more than 20% per mol comonomer, and preferably not more than 10% per mol comonomer. In the most preferred case the copolymer does not contain such a monomer.

Preferred monomers for preparing the polymer according to the present invention are methacrylate type monomers, acrylamide type monomers and methacrylamide type monomers. Most preferred monomers are acrylamide type monomers and methacrylamide monomers.

(B) Polyester resins obtained by condensation of polyvalent alcohols and polybasic acids:

Useful polyvalent alcohols include a glycol having a structure of HO—$R_1$—OH (wherein $R_1$ represents a hydrocarbon chain having from 2 to about 12 carbon atoms, particularly an aliphatic hydrocarbon chain) and a polyalkylene glycol, and useful polybasic acids include those represented by the formula HOOC—$R_2$—COOH (wherein $R_2$ represents a single bond or a hydrocarbon chain having from 1 to about 12 carbon atoms).

Specific examples of the polyvalent alcohols include ethylene glycol, diethylene glycol, triethylene glycol, 1,2-propylene glycol, 1,3-propylene glycol, trimethylol propane, 1,4-butanediol, isobutylenediol, 1,5-pentanediol, neopentyl glycol, 1,6hexanediol, 1,7-heptanediol, 1,8-octanediol, 1,9-nonanediol, 1,10-decanediol, 1,11-undecanediol, 1,12-dodecanediol, 1,13-tridecanediol, glycerol, diglycerol, triglycerol, 1-methylglycerol, erythritol, mannitol, sorbitol, etc.

Specific examples of polybasic acids include oxalic acid, succinic acid, glutaric acid, adipic acid, pimelic acid, iso-pimelic acid, azelaic acid, sebacic acid, nonanedicarboxylic acid, decanedicarboxylic acid, undecanedicarboxylic acid, dodecanecarboxylic acid, fumaric acid, maleic acid, itaconic acid, citraconic acid, phthalic acid, isophthalate, terephthalate, tetrachlorophthalate, mesaconic acid, isopimelic acid, cyclopentadiene-maleic anhydride adduct, rosin-maleic anhydride adduct, etc.

(C) Other polymers:

A polyester obtained by open ring condensation as shown below is exemplified.

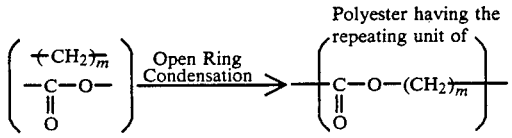

wherein m represents an integer from 4 to 7 and the $-CH_2-$ chain may be a branched chain.

Two or more of the polymers of the present invention disclosed above may optionally be used in combination.

Suitable monomers for preparation of the polyester include β-propiolactone, ε-caprolactone, dimethylpropiolactone, etc.

Molecular weight and degree of polymerization of the polymer according to the present invention do not have a substantial influence on the properties exhibited by the present invention. However, as the molecular weight becomes higher, some problems are apt to occur, such as a slow rate of dissolution in an auxiliary solvent and difficult emulsification or dispersion thereof due to the high viscosity of the solution. The difficult emulsification or dispersion causes coarse grains to be formed, which, in turn, results in a decrease in color forming ability and coating ability.

When a large amount of the auxiliary solvent is used to reduce its viscosity in order to traverse such difficulties, new problems in the process may occur.

The viscosity of the polymer is preferably not more than 5,000 cps, more preferably not more than 2,000 cps when 30 g of the polymer is dissolved in 100 ml of auxiliary solvent. Also, the molecular weight of the polymer to be used in the present invention is preferably not more than 150,000, more preferably not more than 80,000 and further more preferably not more than 30,000.

The ratio of polymer to auxiliary solvent depends upon the kind of polymer used and can be varied over a wide range depending on its solubility in the auxiliary solvent, its degree of polymerization, and the solubility of the coupler, etc. Usually the auxiliary solvent is employed in an amount necessary to make the viscosity sufficiently low for easily dispersing a solution containing at least a coupler, a coupler solvent having a high boiling point and the polymer dissolved in the auxiliary solvent in water or an aqueous solution of a hydrophilic colloid. Since the viscosity of the solution increases with the degree of polymerization of the polymer, it is difficult to set forth a ratio of the polymer to an auxiliary solvent that wold apply to every polymer. The ratio depends on the kind of the polymer employed. Usually, however, a ratio of about 1:1 to about 1:50 (by weight) is preferred. A ratio of the polymer according to the present invention to a coupler is preferably from 1:20 to 20:1, more preferably from 1:10 to 10:1 (by weight).

The polymers which can be used in the present invention are illustrated in part as set forth below, but the present invention should not be construed as being limited to these polymers.

| Examples | Polymers | Tg (°C.) |
|---|---|---|
| P-1 | Polyvinylacetate | 32 |
| P-2 | Polyvinylpropionate | 20 |
| P-3 | Polymethylmethacrylate | 105 |
| P-4 | Polyethylmethacrylate | 65 |
| P-5 | Polyethylacrylate | −24 |
| P-6 | Copolymer of vinylacetate-vinyl-alcohol (95:5) | (32) |
| P-7 | Poly(n-butylacrylate) | −54 |
| P-8 | Poly(n-butylmethcrylate) | 20 |
| P-9 | Poly(iso-butylmethacrylate) | 53 |
| P-10 | Poly(iso-propylmethacrylate) | 81 |
| P-11 | Poly(decylmethacrylate) | −70 |
| P-12 | Copolymer of n-butylacrylate-acrylamide (95:5) | (−54) |
| P-13 | Polymethylacrylate | 140 |
| P-14 | Poly(butanediol.adipate) | −68 |
| P-15 | Poly(ethyleneglycol sebacate) | — |
| P-16 | Polycaprolactone | — |
| P-17 | Poly(2-tert-butylphenyl acrylate) | 72 |
| P-18 | Poly(4-tert-butylphenyl acrylate) | 71 |
| P-19 | Copolymer of n-butylmethacrylate-N-vinyl-2-pyrrolidone (90:10) | (20) |
| P-20 | Copolymer of methylmethacrylate-vinyl chloride (70:30) | (105) |
| P-21 | Copolymer of methylmethacrylate-styrene (90:10) | (105) |
| P-22 | Copolymer of methylmethacrylate-ethylacrylate (50:50) | (105, −24) |
| P-23 | Copolymer of n-butylmethacrylate-methylmethacrylate.styrene (50:30:20) | (20) |
| P-24 | Copolymer of vinylacetate-acrylamide (85:15) | (32) |
| P-25 | Copolymer of vinyl chloride-vinyl-acetate (65:35) | (81) |
| P-26 | Copolymer of methylmethacrylate-acrylonitrile (65:35) | (105) |
| P-27 | Copolymer of diacetoneacrylamide-methylmethacrylate (50:50) | (60, 105) |
| P-28 | Copolymer of vinylmethylketone-iso-butylmethacrylate (55:45) | (—, 53) |
| P-29 | Copolymer of ethylmethacrylate-n-butylacrylate (70:30) | (65) |
| P-30 | Copolymer of diacetoneacrylamide-n-butylacrylate (60:40) | (60, −54) |
| P-31 | Copolymer of methylmethacrylate cyclohexylmethacrylate (50:50) | (105, 104) |
| P-32 | Copolymer of n-butylacrylate-styrenemethacrylate-diacetone-acrylamide (70:20:10:) | (−54) |
| P-33 | Copolymer of N-tert-butylmethacryl-amide-methylmethacrylate-acrylate (60:30:10) | (160, 105) |
| P-34 | Copolymer of methylmethacrylate-styrene-vinylsulfoneamide (70:20:10) | (105) |
| P-35 | Copolymer of methylmethacrylate-phenylvinylketone (70:30) | (105) |
| P-36 | Copolymer of butylacrylate-methyl-methacrylate-n-butylmethacrylate (35:35:30) | (−54, 105) |
| P-37 | Copolymer of n-butylmethacrylate-pentylmethacrylate-N-vinyl-2-pyrrolidone | (20, −5) |
| P-38 | Copolymer of methylmethacrylate-n- | (105) |

-continued

| Examples | Polymers | Tg (°C.) |
|---|---|---|
| | butylmethacrylate-isobutylmeth-acrylate-acrylate (37:29:25:9) | |
| P-39 | Copolymer of n-butylmethacrylate-acrylate (95:5) | (20) |
| P-40 | Copolymer of methylmethacrylate-acrylate (95:5) | (105) |
| P-41 | Copolymer of benzylmethacrylate-acrylate (90:10) | (54) |
| P-42 | Copolymer of n-butylmethacrylate-methylmethacrylate-benzylmeth-acrylate (35:35:25:5) | (20, 105) |
| P-43 | Copolymer of n-butylmethacrylate-methylmethacrylate-benzylmethacry-late (35:35:30) | (20) |
| P-44 | Poly(3-pentylacrylate) | (−6) |
| P-45 | Copolymer of cyclohexylmethacrylate-methylmethacrylate-n-propylmeth-acrylate (37:29:34) | (104) |
| P-46 | Poly(pentylmethacrylate) | −5 |
| P-47 | Copolymer of methylmethacrylate-n-butylmethacrylate (65:35) | (105, 20) |
| P-48 | Copolymer of vinylacetate-vinyl-propionate (75:25) | (32) |
| P-49 | Copolymer of n-butylmethacrylate-sodium-3-acryloxybutane-1-sulfonate (97:3) | (20) |
| P-50 | Copolymer of n-butylmethacrylate-methylmethacrylate-acrylamide (35:35:30) | (20, 105) |
| P-51 | Copolymer of n-butylmethacrylate-methylmethacrylate-vinyl chloride (37:36:27) | (20, 105) |
| P-52 | Copolymer of n-butylmethacrylate-styrene (90:10) | (20) |
| P-53 | Copolymer of methylmethacrylat:-N-vinyl-2-pyrrolidone | (105) |
| P-54 | Copolymer of n-butylmethacrylate-vinylchloride (90:10) | (20) |
| P-55 | Copolymer of n-butylmethacrylate-styrene (70:30) | (20) |
| P-56 | Poly(N-sec-butylacrylamide) | 117 |
| P-57 | Poly(N-tert-butylacrylamide) | 128 |
| P-58 | Copolymer of diacetoneacrylamide-methylmethacrylate (62:38) | (60, 105) |
| P-59 | Copolymer of poly(cyclohexylmeth-acrylate)-methylmethacrylate (60:40) | (104, 105) |
| P-60 | Copolymer of N-tert-butylacryl-amide-methylmethacrylate (40:60) | (128, 105) |
| P-61 | Poly(N-n-butylacrylamide) | 46 |
| P-62 | Copolymer of poly(tert-butylacry-late)-N-tert-butylacrylamide (50:50) | (118, 128) |
| P-63 | Copolymer of tert-butylmethacrylate-methylmethacrylate (70:30) | (118) |
| P-64 | Poly(N-tert-butylmethacrylamide) | 160 |
| P-65 | Copolymer of N-tert-butylacryl-amide-methylmethacrylate (60:40) | (128, 105) |
| P-66 | Copolymer of methylmethacrylate-acrylonitrile (70:30) | (105) |
| P-67 | Copolymer of methylmethacrylate-vinylmethylketone nylmethylketone (38:62) | (105, —) |
| P-68 | Copolymer of methylmethacrylate-styrene (75:25) | (105) |
| P-69 | Copolymer of methylmethacrylate-hexylmethacrylate (70:30) | (105) |
| P-70 | Poly(benzylacrylate) | 6 |
| P-71 | Poly(4-biphenylacrylate) | 110 |
| P-72 | Poly(4-butoxycarbonyl phenylacrylate) | 13 |
| P-73 | Poly(sec-butylacrylate) | −22 |
| P-74 | Poly(tert-butylacrylate) | 43 |
| P-75 | Poly[3-chloro-2,2-bis(chloromethyl)-propylacrylate] | 46 |
| P-76 | Poly(2-chlorophenylacrylate) | 53 |
| P-77 | Poly(4-chlorophenyl acrylate) | 58 |
| P-78 | Poly(pentachlorophenyl acrylate) | 147 |
| P-79 | Poly(4-cyanobenzyl acrylate) | 44 |
| P-80 | Poly(cyanoethyl acrylate) | 4 |
| P-81 | Poly(4-cyanophenyl acrylate) | 90 |
| P-82 | Poly(4-cyano-3-thiabutyl acrylate) | −24 |
| P-83 | Poly(cyclohexyl acrylate) | 19 |

-continued

| Examples | Polymers | Tg (°C.) |
|---|---|---|
| P-84 | Poly(2-ethoxycarbonylphenyl acrylate) | 30 |
| P-85 | Poly(3-ethoxycarbonylphenyl acrylate) | 24 |
| P-86 | Poly(4-ethoxycarbonylphenyl acrylate) | 37 |
| P-87 | Poly(2-ethoxyethyl acrylate) | −50 |
| P-88 | Poly(3-ethoxypropyl acrylate) | −55 |
| P-89 | Poly(1H,1H,5H-octafluoropentyl acrylate) | −35 |
| P-90 | Poly(heptyl acrylate) | −60 |
| P-91 | Poly(hexadecyl acrylate) | 35 |
| P-92 | Poly(hexyl acrylate) | −57 |
| P-93 | Poly(iso-butyl acrylate) | −24 |
| P-94 | Poly(iso-propyl acrylate) | −5 |
| P-95 | Poly(3-methoxybutyl acrylate) | −56 |
| P-96 | Poly(2-methoxycarbonylphenyl acrylate) | 46 |
| P-97 | Poly(3-methoxycarbonylphenyl acrylate) | 38 |
| P-98 | Poly(4-methoxycarbonylphenyl acrylate) | 67 |
| P-99 | Poly(2-methoxyethyl acrylate) | −50 |
| P-100 | Poly(4-methoxyphenyl acrylate) | 51 |
| P-101 | Poly(3-methoxypropyl acrylate) | −75 |
| P-102 | Poly(3,5-dimethyladamanthyl acrylate) | 106 |
| P-103 | Poly(3-dimethylaminophenyl acrylate) | 47 |
| P-104 | Poly(tert-butylate) | 86 |
| P-105 | Poly(2-methylbutyl acrylate) | −32 |
| P-106 | Poly(3-methylbutyl acrylate) | −45 |
| P-107 | Poly(1,3-dimethylbutyl acrylate) | −15 |
| P-108 | Poly(2-methylpentyl acrylate) | −38 |
| P-109 | Poly(2-naphtyl acrylate) | 85 |
| P-110 | Poly(phenyl acrylate) | 57 |
| P-111 | Poly(propyl acrylate | −37 |
| P-112 | Poly(m-tolyl acrylate) | 25 |
| P-113 | Poly(o-tolyl acrylate) | 52 |
| P-114 | Poly(p-tolyl acrylate) | 43 |
| P-115 | Poly(N,N-dibutyl acrylamide) | 60 |
| P-116 | Poly(iso-henxyl acrylamide) | 71 |
| P-117 | Poly(iso-octylacrylamide) | 66 |
| P-118 | Poly(N-methyl-N-phenylacrylamide) | 180 |
| P-119 | Poly(adamanthyl methacrylate) | 141 |
| P-120 | Poly(benzyl methacrylate) | 54 |
| P-121 | Poly(2-bromoethyl methacrylate) | 52 |
| P-122 | Poly(2-N-tert-butylaminoethyl methacrylate) | 33 |
| P-123 | Poly(sec-butyl methacrylate) | 60 |
| P-124 | Poly(tert-butyl methacrylate) | 118 |
| P-125 | Poly(2-chloroethyl methacrylate) | 92 |
| P-126 | Poly(2-cyanoethyl methacrylate) | 91 |
| P-127 | Poly(2-cyanomethylphenyl methacrylate) | 128 |
| P-128 | Poly(4-cyanophenyl methacrylate) | 155 |
| P-129 | Poly(cyclohexyl methacrylate) | 104 |
| P-130 | Poly(dodecyl methacrylate) | −65 |
| P-131 | Poly(diethylaminoethyl methacrylate) | −20 |
| P-132 | Poly(2-ethylsulfinylethyl meth-acrylate) | 25 |
| P-133 | Poly(hexadecyl methacrylate) | 15 |
| P-134 | Poly(hexyl methacrylate) | −5 |
| P-135 | Poly(2-hydroxypropyl methacrylate) | 76 |
| P-136 | Poly(4-methoxycarbonylphenyl meth-acrylate) | 106 |
| P-137 | Poly(3,5-dimethyladamanthyl meth-acrylate) | 196 |
| P-138 | Poly(dimethylaminoethyl methacrylate) | 20 |
| P-139 | Poly(3,3-dimethylbutyl methacrylate) | 45 |
| P-140 | Poly(3,3-dimethyl-2-butyl meth-acrylate) | 108 |
| P-141 | Poly(3,5,5-trimethylhexyl meth-acrylate) | 1 |
| P-142 | Poly(octadecyl methacrylate) | −100 |
| P-143 | Poly(tetradecyl methacrylate) | 80 |
| P-144 | Poly(4-butoxycarbonylphenyl meth-acrylamide | 128 |
| P-145 | Poly(4-carboxyphenyl methacrylamide) | 200 |
| P-146 | Poly(4-ethoxycarbonylphenyl meth-acrylamide) | 168 |
| P-147 | Poly(4-methoxycarbonylphenyl meth-acrylamide) | 180 |
| P-148 | Poly(butyl butoxycarbonylmethacrylate) | 25 |
| P-149 | Poly(butyl chloroacrylate) | 57 |
| P-150 | Poly(butyl cyanoacrylate) | 85 |
| P-151 | Poly(cyclohexyl chloroacrylate) | 114 |
| P-152 | Poly(ethyl chloroacrylate) | 93 |
| P-153 | Poly(ethyl ethoxycarbonylmeth-acrylate) | 52 |

-continued

| Examples | Polymers | Tg (°C.) |
|---|---|---|
| P-154 | Poly(ethyl ethacrylate) | 27 |
| P-155 | Poly(ethyl fluoromethacrylate) | 43 |
| P-156 | Poly(hexyl hexyloxycarbonylmethacrylate) | −4 |
| P-157 | Poly(iso-butyl chloroacrylate) | 90 |
| P-158 | Poly(iso-propyl chloroacrylate) | 90 |

Remarks:
The data in parentheses shows a glass transition temperature of a homopolymer of the monomer which does not have an acid group and is composed of a captioned polymer in an amount of 35% or more.

An oil soluble coupler providing diffusion resistance according to the present invention are described in detail below.

The oil-soluble coupler treated as providing diffusion resistance, which is herein referred to, is a coupler which is soluble in the aforementioned coupler solvent and is processed to make the coupler diffusion resistant in a photosensitive material. There are several methods for providing diffusion resistance, however, two methods are illustrated hereunder among major methods.

1. A method 1 comprises introducing one or more so-called diffusion resistive groups, a part of which includes an aliphatic group, an aromatic group, or a heterocyclic group. A number of total carbon atoms in the diffusion resistive group is depend on a constituent of a remaining moiety of the coupler, and is, ordinarily, 6 or more, with more preferably, 12 or more.

2. A method 2 wherein the molecular weight of the coupler is increased by polymerizing the coupler (known as a polymer coupler) to make the coupler diffusion resistant.

When the coupler is that produced by Method 1, the molecular weight of the coupler is preferably from 250 to 1,200 and more preferably from 300 to 800.

When the coupler is that produced by Method 2, a trimer or more if preferred.

Examples of cyan couplers in which the above mentioned repeating unit of polymer free of acid radical can be used in the present invention include oil protect type naphthol and phenol couplers. Examples of such naphthol couplers are described in U.S. Pat. No. 2,474,293. Typical examples of preferred such naphthol couplers include oxygen atom-releasing type two-equivalent naphthol couplers as described in U.S. Pat. Nos. 4,052,212, 4,146,396, 4,228,233, and 4,296,200. Specific examples of such phenol couplers are described in U.S. Pat. Nos. 2,369,939, 2,801,171, 2,772,162, and 2,895,826. Other examples of phenol couplers which can be preferably used in the present invention include phenol cyan couplers containing an ethyl group or higher alkyl group in the meta-position of phenol nucleus as described in U.S. Pat. No. 3,772,002, 2,5-diacylamino-substituted phenol couplers as described in U.S. Pat. Nos. 2,772,162, 3,758,308, 4,126,396, 4,334,011, and 4,327,173, West German Patent Disclosure No. 3,329,729, and Japanese Patent Application No. 42671/83, and phenol couplers containing a phenylureide group in the 2-position and an acylamino group in the 5-position as described in U.S. Pat. Nos. 3,446,622, 4,333,999, 4,451,559, and 4,427,767.

Cyan couplers which can be used in the present invention are phenol cyan couplers of the general formula (Cp-I).

Substituents in the general formula (Cp-I) will be described in detail hereinafter.

In the general formula (Cp-I), examples of $C_{1-32}$ alkyl group represented by $R^{31}$ include methyl group, butyl group, tridecyl group, cyclohexyl group, and allyl group. Examples of aryl group represented by $R^{31}$ include phenyl group, and naphtyl group. Examples of heterocyclic group represented by $R^{31}$ include 2-pyridyl group, and 2-furyl group.

$R^{31}$ may be further substituted by substituents selected from the group consisting of alkyl group, aryl group, alkyloxy or aryloxy group such as methoxy, dodecyloxy, methoxyethoxy, phenyloxy, 2,4-di-tert-amylphenoxy, 3-tert-butyl-4-hydroxyphenyloxy, and naphthyloxy, carboxy group, alkylcarbonyl or arylcarbonyl group such as acetyl, tetradecanoyl, and benzoyl, alkyloxycarbonyl or aryloxycarbonyl group such as methoxycarbonyl, and phenoxycarbonyl, acyloxy group such as acetyl, and benzoyloxy, sulfamoyl group such as N-ethylsulfamoyl, and N-octadecylsulfamoyl, carbomoyl group such as N-ethylcarbamoyl, and N-methyl-dodecylcarbamoyl, sulfonamide group such as methanesulfonamide, and benzenesulfonamide, acylamino group such as acetylamino, benzamide, ethoxycarbonylamino, and phenylaminocarbonylamino, imide group such as succinimide, and hydantoinyl, sulfonyl group such as methanesulfonyl, hydroxy group, cyano group, nitro group, and halogen atom.

In the general formula (Cp-I), $Z^{31}$ represents a hydrogen atom, or coupling-off group. Examples of such a coupling-off group include halogen atom such as fluorine atom, chlorine atom, and bromine atom, alkoxy group such as dodecyloxy, methoxycarbamoylmethoxy, carboxypropyloxy, and methylsulfonylethoxy, aryloxy group such as 4-chlorophenoxy, and 4-methoxyphenoxy, acyloxy group such as acetoxy, tetradecanoyloxy, and benzoyloxy, sulfonyloxy group such as methanesulfonyloxy, and toluenesulfonyloxy, amide group such as dichloroacetylamino, methanesulfonylamino, and toluenesulfonylamino, alkoxycarbonyloxy group such as ethoxycarbonyloxy, and benzyloxycarbonyloxy, aryloxycarbonyloxy group such as phenoxycarbonyloxy, aliphatic or aromatic thio group such as phenylthio, 2-tutoxy-5-t-octylphenylthio, and tetraxolylthio, imide group such as succinimide, and hydantoinyl, N-heterocyclic group such as 1-pyraxolyl, and 1-benztriazolyl, and aromatic azo group such as phenylazo. These coupling-off groups may contain photographically useful groups.

In the general formula (Cp-I), examples of acylamino group represented by $R^{32}$ include acetylamino, benzamide, 2,4-di-tert-amylphenoxyacetamide, α-(2,4-di-tert-amylphenoxy)butylamide, α-(2,4-di-tert-amylphenoxy)-β-methylbutylamide, β-(2-chloro-4-di-ter-amylphenoxy)octanamide, α-(2-chlorophenoxy)tetradecanamide, and α-(3-pentadecylphenoxy)butylamide. Examples of alkyl group containing two or more carbon atoms represented by $R^{32}$ include ethyl, propyl, t-butyl, pentadecyl, and benzyl.

In the general formula (Cp-I), $R^{33}$ represents a hydrogen atom, halogen atom such as fluorine atom, chlorine atom, and bromine atom, alkyl group such as methyl, ethyl, n-butyl, n-octyl, and n-tetradecyl, or alkoxy group such as methoxy, 2-ethylhexyloxy, n-octyloxy, and n-dodecyloxy.

In the general formula (Cp-I), $R^{31}$ or $R^{32}$ may form a dimer or polymer.

The preferable combination of these couplers are combinations of the cyan coupler (Cp-I) and the polymers which are composed of a monomer in an amount or 50% such that a homopolymer of said monomer shows a Tg of 50° C. or higher, more preferably, combinations of the cyan coupler (Cp-I) and the polymers which are composed of a monomer in an amount 70% or more such that a homopolymer of said monomer shows a Tg of 80° C. or higher, and the most preferably, combinations of the cyan coupler (Cp-I) wherein $R_{32}$ is an alkyl group having 2 to 4 carbon atoms and polymers which are composed of acrylamide type and/or methacrylamide type in an amount of 70% or more such that a homopolymer of said monomer shows a Tg of 80° C. or higher.

As magenta couplers to be used in the present invention, oil protected indazolone type couplers, cyanoacetyl type couplers, and preferably 5-pyrazolone type couplers and pyrazoloazole type couplers such as pyrazolotriazole type couplers are exemplified. Of 5-pyrazolone type couplers, those substituted with an arylamino group or an acylamino group at the 3-position thereof are preferred because of the hue and color density of dyes formed therefrom. Typical examples thereof are described in U.S. Pat. Nos. 2,311,082, 2,343,703, 2,600,788, 2,908,573, 3,062,653, 3,152,896, 3,936,015, etc. 2-Equivalent 5-pyrazolone type couplers are preferably employed. As releasing groups for 2-equivalent 5-pyrazolone type couplers, nitrogen atom releasing groups as described in U.S. Pat. No. 4,310,619 and arylthio groups as described in U.S. Pat. No. 4,351,897 are preferred. Further, 5-pyrazolone type couplers having a ballast group as described in European Patent 73,636 are advantageous since they provide high color density.

Examples of pyrazoloazole type couplers include pyrazolobenzimidazoles as described in U.S. Patent 3,369,879, and preferably pyrazolo[5,1-c][1,2,4]triazoles as described in U.S. Pat. No 3,725,067, pyrazolotetrazoles as described in *Research Disclosure,* No. 24220 (June, 1984) and pyrazolopyrazoles as described in *Research Disclosure,* No. 24230 (June, 1984). Imidazo[1,2-b]-pyrazoles as described in European Patent 119,741 are preferred and pyrazolo[1,5-b][1,2,4]triazoles as described in European Patent 119,860 are particularly preferred because of less yellow subsidiary absorption and light fastness of dyes formed therefrom and because they are very effective in achieving the objectives of the present invention.

Examples of magenta couplers which can be more preferably used in the present invention include those represented by the general formula (Cp-II) and/or the general formula (Cp-III).

Substituents for the general formula (Cp-II) will be described in detail hereinafter.

Ar represents an aryl group such as phenyl, 2,4,6-trichlorophenyl, 2,5-dicholophenyl, 2,6-dichloro-4-methoxyphenyl, 2,4-dimethyl-6-methoxyphenyl, 2,6-dichloro-4-ethoxycarbonylphenyl, and 2,6-dichloro-4-cyanophenyl. $R_{21}$ represents a hydrogen atom, acyl group such as acetyl, benzoyl, propanoyl, butanoyl, and monochloroacetyl, or aliphatic or aromatic sulfonyl group such as methanesulfonyl, butanesulfonyl, benzenesulfonyl, toluenesulfonyl, and 3-hydroxypropanesulfonyl. $R_{22}$ represents a halogen atom such as chlorine atom, bromine atom, and fluorine atom, or alkoxy group such as methoxy, butoxy, benzyloxy, and 2-methoxyethoxy. $R_{23}$ represents an alkyl group such as methyl, butyl, t-butyl, t-octyl, dodecyl, 2,4-di-tert-pentylphenoxymethyl, and hexadecyl, aryl group such as phenyl, and 2,4-dichlorophenyl, halogen atom such as chlorine atom, fluorine atom, and bromine atom, alkoxy group such as methoxy, dodecyloxy, benzyloxy, and hexadecyloxy, aryloxy group such as phenoxy, and 4-dodecylphenoxy, acylamino group such as acetylamino, tetradecaneamide, α-(2,4-di-tert-pentylphenoxy)butylamide, α-(4-hydroxy-3-tert-butylphenoxy)tetradecaneamide, and α-[4-(4-hydroxyphenylsulfonyl)phenoxy]dodecaneamide, imide group such as N-succinimide, N-maleinimide, 1-N-benzyl-5,5-dimethyl-hydantoin-3-il, and 3-hexadecenyl-1-succinimide, sulfonamide group such as methanesulfonamide, benzenesulfonamide., tetradecanesulfonamide, 4-dodecyloxybenzenesulfonamide, and 2-octyloxy-5-tert-octylbenzenesulfonamide, alkoxycarbonyl group such as ethoxycarbonyl, dodecyloxycarbonyl, and hexadecyloxycarbonyl, carbamoyl group such as N-phenylcarbamoyl, N-ethylcarbamoyl, N-dodecylcarbamoyl, N-(2-dodecyloxyethyl)carbamoyl, and N-[3-(2,4-di-tert-pentylphenoxy)propyl]carbamoyl, sulfamoyl group such as N,N-diethylsulfamoyl, N-ethyl-N-(2-dodecyloxyethyl)sulfamoyl, and N-[3-(2,4-di-tert-pentylphenoxy)propylzsulfamoyl, alkylthio group such as ethylthio, dodecylthio, octadecyl, and 3-(2,2-di-tert-phenoxy)propylthio, or sulfonyl group such as methanesulfonyl, tetradecanesulfonyl, i-octadecanesulfonyl, and benzenesulfonyl.

Referring in detail to $R_{27}$,$R_{27}$ represents an alkyl group preferably containing 1 to 22 carbon atoms such as methyl, ethyl, n-hexyl, n-dodecyl, t-butyl, 1,1,3,3-tetramethylbutyl, and 2-(2,4-di-tert-amylphenoxy) ethyl, alkoxy group preferably containing 1 to 22 carbon atoms such as methoxy, ethoxy, n-butoxy, n-octyloxy, 2-ethylhexyloxy, n-dodecyloxy, n-hexadecyloxy, 2-ethoxyethoxy, 2-dodecyloxyethoxy, 2-methanesulfonylethoxy, 2-methanesulfonamide,3-(N-2-hydroxyethylsulfamoyl)proppoxy, and 2-(N-2-methoxyethylcarbonyl)ethoxy, or aryloxy group preferably containing 6 to 32 carbon atoms such as phenoxy, 4-chlorophenoxy, 2,4-dichlorophenoxy, 4-methoxyphenoxy, 4-dodecyloxyphenoxy, and 3,4-methylenedioxyphenoxy. Referring in detail to $R_{29}$, $R_{29}$ represents a hydrogen atom, halogen atom such as fluorine atom, chlorine atom, and bromine atom, hydroxy group, alkyl group, alkoxy group, or aryl group. Such alkyl and alkoxy groups each preferably contain 1 to 22 carbon atoms as defined in $R_{27}$. Such an aryl group represents an aryl group preferably containing 6 to 32 carbon atoms such as phenyl, 2,4-dichlorophenyl, 4-methoxyphenyl, 4-dodecyloxyphenyl, 2,4-di-tert-amylphenoxy, 4-tert-octylphenyl, and 4-(2-ethylhexaneamide)phenyl.

Referring in detail to $R_{28}$, $R_{28}$ represents a substituted or unsubstituted amino group such as N-alkylamino group, N,N-dialkylamino group, N-anilino group, N-alkyl-N-arylamino group, and heterocyclic amino group (e.g., N-butylamino, N,N-diethylamino, N-[2-(2,4-di-tert-amylphenoxy)ethyl]amino, N,N-dibutylamino, N-piperidino, N,N-bis-(2-dodecyloxyethyl)amino, N-cyclohexylamino, N,N-di-hexylamino, N-phenylamino, 2,4-di-tert-amylphenylamino, N-(2-chloro-5-tetradecaneamidephenyl)amino, N-methyl-N-phenylamino, and N-(2-pyridyl) amino, acylamino group such as acetamide, benzamide, tetradecaneamide, (2,4-di-tert-amylphenoxy)acetamide, 2-chloro-benzamide, 3-pentadecylbenzamide, 2-(2-methanesulfonamidephenoxy)dodecaneamide, and 2-(2-chlorophenoxy)tetradecaneamide, ureide group such as methylureide, phenylureide, and 4-cyanophenylureide, alkoxycarbonylamino group such as methoxycarbonylamino, dodecyloxycarbonylamino, and 2-ethylhexyloxycarbonylamino, imide group such as N-succinimide, N-phthalimide, N-hydantoinyl, 5,5-dimethyl-2,4-dioxooxazole-3-il, and N-(3-octadecenyl)succimide, sulfonamide group such as methanesulfonamide, octanesulfonamide, benzenesulfonamide, 4-chlorobenzenesulfonamide, 4-dodecylbenznesulfonamide, N-methyl-N-benzenesulfonamide, 4-dodecyloxybenzenesulfonamide, and hexadecanesulfonamide, sulfamoylamino group such as N-octylsulfamoylamino, N,N-dipropylsulfamoylamino, N-ethyl-N-phenylsulfamoylamino, and N-(4-butyloxy)sulfamoylamino, alkoxycarbonyl group such as methoxycarbonyl, butoxycarbonyl, dodecyloxycarbonyl, and benzyloxycarbonyl, carbamoyl group such as N-octylcarbamoyl, N,N-dibutylcarbamoyl, N-phenylcarbamoyl, and N-[3-(2,4-di-tert-amylphenoxy)propyl]carbamoyl, acyl group such as acetyl, benzoyl, hexanoyl, 2-ethylhexanoyl, and 2-chlorobenzoyl, cyano group, or alkylthio group such as dodecylthio, 2-ethylhexylthio, benzylthio, 2-oxocyclohexylthio, 2-(ethyltetradecanoate)thio, 2-(dodecylhexanoate)thio, 3-phenoxypropylthio, and 2-dodecanesulfonylethylthio.

Particularly preferred among compounds represented by the general formula (Cp-II) is a compound wherein $R_{21}$ represents a hydrogen atom, $R_{22}$ represents a halogen atom, $R_{27}$ represents a $C_{1-22}$ alkoxy group, $m_1$ and $m_2$ each represent an integer of 1, and $m_3$ represents 0.

Substituents for the general formula (Cp-III) will be described in detail hereinafter.

$R_{24}$ represents a hydrogen atom, halogen atom, alkyl group, aryl group, heterocyclic group, cyano group, alkoxy group, aryloxy group, heterocyclic oxy group, acyloxy group, carbamoyloxy group, silyloxy group, sulfonyloxy group, acylamino group, anilino group, ureide group, imide group, sulfamoylamino group, carbamoylamino group, alkylthio group, arylthio group, heterocyclic thio group, alkoxycarbonylamino group, aryloxycarbonylamino group, sulfonamide group, carbamoyl group, acyl group, sulfamoyl group, sulfonyl group, sulfinyl group, alkoxycarbonyl group, or aryloxycarbonyl group. Referring further to these substituents, $R_{24}$ represents a hydrogen atom, halogen atom such as chlorine atom, and bromine atom, alkyl group such as methyl, propyl, isopropyl, t-butyl, trifluoromethyl, tridecyl, 3-(2,4-di-amylphenoxy)propyl, allyl, 2-dodecyloxyethyl, 3-phenoxypropyl, 2-hexylsulfonylethyl, 3-(2-butoxy-5-t-hexylphenylsulfonyl)propyl, cyclopentel, and benzyl, aryl group such as phenyl, 4-t-butylphenyl, 2,4-di-t-amylphenyl, and 4-tetradecaneamidephenyl, heterocyclic group such as 2-furyl, 2-chenyl, 2-pyrimidinyl, and 2-benzothiazolyl, cyano group, alkoxy group such as methoxy, ethoxy, 2-methoxyethoxy, 2-dodecyloxyethoxy, 2-phenoxyethoxy, and 2-methanesulfonylehtoxy, aryloxy group such as phenoxy, 2-methylphenoxy, 2-methoxyphenoxy, and 4-t-butylphenoxy, heterocyclic oxy group such as 2-benzimidazolyloxy, acyloxy group such as acetoxy, and hexadecanoiloxy, carbamoyloxy group such as N-phenylcarbamoyloxy, and N-ethylcarbamoyloxy, silyloxy group such as trimethylsilyloxy, sulfonyloxy group such as dodecylsulfonyloxy, acylamino group such as acetamide, benzamide, tetradecaneamide, α-(2,4-di-t-amylphenoxy) butylamide, γ-(3-t-butyl-4-hydroxyphenoxy)butylamide, and α-[4-(4-hydroxyphenylsulfonyl)phenoxyl]decaneamide, anilino group such as phenylamino, 2-chloroanilino, 2-chloro-5-tetradecaneamideanilino, 2-chloro-5-dodecyloxycarbonylanilino, N-acetylanilino, and 2-chloro-5-[α-(3-t-butyl-4-hydroxyphenoxy)-dodecaneamide]anilino, ureide group such as phenylureide, methylureide, and N,N-di-butylureide, imide group such as N-succinimide, 3-benzylhydantoinyl, and 4-(2-ethylhexanoilamino)phthalimide, sulfamoylamino group such as N,N-dipropylsulfamoylamino, and N-methyl-N-decylsulfamoyl, alkylthio group such as methylthio, octylthio, tetradecylthio, 2-phenoxyethylthio, 3-phenoxypropylthio, and 3-(4-t-butylphenoxy) propylthio, arylthio group such as phenylthio, 2-butoxy-5-t-octylphenylthio, 2-butoxy-5-t-octylphenylthio, 3-pentadecylphenylthio, 2-carboxyphenylthio, and 4-tetradecaneamidephenylthio, heterocyclic thio group such as 2-benzothiazolylthio, alkoxycarbonylamino group such as methoxycarbonylamino, and tetradecyloxycarbonylamino, aryloxycarbonylamino group such as phenoxycarbonylamino, and 2,4-di-tert-butylphenoxycarbonylamino, sulfonamide group such as methanesulfonamide, hexadecanesulfonamide, benznesulfonamide, p-toluenesulfonamide, octadecanesulfonamide, and 2-methyloxy-5-t-butylbenzenesulfonamide, carbamoyl group such as N-ethylcarbamoyl, N,N-dibutylcarbamoyl, N-(2-dodecyloxyethyl)carbamoyl, and N-[3-(2,4-di-tert-amylphenoxy)propyl]carbamoyl, acyl group such as acetyl, (2,4-di-tert-amylphenoxy)acetyl, and benzoyl, sulfamoyl group such as N-ethylsulfamoyl, N,N-dipropylsulfamoyl, N-(2-dodecyloxyethyl)sulfamoyl, N-ethyl-N-dodecylsulfamoyl, and N,N-diethylsulfamoyl, sulfonyl group such as methanesulfonyl, octanesulfonyl, benzenesulfonyl, toluenesulfonyl, and 2-butoxy-5-tert-octylphenylsulfonyl, sulfinyl group such as octanesulfinyl, dodecylsulfinyl, and phenylsulfinyl, alkoxycarbonyl group such as methoxycarbonyl, butyloxycarbonyl, dodecylcarbonyl, and octanedecylcarbonyl, or aryloxycarbonyl group such as phenyloxycarbonyl, and 3-pentadecyloxycarbonyl.

In the general formula (Cp-III), $Z_{21}$ represents a hydrogen atom, or group capable of being released upon a reaction with an oxidation product of an aromatic primary amine color developing agent. Referring further to the releasable group represented by $Z_{21}$, examples of the releasable group include halogen atom such as fluorine atom, chlorine atom, and bromine atom, alkoxy group such as dodecyloxy, dodecyloxycarbonylmethoxy, methoxycarbamoylmethoxy, carboxypropyloxy, and methanesulfonyloxy, aryloxy group such as 4-methylphenoxy, 4-tert-butylphenoxy, 4-methoxyphenoxy, 4-methanesulfonylphenoxy, and 4-(4-benzyloxyphenylsulfonyl)phenoxy, acyloxy group such as acetoxy, tetradecanoyloxy, and benzoyloxy, sulfonyloxy group such as methanesulfonyloxy, and toluenesulfonyloxy, amide group such as dichloroacetylamino, methanesulfonylamino, and triphonylphosphonamide, alkoxycarbonyloxy group such as ethoxycarbonyloxy, and benzyloxycarbonyloxy, aryloxycarbonyl group such as phenoxycarbonyloxy, aliphatic or aromatic thio group such as phenylthio, dodecylthio, benzylthio, 2-butoxy-5-tert-octylphenylthio, 2,5-di-octyloxyphenylthio, 2-(2-ethoxy)-5-tert-octylphenylthio, and tetrazolylthio, imide group such as succinimide, hydantoinyl, 2,4-dioxooxazolidine-3-il, and 3-benzyl-4-ethoxyhydantoin-1-il, N-heterocyclic ring such as 1-pyrazolyl, 1-benzotriazolyl, and 5-chloro-1,2,4-triazole-1-il, and aromatic azo group such as phenylazo. These releasable groups may contain photographically useful groups.

In the general formula (Cp-III), $R_{24}$ or $Z_{21}$ may form a dimer or higher polymer.

Particularly preferred among compounds represented by the general formula (Cp-III) is a compound represented by the general formula (Cp-IV) or (Cp-V):

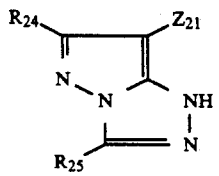

General formula (Cp-IV)

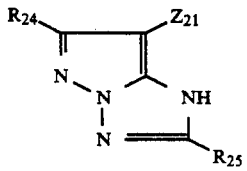

General formula (Cp-V)

wherein $R_{24}$ and $Z_{21}$ have the same meaning as defined in the general formula (Cp-III); and $R_{25}$ has the same meaning as $R_{24}$, with the proviso that $R_{24}$ and $R_{25}$ may be the same or different.

Particularly preferred among these compounds are those represented by the general formula (Cp-V).

As typical yellow couplers used in the present invention, oil protected acylacetamide type couplers are exemplified. Specific examples thereof are described in U.S. Pat. Nos. 2,407,210, 2,875,057, 3,265,506, etc. In the present invention, 2-equivalent yellow couplers are preferably employed and typical examples thereof include yellow couplers of the oxygen atom releasing type as described in U.S. Pat. Nos. 3,408,194, 3,447,928, 3,933,501, 4,022,620, etc., and yellow couplers of nitrogen atom releasing type as described in Japanese Patent Publication No. 10739/83, U.S. Pat. Nos. 4,401,752 and 4,326,024, *Research Disclosure*, No. 18053 (April, 1979), British Patent 1,425,020, West German Patent Application (OLS) Nos. 2,219,917, 2,261,361, 2,329,587, 2,433,812, etc. α-Pivaloylacetanilide type couplers are characterized by excellent fastness, particularly light fastness of dyes formed therefrom, and α-benzoylacetanilide type couplers are characterized by providing high color density.

More preferable yellow coupler which may be used in the present invention is a yellow coupler (Cp-IV) as set forth below.

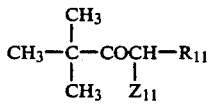

General formula (Cp-IV)

wherein $R_{11}$ represents substituted or unsubstituted N-phenyl carbamoyl group; and $Z_{11}$ represents a group which may be released when the coupler reacts with an oxidation products of an aromatic primary amine color developing agent.

In general formula (Cp-VI), substituents of a phenyl group in N-phenylcarbamoyl group represented by $R_{11}$ include an aliphatic group (such as methyl, allyl, cyclopentyl), a heterocycryl group (such as 2-pyridyl, 2-imidazaryl, 2-fryl, 6-quinoryl), an aliphatic oxy group (such as methoxy, 2-methoxyethoxy, 2-propenyloxy), an aromatic oxy group (such as 2,4-di-tert-amylphenoxy, 4-cyanophenoxy, 2-chlorophenoxy), an acyl group (such as an acetyl, benzoyl), an ester group (such as a butyoxycarbonyl, a hexadecyloxycarbonyl, phenoxycarbonyl, dodecyloxy, carbonylmethoxycarbonyl, acetoxy, benzoyloxy, tetradecyloxysulfonyl, hexadecanesulfonyl, etc.), an amido group (such as acetylamino, dodecanesulfoneamido, α-(2,4-di-tert-pentylphenoxy)butanamido, γ-(2,4-di-tert-pentylphenoxy)-butanamido, N-tetradexylcarbamoyl, N,N-dihexylcarbamoyl, N-butansulfamoyl, N-methyl-N-tetradecahsulfamoyl), an imido group (such as succinimido, N-hidantonyl, 3-hexadecenylsuccinimido), an ureido group (such as phenylureido, N,N-dimethylureido, N-(3-(2,4-di-tert-pentylphenoxy)propyl)ureido), an aliphatic or aromatic sulfonyl group (such as methanesulfonyl, phenylsulfonyl, dodecanesulfonyl, 2-butoxy-5-tert-octylbenzenesulfonyl), an aliphatic or aromatic thio group (such as phenylthio, ethylthio, hexadecylthio, 4-(2,4-di-tert-phenoxyacetoamido)benzylthio), a hydroxy group, a sulfonic acid group, a halogen atom (such as fluorine, chlorine, bromine) and the like. When two or more of substituent group are present, these may be the same or different.

In general formula (Cp-VI), $Z_{11}$ represents a coupling rease group which includes a halogen atom (such as fluorine, chlorine, bromine), an alkoxy group (such as dodesyloxy, dodesyloxycarbonylmethoxy, methoxycarbamoylmethoxy, carboxypropyloxy, methanesulfonyloxy), an aryloxy group (such as 4-methylphenoxy, 4-tert-butylphenoxy, 4-methanesulfonylphenoxy, 4-(4-benzyloxyphenylsulfonyl)phenoxy, 4-methoxycarbonylphenoxy), an acyloxy group (such as acetoxy, tetradecanoyloxy, benzoyloxy), sulfonyloxy group (such as methanesulfonyloxy, toluenesulfonyloxy), an amido group (such as dichloroacetylamino, methanesulfonylamino), an alkoxycarbonyloxy group (such as ethoxycarbonyloxy, benzyloxycarbonyloxy), an aryloxy carbonyloxy group (such as phenoxycarbonyloxy), an aliphatic or aromatic thio group (such as phenylthio, dodesylthio, benzylthio, 2-butoxy-5-tert-octylphenylthio, 2-(2-ethoxyethoxy)-5-tert-octylphenylthio, tetrazalylthio), an imido group (such as succinimido, hydantonyl, 2,4-dioxazolidyne-3-yl, 3-benzyl-4-ethoxyhydantoin-1-yl, 3-benzylhydantoin-1-yl, 1-benzyl-2-phenyl-3,5-dioxo-1,2,4-triazolidine-4-yl, 3-benzyl-4-ethoxyhydantoin-1-yl), an heterocyclic ring (such as 1-pyrazolyl, 1-benzotriazolyl, 5-chloro-1,2,4-triazole-1-yl), an aromatic azo group (such as phenylazo) and the like.

These releasable groups in the compound may contain a photographically useful group.

In general formula (Cp-VI), $R_{11}$ and $Z_{11}$ may form divalent or more higher valent groups.

The amount of the coupler used in the present invention is generally from 0.01 to 2 mols, preferably from 0.1 to 1.0 mol per mol of silver halide present in the silver halide emulsion layer.

Preferred specific examples of cyan couplers which can be used in the present invention are set forth below, but the present invention should not be construed as being limited thereto.

(C-1)
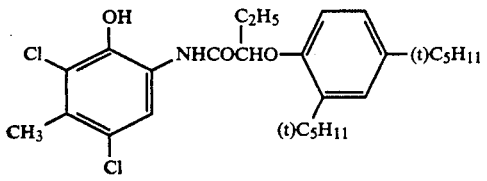
(C-2)
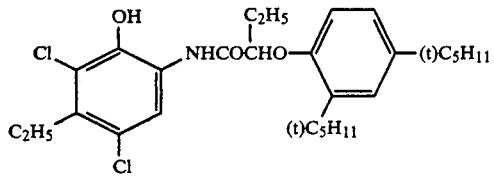
(C-3)
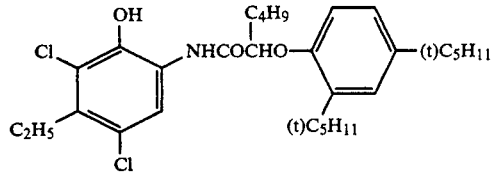
(C-4)
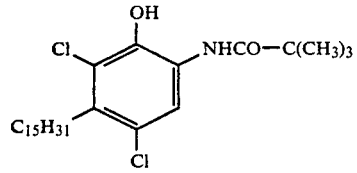
(C-5)
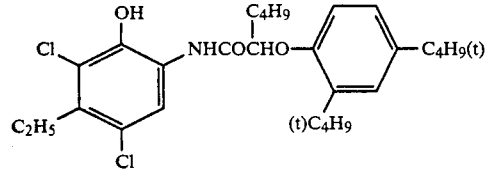
(C-6)
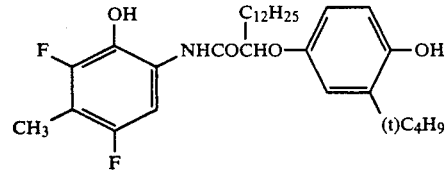
(C-7)
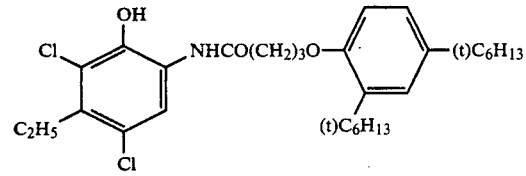
(C-8)
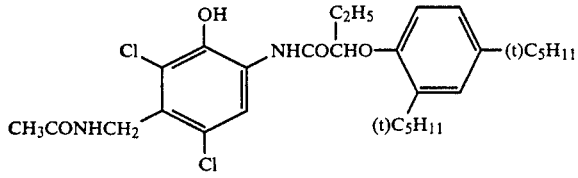

-continued
(C-9)
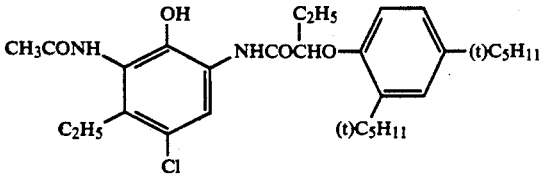
(C-10)
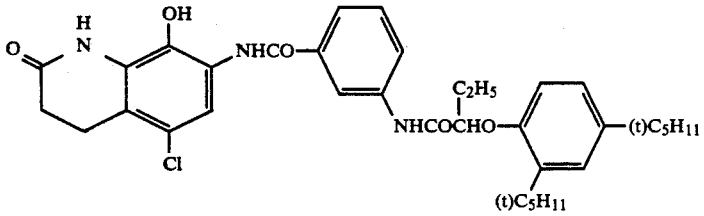
(C-11)
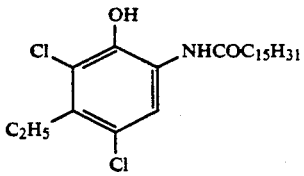
(C-12)
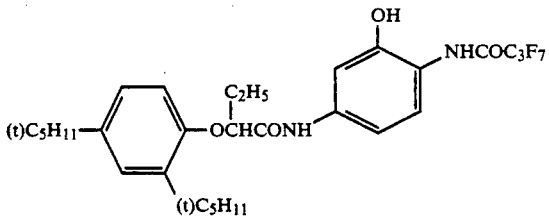
(C-13)
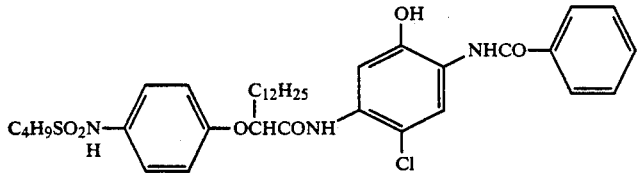
(C-14)
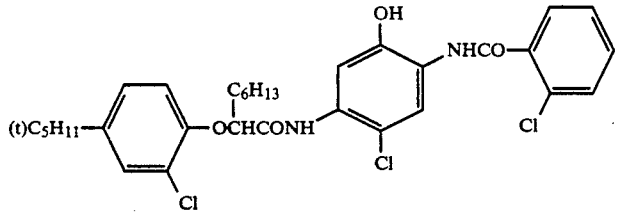
(C-15)
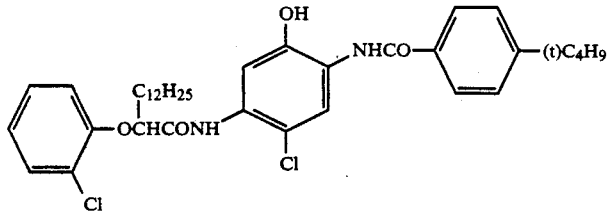
(C-16)
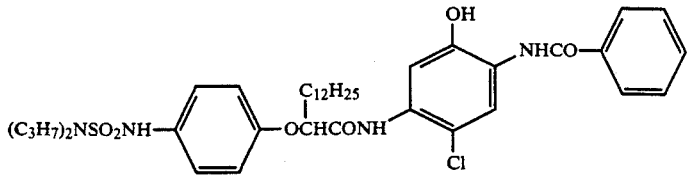

-continued
(C-17)
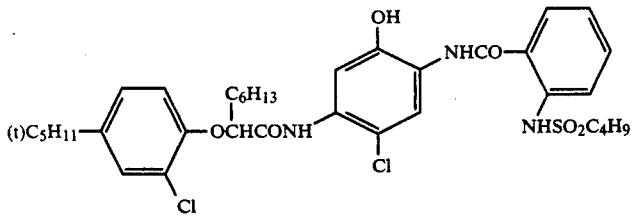
(C-18)
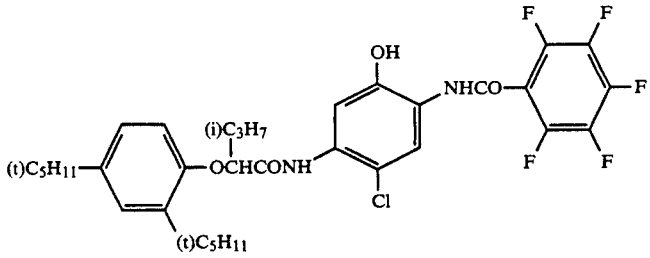
(C-19)
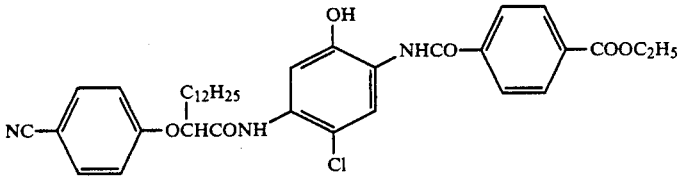
(C-20)
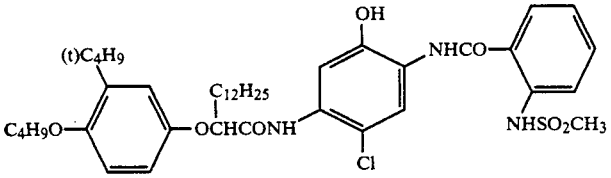
(C-21)
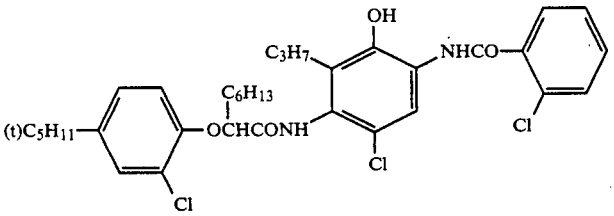
(C-22)
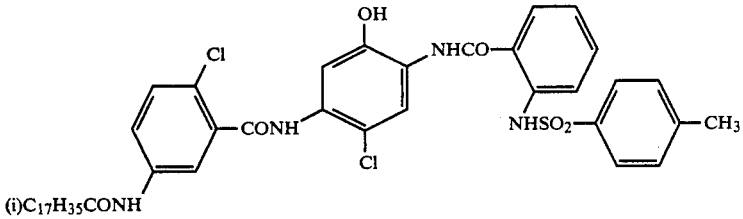
(C-23)
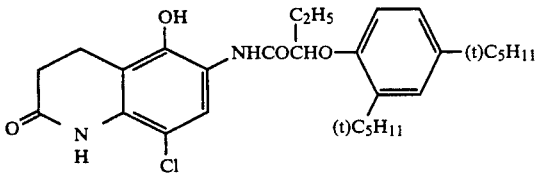

-continued
(C-24)
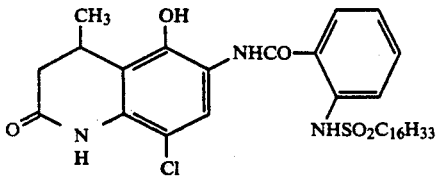
(C-25)
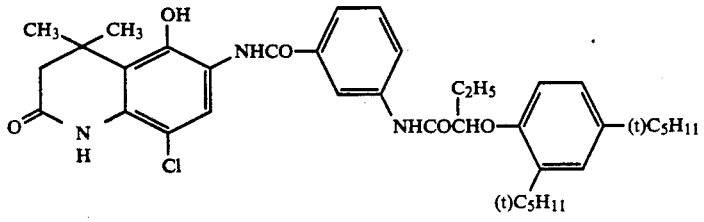
(C-26)
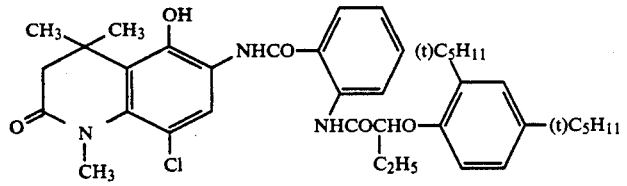
(C-27)
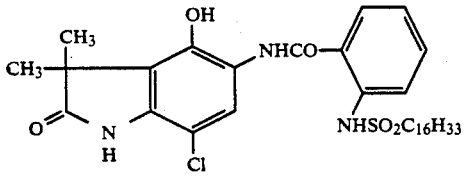
(C-28)
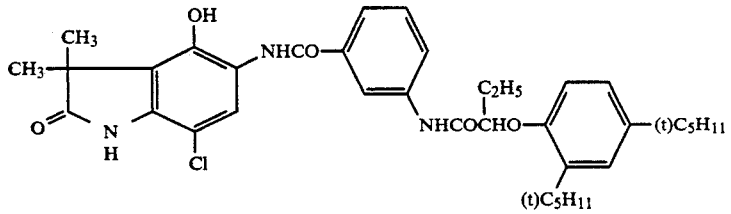
(C-29)
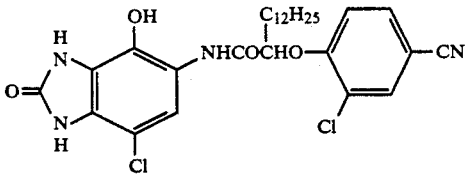
(C-30)
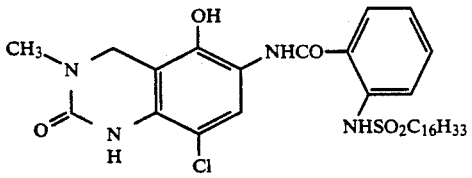
(C-31)
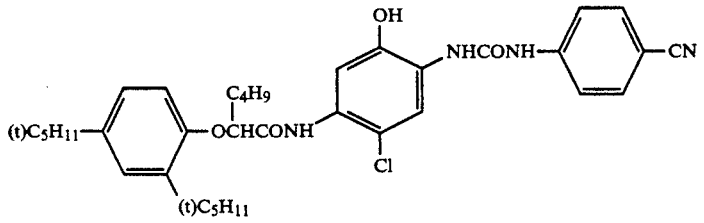

-continued
(C-32)
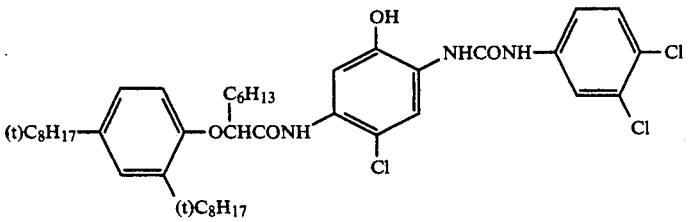
(C-33)
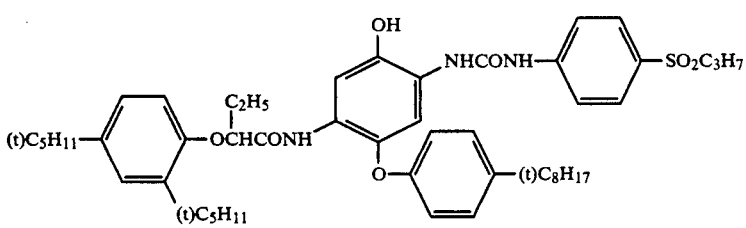
In the following, the ratio of x and y or x, y and z is by weight.
(C-34)
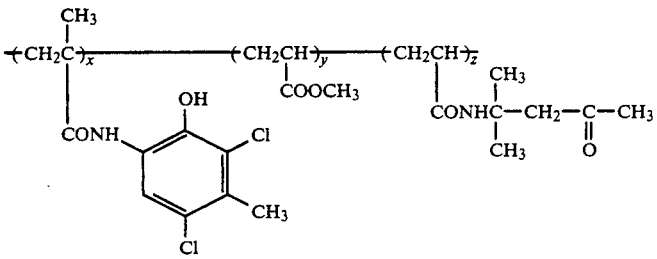
x:y:z = 50:20:30
(C-35)
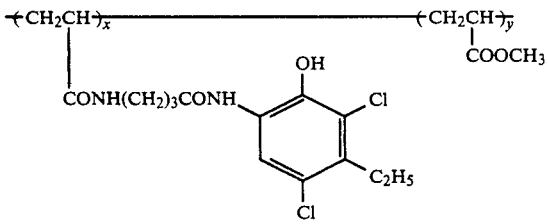
x:y = 55:45
(C-36)
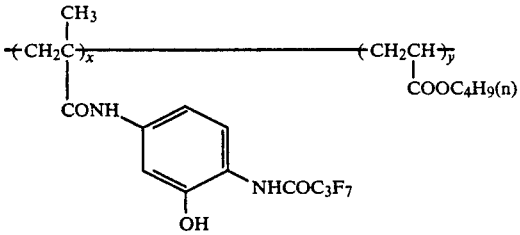
x:y = 60:40
(C-37)
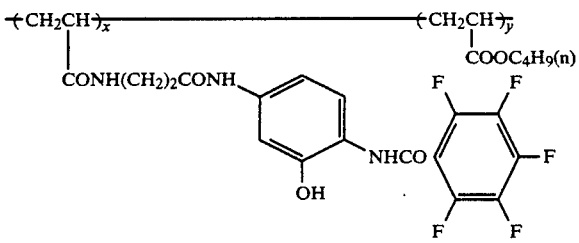
x:y = 50:50

-continued
(C-38)
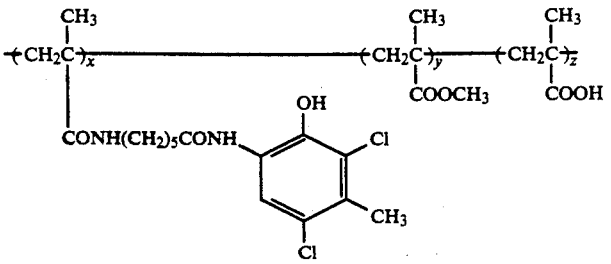
x:y:z = 55:40:5
(C-39)
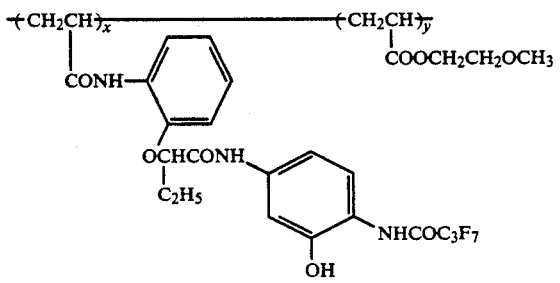
x:y = 60:40
(C-40)
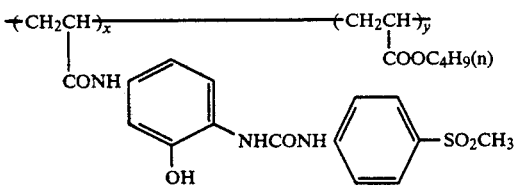
x:y = 50:50
(C-41)
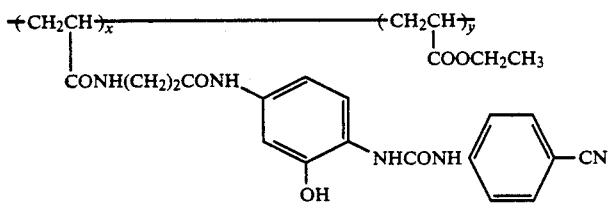
x:y = 45:55
(C-42)
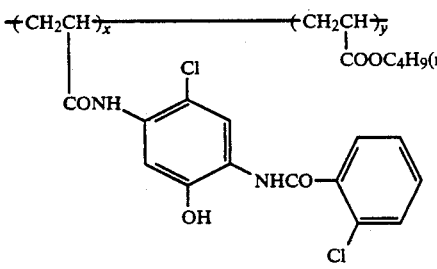
x:y = 50:50
(C-43)
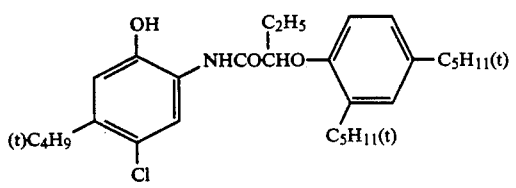

-continued
(C-44)
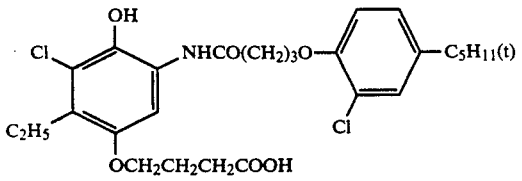
(C-45)
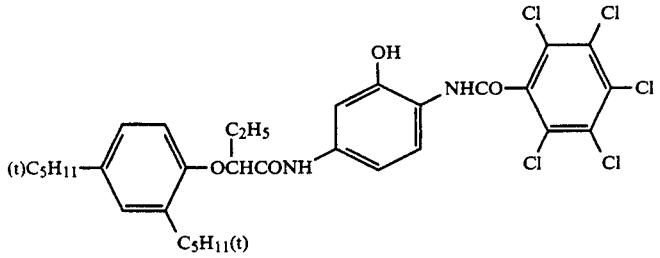
(C-46)
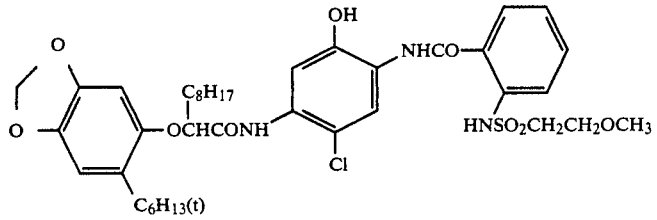
(C-47)
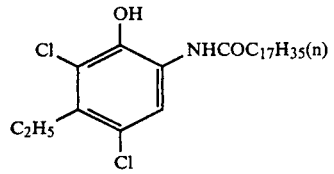
(C-48)
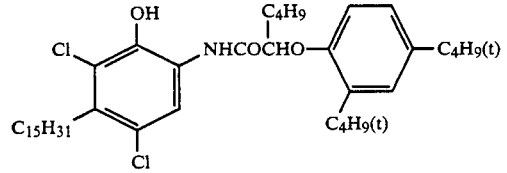
(C-49)
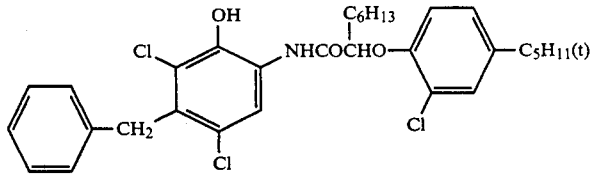
(C-50)
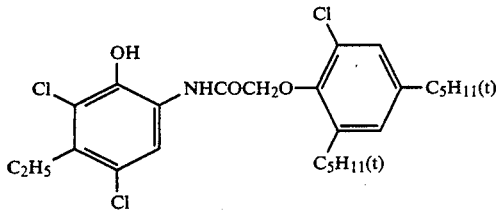
(C-51)
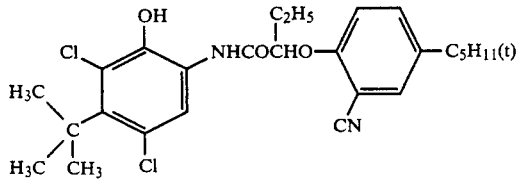

-continued
(C-52)
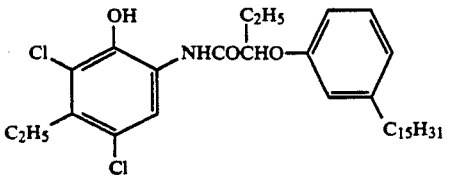
(C-53)
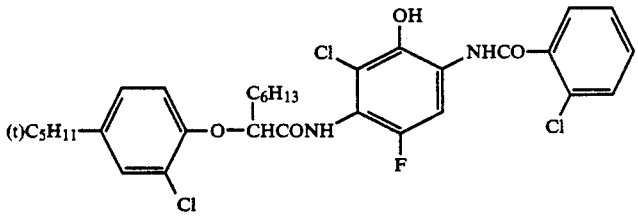
Specific examples of oil-soluble magenta and yellow couplers which can be used in the present invention are set forth below, but the present invention should not be construed as being limited thereto.
(M-1)
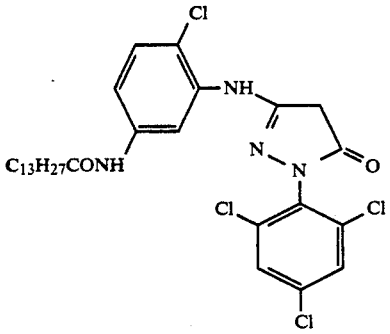
(M-2)
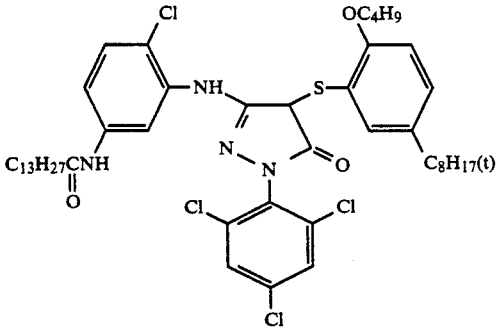
(M-3)
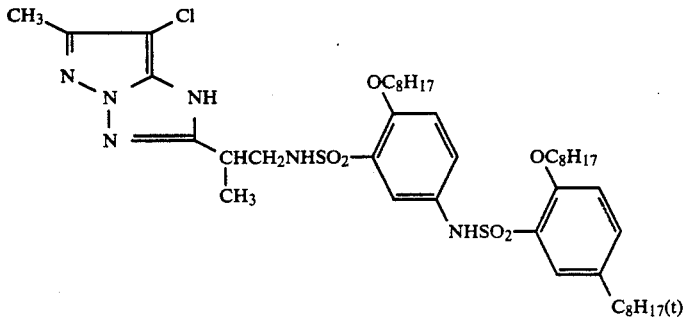

-continued
(M-4)
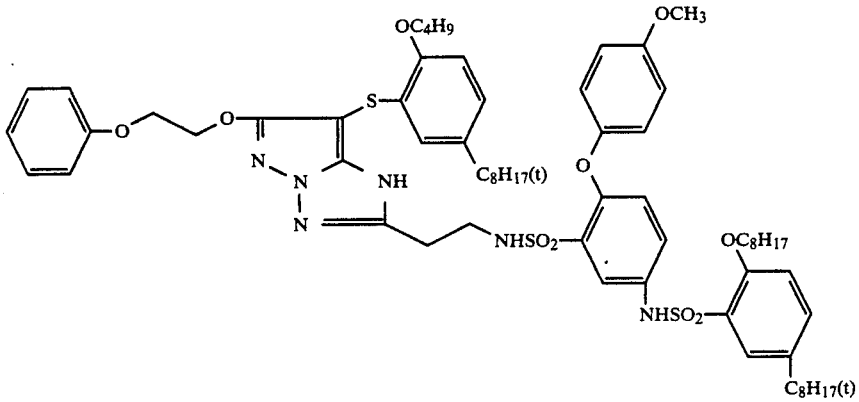
(M-5)
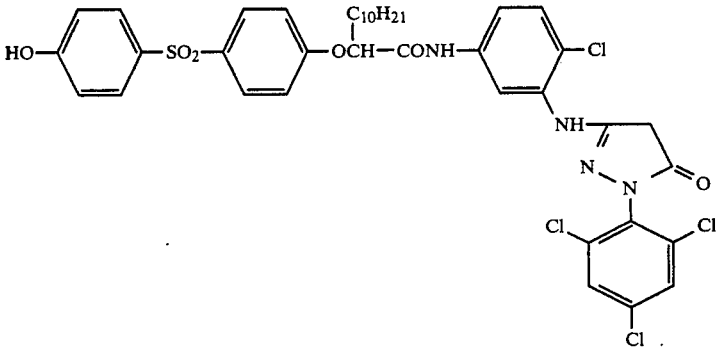
(M-6)
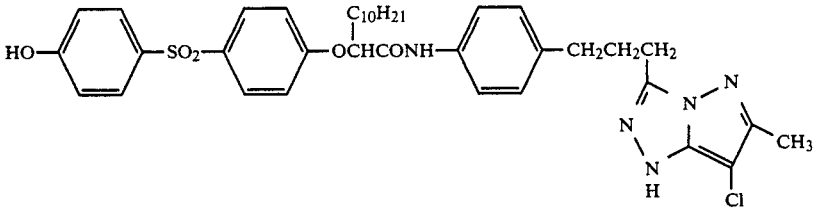
(M-7)
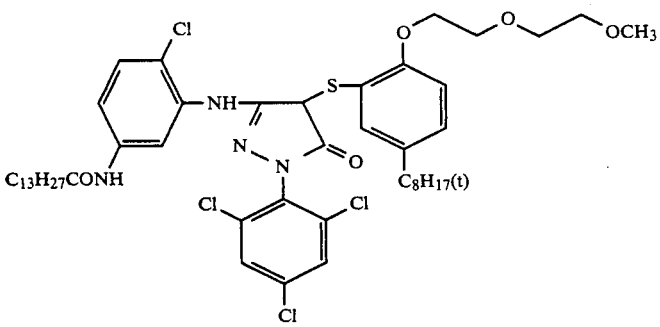
(M-8)
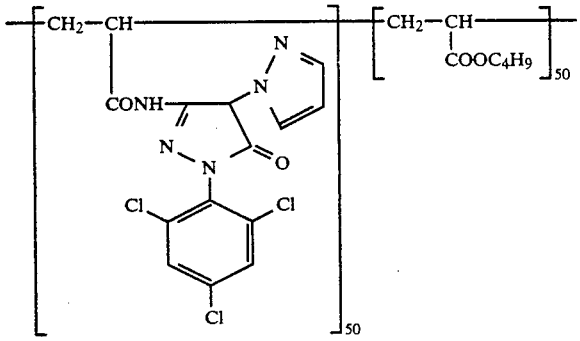

-continued
(M-9)
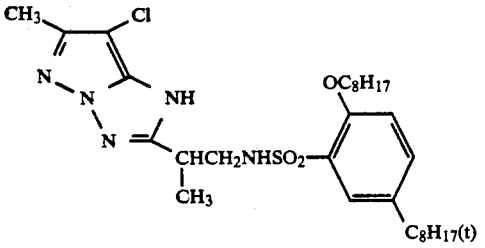
(M-10)
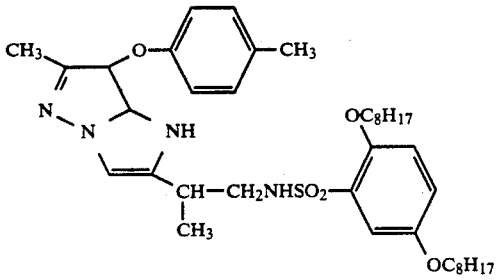
(M-11)
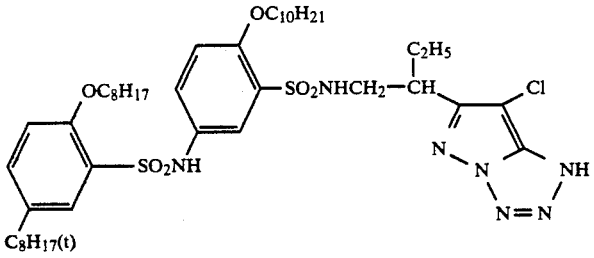
(M-12)
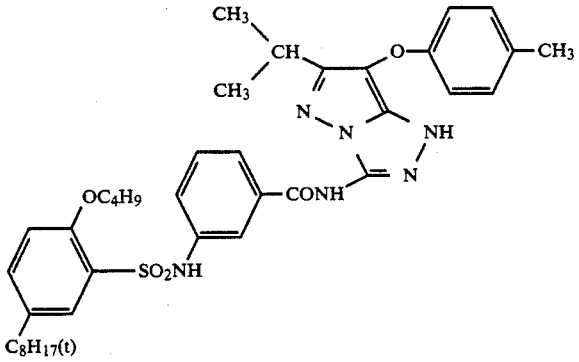
(M-13)
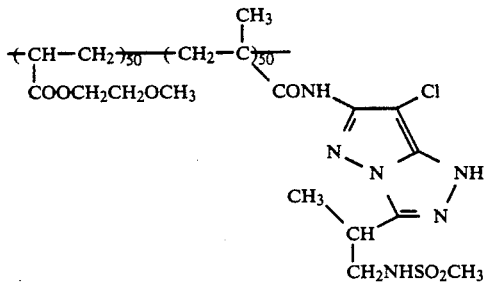

-continued
(M-14)
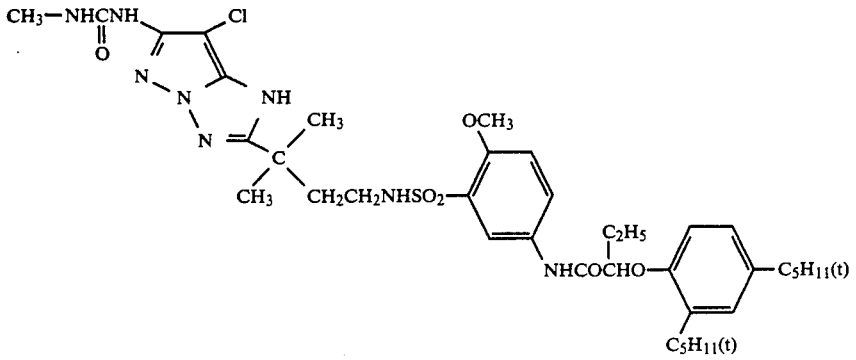
(M-15)
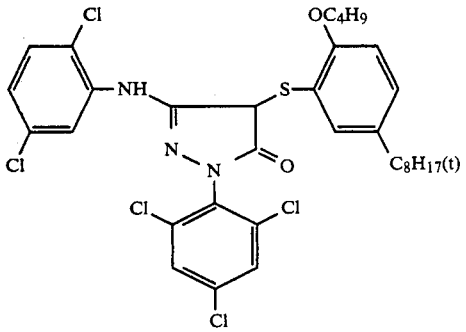
(M-16)
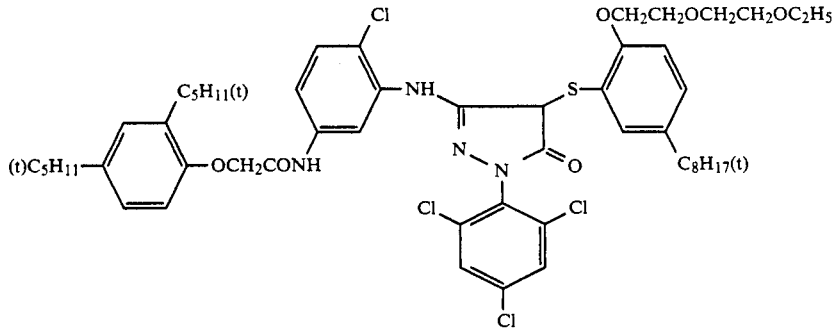
(M-17)
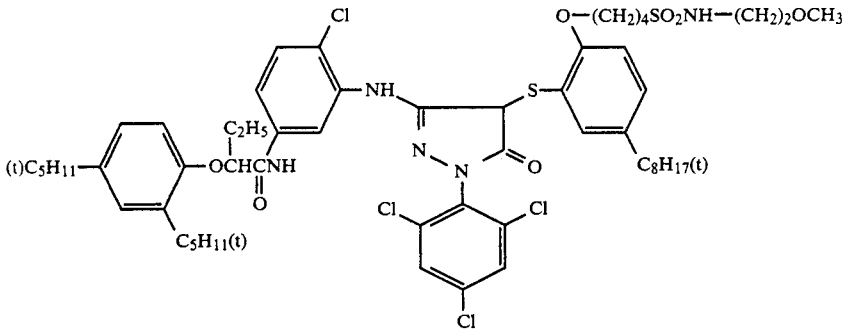
(M-18)
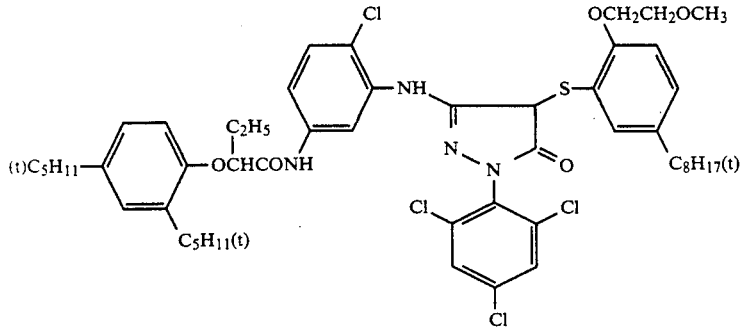

-continued
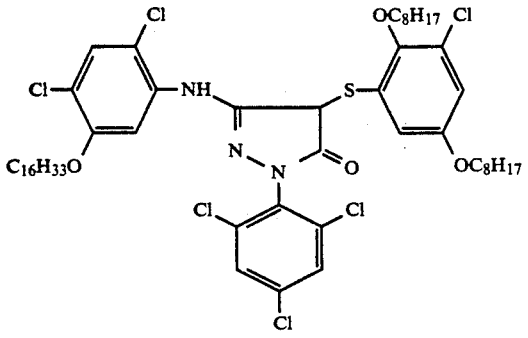
(M-19)
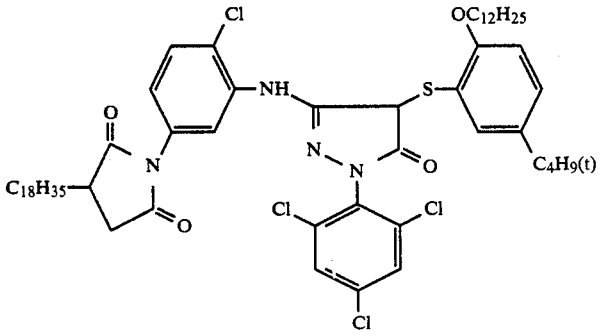
(M-20)
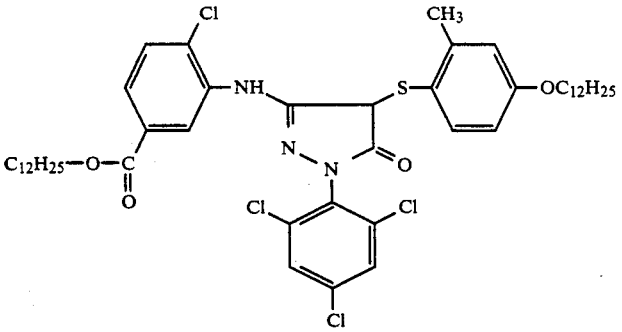
(M-21)
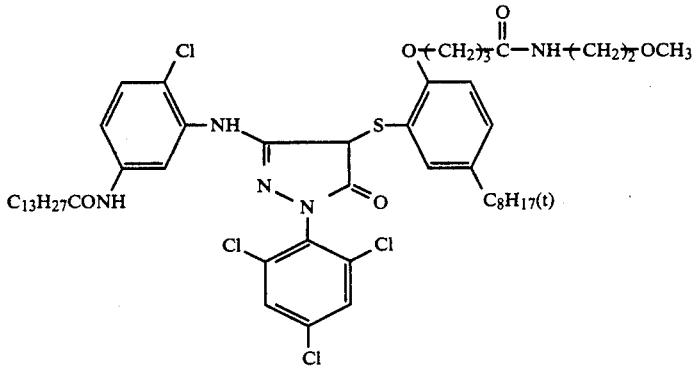
(M-22)

-continued
(M-23)
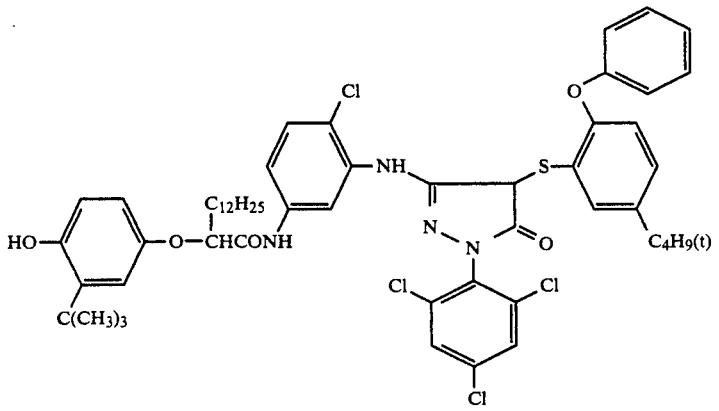
(M-24)
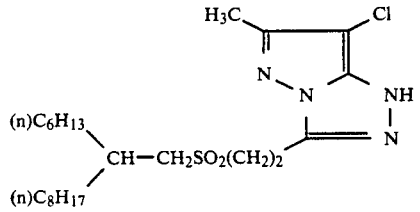
(M-25)
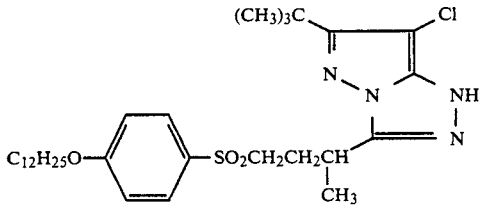
(M-26)
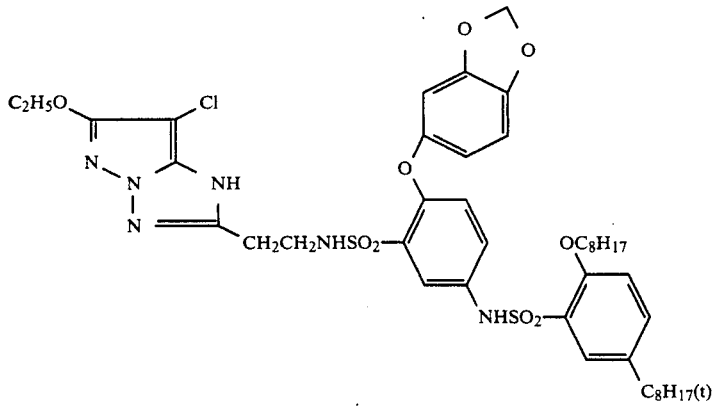
(M-27)
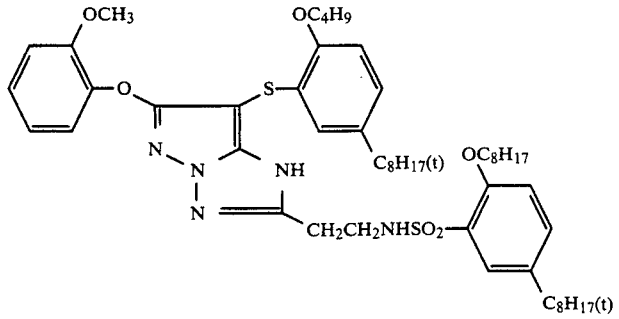

-continued
(M-28)
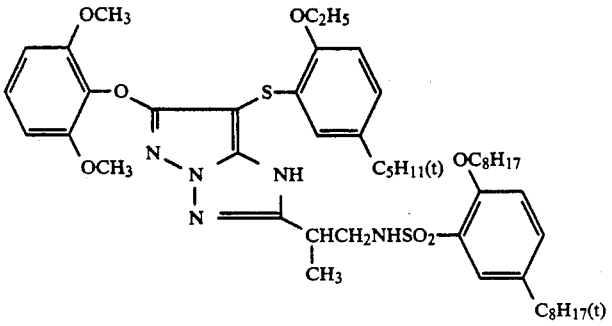
(M-29)
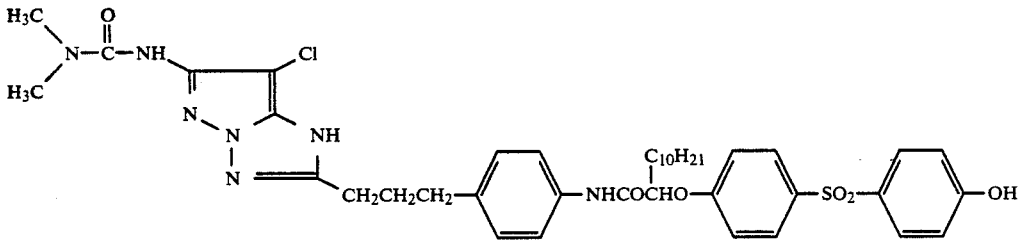
(M-30)
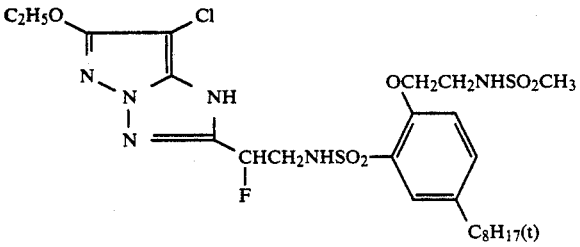
(M-31)
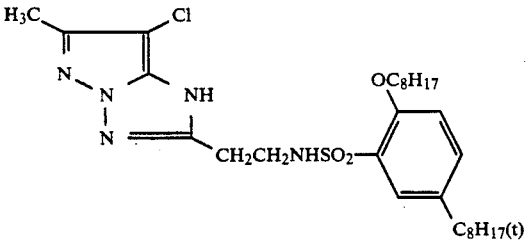
(M-32)
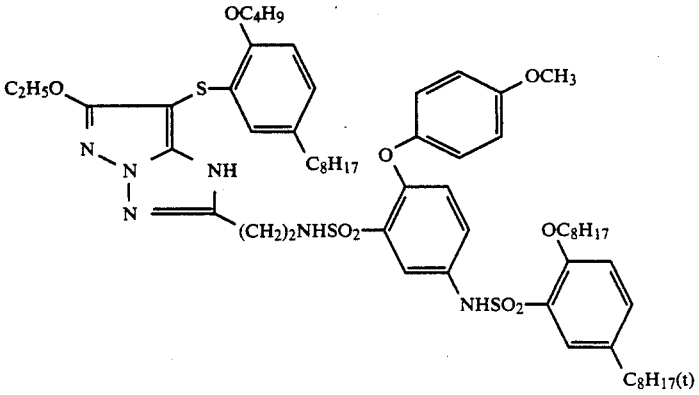

-continued
(M-33)
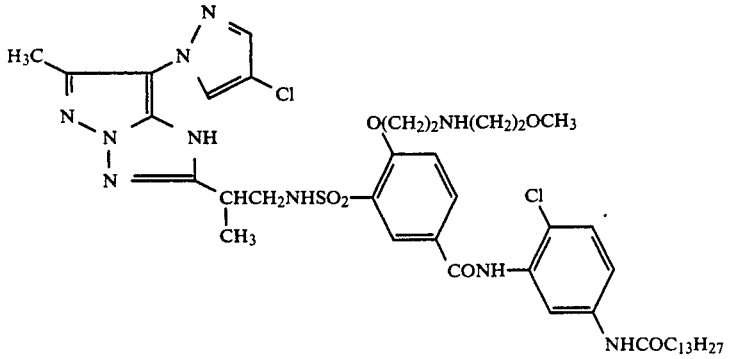
(M-34)
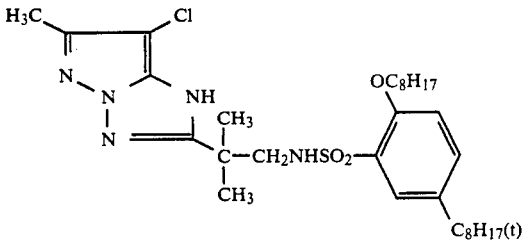
(M-35)
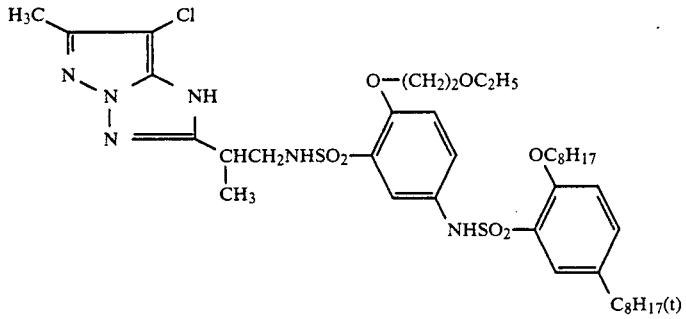
(M-36)
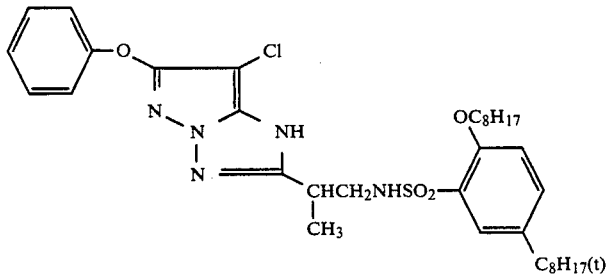
(M-37)
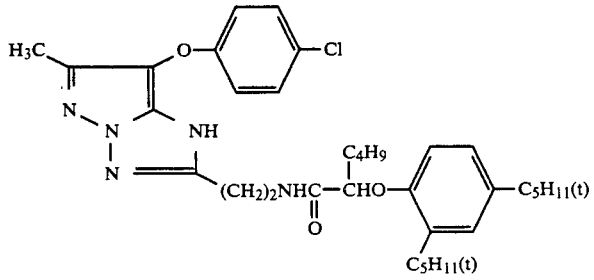

-continued
(M-38)
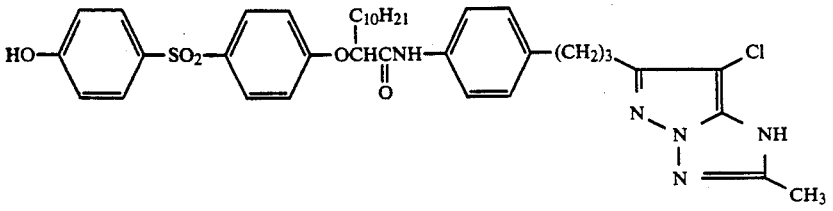
(M-39)
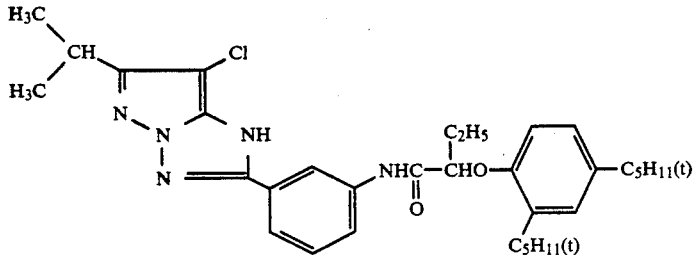
(M-40)
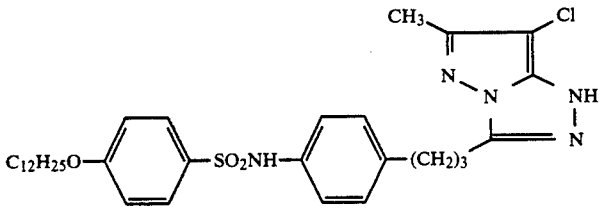
(M-41)
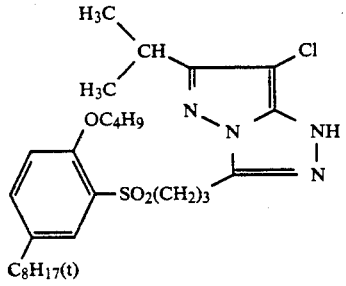
(M-42)
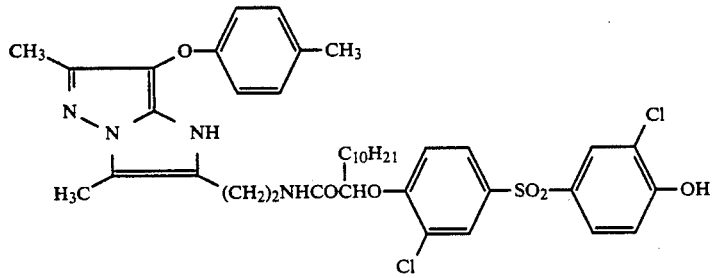
(M-43)
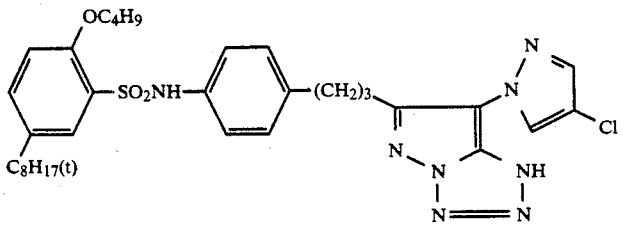

-continued
(M-44)
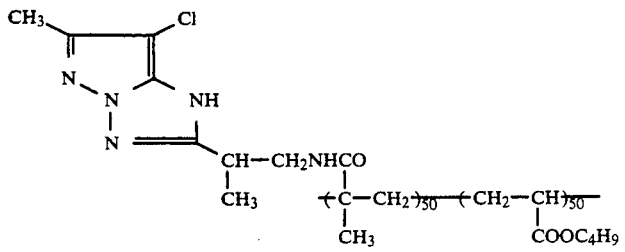
(Y-1)
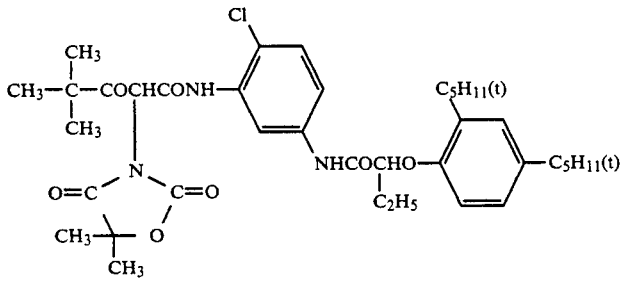
(Y-2)
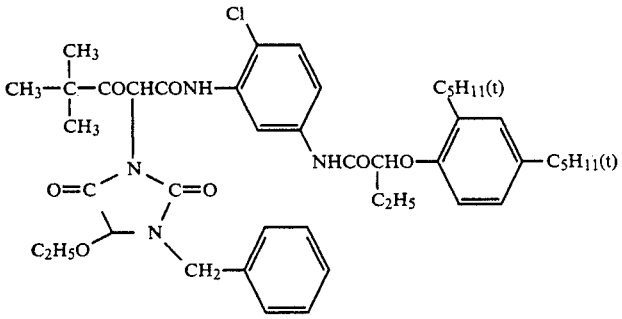
(Y-3)
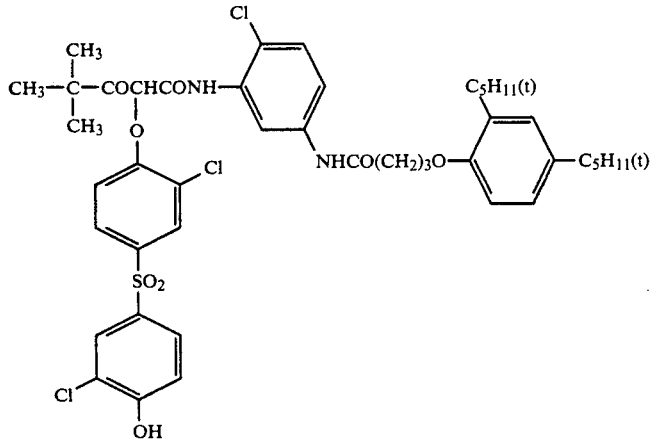

-continued
(Y-4)
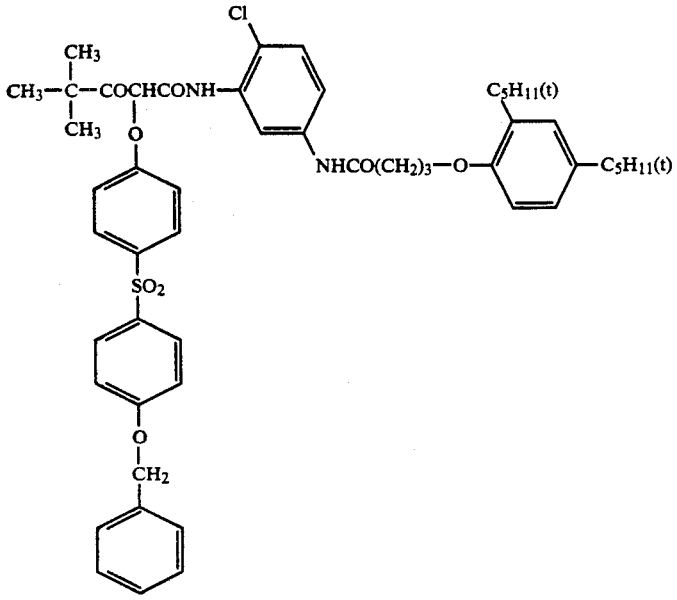
(Y-5)
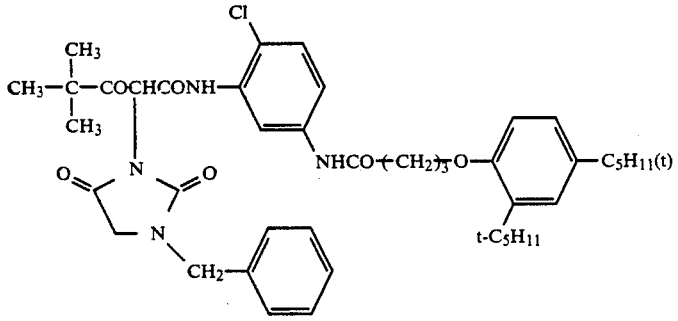
(Y-6)
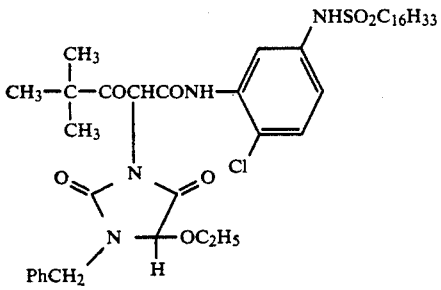
(Y-7)
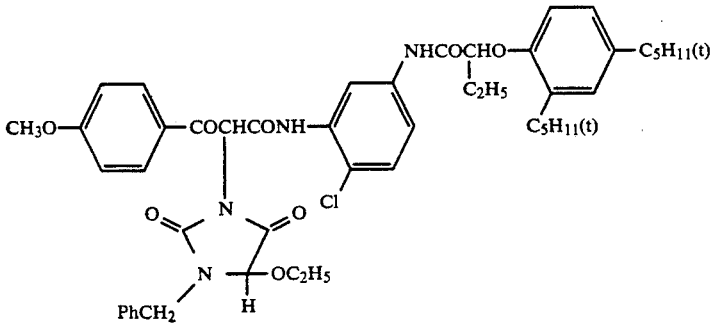

-continued
(Y-8)
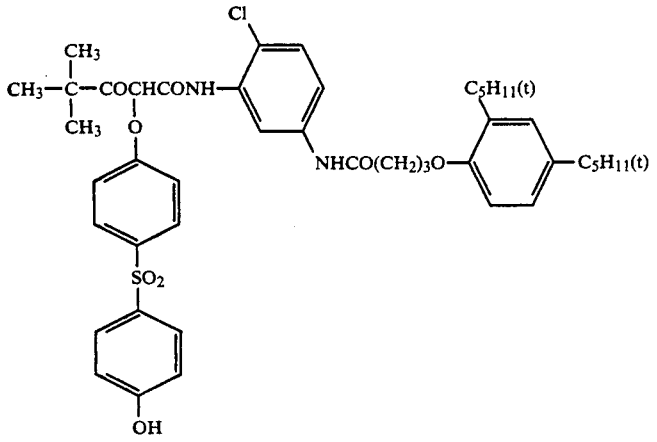
(Y-9)
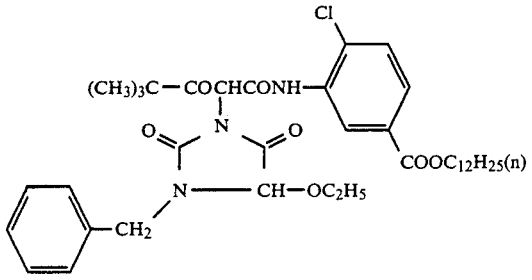
(Y-10)
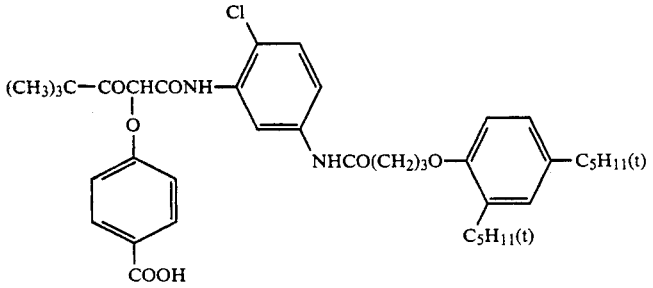
(Y-11)
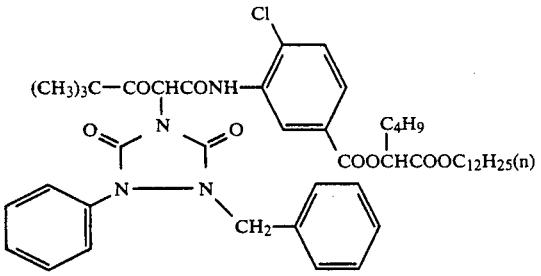
(Y-12)
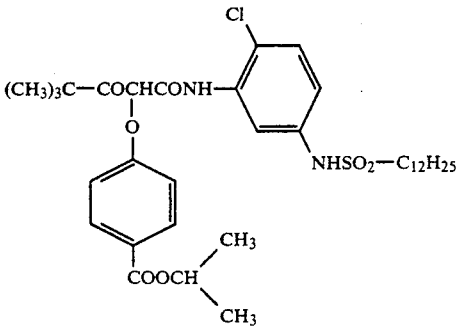

-continued
(Y-13)
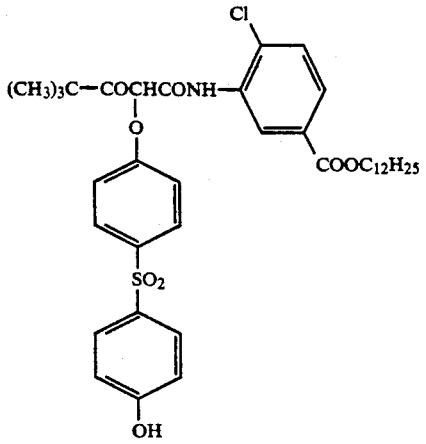
(Y-14)
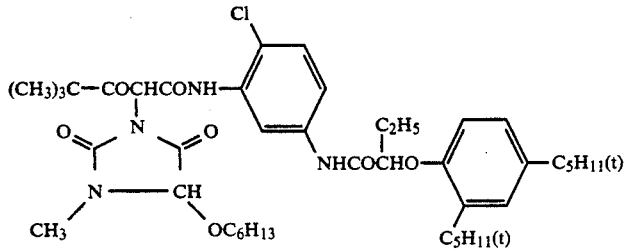
(Y-15)
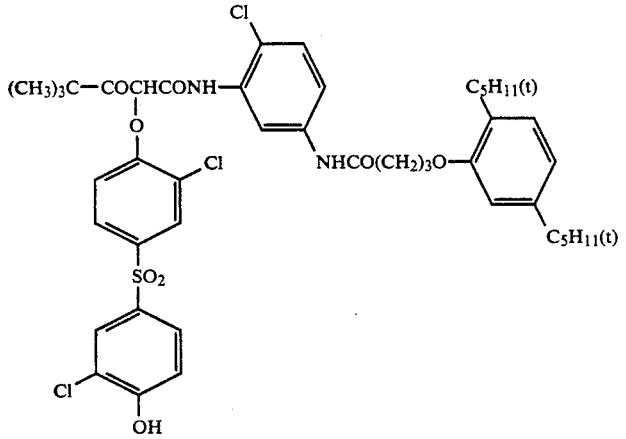
(Y-16)
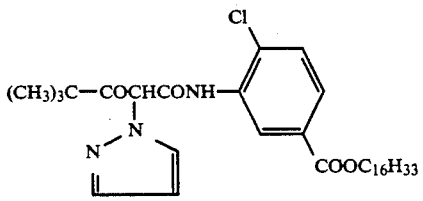
(Y-17)
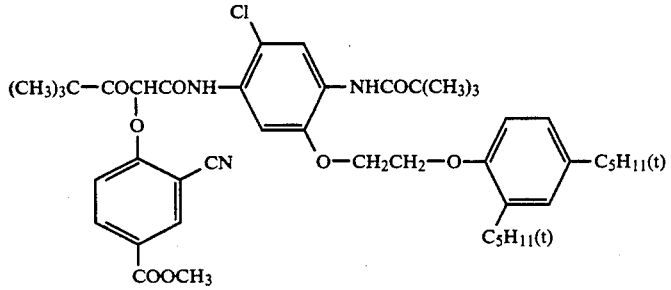

-continued (Y-18)

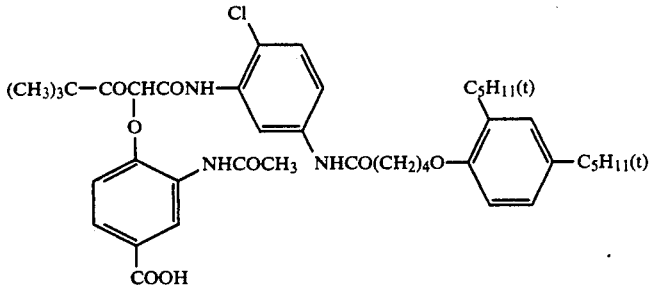

(Y-19)

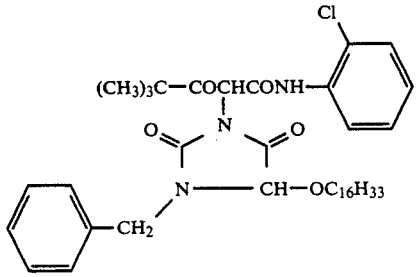

(Y-20)

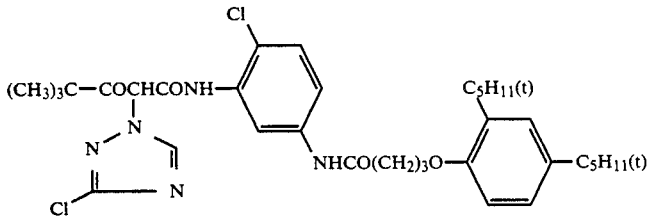

In the following, the water-immiscible coupler solvents having a high boiling point which can be employed in the present invention are described in detail.

Of the water-immiscible coupler solvents used in the present invention, any compound which has a melting point of not more than 100° C. and a boiling point of not less than 140° C., and is water-immiscible and a good solvent for the coupler can be employed as the coupler solvent having a high boiling point according to the present invention. The melting point of the coupler solvent having a high boiling point is preferably not more than 80° C. The boiling point of the coupler solvent having a high boiling point is preferably not less than 160° C. and more preferably not less than 170° C.

When the melting point of the coupler solvent exceeds about 100° C., crystallization of couplers is apt to occur and color forming ability tends to become poor.

Further, when the boiling point of the coupler solvent is lower than about 140° C., such a coupler solvent is hard to be maintained in the photographic emulsion layer as droplets together with the coupler and the polymer according to the present invention because it easily evaporates during coating and drying the photographic emulsion. As a result, it is difficult to achieve the effect of the present invention.

Moreover, when using a coupler solvent which is miscible with water, the couplers, etc., are apt to move to other photographic layers or diffuse into the processing solution during coating of the photographic emulsion layer or photographic processing of the photographic light-sensitive material obtained by coating and drying. These phenomena cause the formation of color mixing and fog and cause a decrease in maximum color density.

In the present invention, the amount of the coupler solvent having a high boiling point can be varied in a wide range, depending on the kinds and amounts of coupler and the polymer to be employed. However, the ratio of coupler solvent having a high boiling point/coupler by weight is preferably from 0.05 to 20, and more preferably from 0.1 to 10. Also, the ratio of coupler solvent having a high boiling point/polymer by weight is preferably from 0.02 to 40, and more preferably from 0.50 to 20. Further, a coupler solvent having a high boiling point can be employed individually or in a combination of two or more thereof.

Of the compounds represented by the general formulae (III) to (VIII), those represented by the general formulae(III), (IV) and (VIII) are preferred. (III) and (IV), a compound of formula (IX) is most preferred.

General Formula (IX)

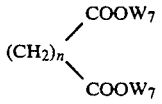

wherein n is an integer of from 3 to 15; and $W_7$ represents a substituted or unsubstituted alkyl group having 4 to 15 carbon atoms.

Specific examples of the substituted or unsubstituted alkyl, cycloalkyl, alkenyl, aryl or heterocyclic groups represented by $W_1$ to $W_6$ in formulae (III) to (VIII) are the same as the groups illustrated with respect to the general formula (Cp-I) and (Cp-II). Also, an alkyl group may be bonded to an epoxy group.

Specific examples of the coupler solvents having a high boiling point which can be used in the present invention are set forth below, but the present invention should not be construed as being limited thereto.

$O{=}P(OC_4H_9\text{-}n)_3$ (S-1)
$O{=}P(OCH_2CH_2CH(CH_3)CH_3)_3$ (S-2)
$O{=}P(OC_6H_{13}(n))_3$ (S-3)
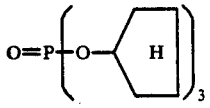
(S-4)
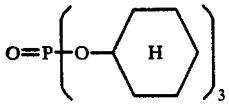
(S-5)
$O{=}P(OC_8H_{17}(n))_3$ (S-6)
$O{=}P(OCH_2CH(CH_3)CH_2CH_3)_3$ (S-7)
$O{=}P(OCH_2C(CH_3)_2CH_2CH(CH_3)CH_3)_3$ (S-8)
$O{=}P(O(CH_2)_6CH(CH_3)CH_3)_3$ (S-9)
$O{=}P(OC_9H_{19}(n))_3$ (S-10)
$O{=}P(OCH(CH_3)(CH_2)_6CH_3)_3$ (S-11)
$O{=}P(OC_{10}H_{21}(n))_3$ (S-12)
$O{=}P(OCH_2CH_2CH(CH_3)CH_2CH_2C(CH_3)_2CH_3)_3$ (S-13)
$O{=}P(O(CH_2)_6CH(CH_3)_2)[O(CH_2)_7CH(CH_3)_2]_2$ (S-41)
$O{=}P(OC_4H_9(n))(OC_{12}H_{25}(n))_2$ (S-15)
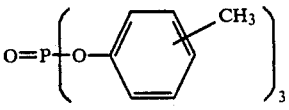
(S-16)
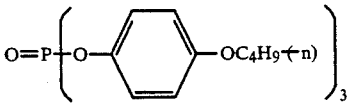
(S-17)
-continued
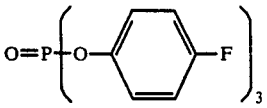
(S-18)
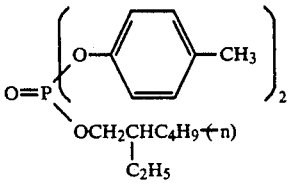
(S-19)
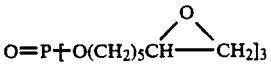
(S-20)
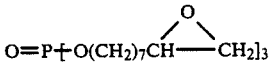
(S-21)
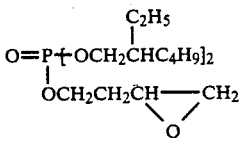
(S-22)
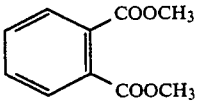
(S-23)
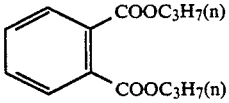
(S-24)
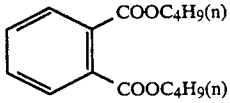
(S-25)
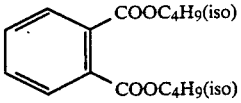
(S-26)
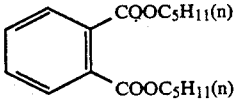
(S-27)
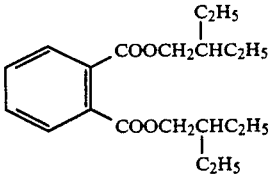
(S-28)
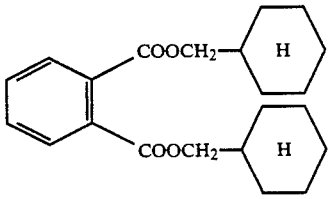
(S-29)

-continued
(S-30)
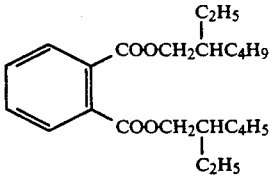
(S-31)
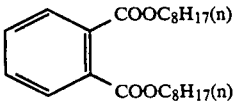
(S-32)
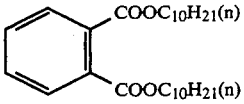
(S-33)
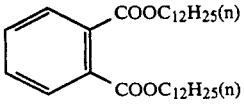
(S-34)
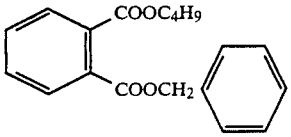
(S-35)
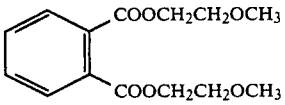
(S-36)
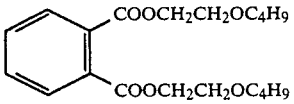
(S-37)
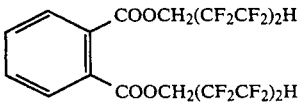
(S-38)
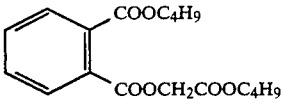
(S-39)
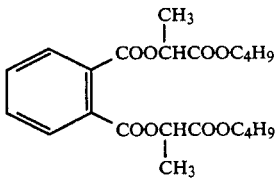
(S-40)
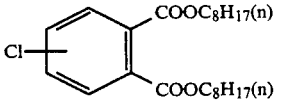
(S-41)
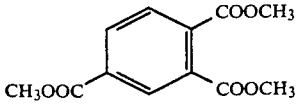
-continued
(S-42)
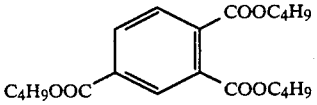
(S-43)
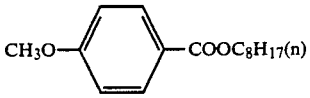
(S-44)
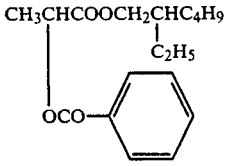
(S-45)
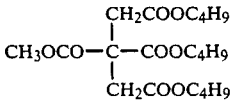
(S-46)
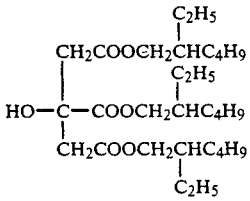
(S-47)
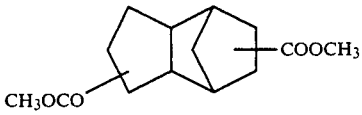
(S-48)
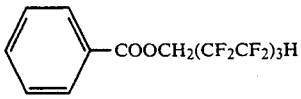
(S-49)
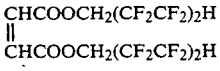
(S-50)
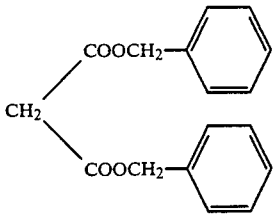
(S-51)
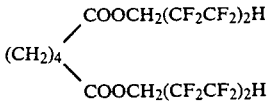
(S-52)
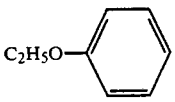
(S-53)
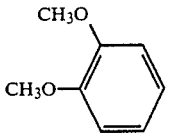

-continued

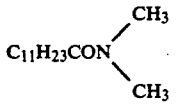

(S-54)

$C_{12}H_{25}OH$ (S-55)

$C_{16}H_{33}OH$ (S-56)

$C_{18}H_{37}OH$ (S-57)

$C_{10}H_{21}O(CH_2)_5O(CH_2)_2OH$ (S-58)

(S-59)

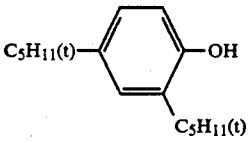

(S-60)

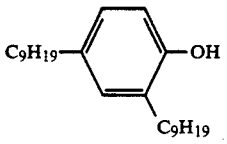

$CH_3(CH_2)_{17}Cl$ (S-61)

$CH_3(CH_2)_{15}Br$ (S-62)

(S-63)

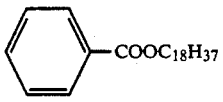

(S-64)

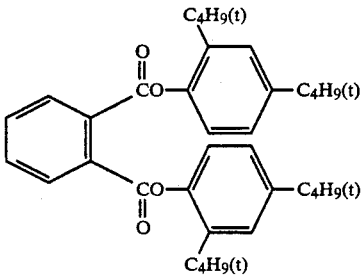

(S-65)

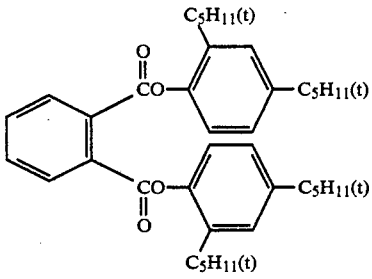

(S-66)

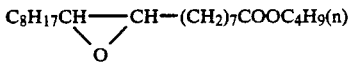

(S-67)

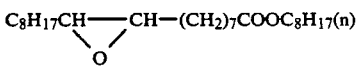

(S-68)

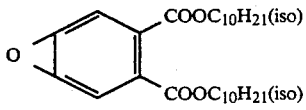

(S-69)

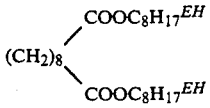

(S-70)

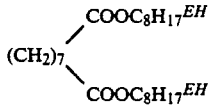

The dispersion of oleophilic fine particles containing the coupler, the coupler solvent having a high boiling point and the polymer used in the present invention can be prepared in the following manner.

The polymer according to the present invention may be synthesized by a solution polymerization method, an emulsion polymerization method, a suspension polymerization method, etc., and is not cross-linked (i.e., a linear polymer). The coupler solvent has a high boiling point and the coupler is completely dissolved in an auxiliary organic solvent. The solution is dispersed in water, preferably in an aqueous solution of a hydrophilic colloid, and more preferably in an aqueous solution of gelatin with the assistance of a dispersant using ultrasonic agitation, a colloid mill, etc., to form fine particles. Then, the dispersion is mixed with a silver halide emulsion. Alternatively, water or an aqueous solution of a hydrophilic colloid such as an aqueous solution of gelatin, etc., is added to an auxiliary organic solvent containing a dispersant such as a surface active agent, etc., the polymer according to the present invention, the coupler solvent having a high boiling point and the coupler to prepare an oil in water type dispersion accompanied by phase inversion.

Further, the dispersion may be mixed with a photographic emulsion after removing the auxiliary organic solvent therefrom by distillation, noodle washing, ultrafiltration, etc. The term "auxiliary organic solvent" as used herein means an organic solvent which is useful in forming an emulsified dispersion which is finally removed substantially from the photographic light-sensitive material during the drying step after coating or by the above-described method, and which is an organic solvent having a low boiling point or a solvent having a certain extent of solubility in water and removable by washing with water, etc. Specific examples of auxiliary organic solvents include a lower alkyl acetate such as ethyl acetate, butyl acetate, etc., ethyl propionate, sec-butyl alcohol, methyl ethyl ketone, methyl isobutyl ketone, $\beta$-ethoxyethyl acetate, methyl cellosolve acetate, methylcarbitol acetate, methylcarbitol propionate, cyclohexanone, etc.

Further, an organic solvent which is completely miscible with water, for example, methyl alcohol, ethyl alcohol, acetone, tetrahydrofuran, etc., may be partially employed together with the auxiliary organic solvent, if desired.

Moreover, these organic solvents can be used in a mixture of two or more thereof.

The average particle diameter of the oleophilic fine particles thus-obtained is preferably from 0.04 $\mu$m to 2 $\mu$m and more preferably from 0.06 $\mu$m to 0.4 $\mu$m. The particle diameter of the oleophilic fine particles can be measured by a suitable apparatus such as Nanosizer manufactured by the Coal-Tar Limited in England, etc.

Into the oleophilic fine particles used in the present invention, various kinds of photographic hydrophobic substances can be incorporated. Suitable examples of such photographic hydrophobic substances include colored couplers, non-color forming couplers, developing agents, developing agent precursors, development inhibitor precursor, ultraviolet ray absorbing agents, development accelerators, gradation controlling agents such as hydroquinones, etc., dyes, dye releasers, antioxidants, fluorescent brightening agents, color fading preventing agents, etc. Two or more of these hydrophobic substances can be used together.

Further, the compounds represented by the general formulae (A), (B) and (C) described below are particularly useful as photographic hydrophobic substances for incorporation into the oleophilic fine particles comprising the coupler, the coupler solvent having a high boiling point and the polymer according to the present invention, since it can further increase color forming ability and prevent fading according to the present invention.

Formula (A)

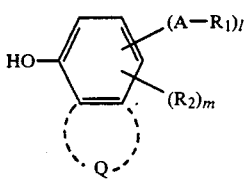

wherein A represents a divalent electron withdrawing group; $R_1$ represents a substituted or unsubstituted alkyl group, a substituted or unsubstituted aryl group, a substituted or unsubstituted alkoxy group, a substituted or unsubstituted aryloxy group, a substituted or unsubstituted alkylamino group, a substituted or unsubstituted anilino group or a substituted or unsubstituted heterocyclic group; represents an integer of 1 or 2; $R_2$ represents a substituted or unsubstituted alkyl group, a substituted or unsubstituted alkoxy group, a hydroxy group, or a halogen atom; m represents an integer from 0 to 4; and Q, if present, represents a benzene ring or a hetero ring condensed with the phenol ring.

Formula (B)

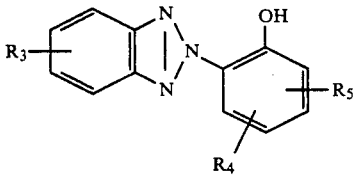

wherein $R_3$, $R_4$ and $R_5$ each represents a hydrogen atom, a halogen atom, a nitro group, a hydroxy group, a substituted or unsubstituted alkyl group, a substituted or unsubstituted alkoxy group, a substituted or unsubstituted aryl group, a substituted or unsubstituted aryloxy group or a substituted or unsubstituted acylamino group.

Formula (C)

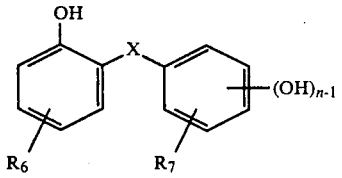

wherein $R_6$ and $R_7$ each represents a hydrogen atom, a substituted or unsubstituted alkyl group, a substituted or unsubstituted alkoxy group or a substituted or unsubstituted acyl group; X represents —CO— or —COO—; and n represents an integer from 1 to 4.

Specific examples of the compounds represented by the general formulae (A), (B) and (C) are set forth below, but the present invention should not be construed as being limited thereto.

(X-1)

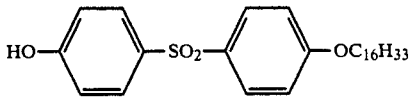

(X-2)

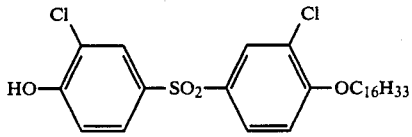

(X-3)

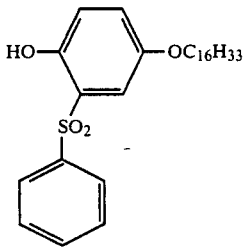

(X-4)

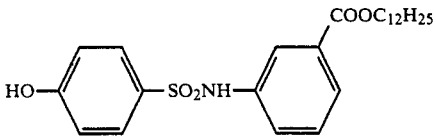

(X-5)

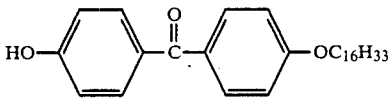

(X-6)

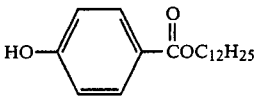

(X-7)

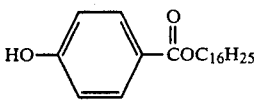

(X-8)

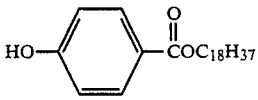

(X-9)

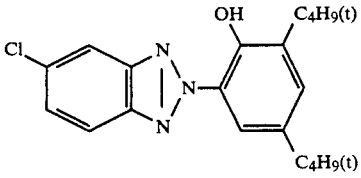

(X-10)

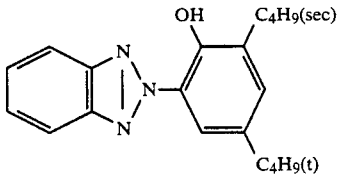

-continued (X-11)

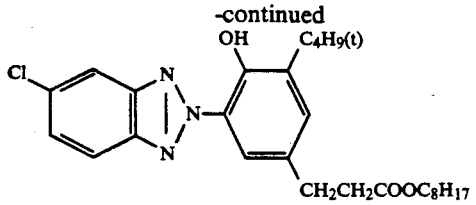

(X-12)

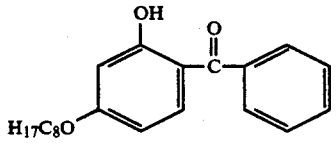

(X-13)

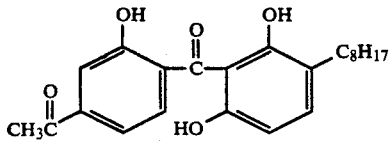

(X-14)

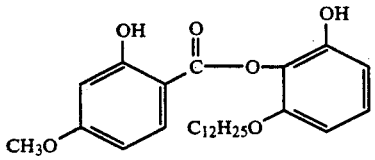

Any silver halide, such as silver chloride, silver iodobromide, silver bromide, silver chlorobromide, silver chloroiodobromide, etc., conventionally used in a silver halide emulsion can be employed in the silver halide emulsion according to the present invention. Silver halide grains may be coarse grains or fine grains. Grain size distribution may be narrow or broad, but it is preferred to use a monodispersed emulsion having a percentage of grains greater than or less than the average grain size by 40% or more of not more than 15% and more preferably not more than 10%.

Silver halide grains may have a regular crystal structure or an irregular crystal structure, such as a spherical structure, a tabular structure, a twin structure, etc. Further, any crystal structure having a various ratio of a [100]plane to a [111]plane may be employed. The crystal structure of silver halide grains may be uniform, composed of different halide compositions between the inner portion and the outer portion, or may have a layer structure. Moreover, the silver halide grains may be those of the surface latent image type in which latent images are formed mainly in the surface portion thereof or those of the internal latent image type in which latent images are formed mainly in the interior thereof. The silver halide emulsions can be those prepared by an acid process, a neutral process and an ammonia process. Further, silver halide grains prepared by a double jet process, a single jet process, a reverse mixing process, a conversion method, etc., can be employed. It is also possible to use a mixture of two or more kinds of silver halide emulsions which are prepared separately.

Silver halide photographic emulsions comprising silver halide grains dispersed in a binder can be subjected to chemical sensitization using a chemical sensitizer. Chemical sensitizers which can be preferably employed individually or in a combination in the present invention includes noble metal sensitizers, sulfur sensitizers, selenium sensitizers, and reducing sensitizers.

Noble metal sensitizers include gold compounds and ruthenium, rhodium, palladium, iridium, platinum compounds, etc.

Ammonium thiocyanate or sodium thiocyanate can be employed together with the gold compound.

Sulfur sensitizers include active gelatin, a sulfur compound, etc.

Selenium sensitizers include an active or inactive selenium compound, etc.

Reducing sensitizers include a stannous salt, a polyamine, a bisalkylaminosulfide, a silane compound, an iminoaminomethanesulfinic acid, a hydrazinium salt, a hydrazine derivative, etc.

In the color photographic light-sensitive material according to the present invention, it is preferred to appropriately provide a subsidiary layer such as a protective layer, intermediate layer, a filter layer, an antihalation layer, a back layer, etc., in addition to the silver halide emulsion layer.

As the binder or the protective colloid for the photographic emulsion layers or intermediate layers of the color photographic light-sensitive material according to the present invention, gelatin is advantageously used, but other hydrophilic colloids can be used.

For example, it is possible to use proteins such as gelatin derivatives, graft polymers of gelatin and other polymers, albumin, casein, etc.; saccharide derivatives including cellulose derivatives such as hydroxyethyl cellulose, carboxymethyl cellulose, cellulose sulfate, etc., sodium alginate, starch derivatives, etc.; and various synthetic hydrophilic high molecular substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinylimidazole, polyvinylpyrazole, etc.

As gelatin, not only lime-processed gelatin, but also acid-processed gelatin and enzyme-processed gelatin as described in *Bull. Soc. Sci. Phot. Japan,* No. 16, page 30 (1966) may be used. Further, hydrolyzed products of gelatin or enzymatically decomposed products of gelatin can also be used.

Into the silver halide emulsion layer and the subsidiary layer of the color photographic light-sensitive material of the present invention can be incorporated various kinds of photographic additives. For example, antifogging agents, dye image fading preventing agents, color contamination preventing agents, fluorescent whitening agents, antistatic agents, hardening agents, surface active agents, plasticizers, wetting agents and ultraviolet ray absorbing agents, etc., as described in *Research Disclosure,* No. 17643 can be employed when needed.

The silver halide color photographic material of the present invention can be produced by coating one or more silver halide emulsion layers and one or more subsidiary layers, each containing various photographic additives as described above, if desired, on a support which has been subjected to a corona discharge treatment, a flame treatment or an ultraviolet irradiation treatment, etc., or on a support having a subbing layer or an intermediate layer. Examples of supports which can be advantageously employed include baryta coated paper, polyethylene coated paper, polypropylene type synthetic paper, a transparent support, for example, a glass plate, a polyester film such as a cellulose triacetate film, a cellulose nitrate film, a polyethylene terephthalate film etc., a polyamide film, a polycarbonate film, a polystyrene film, etc., having a reflective layer or having incorporated therein a reflective substance. A suitable support can be selected depending on the purpose for which the photographic light-sensitive material is to be used.

In the present invention, photographic emulsion layers and other constituent layers can be coated on a support or other layers on a support using various conventional coating methods. Examples of such coating methods include the dip coating method, the air doctor coating method, the curtain coating method, the hopper coating method, etc. Further, the coating methods described in U.S. Pat. Nos. 2,761,791 and 2,941,898, etc., in which two or more layers may be coated at the same time if desired, may be used.

In the present invention, the position of each emulsion layer can be in any order which is appropriate. For example, the layers may be in the order of blue-sensitive emulsion layer, green-sensitive emulsion layer and red-sensitive emulsion layer from the support side, or in the order of red-sensitive emulsion layer, green-sensitive emulsion layer and blue-sensitive emulsion layer from the support side can be employed.

Further, an ultraviolet ray absorbing layer may be a layer adjacent to an emulsion layer farthest from the support, or, if desired, as a layer on the opposite side of the support. In the latter case, it is particularly preferred to provide a layer substantially comprising only gelatin as the uppermost layer.

The present invention is preferably applied to color photographic light-sensitive materials for prints. When used for that purpose, the color photographic light-sensitive material is exposed through a color negative photographic material having color images composed of coupling products and then subjected to color development processing.

The color developing solution used in the development of the light-sensitive material of the present invention is preferably an alkaline aqueous solution containing an aromatic primary amine color developing agent as a main component: As such a color developing agent there is effectively used an aminophenol compound. p-Phenylenediamine compound is more preferably used as such a color developing agent. Typical examples of such a p-phenylenediamine compound include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-β-methoxyethylaniline, and sulfates, hydrochlorides, and p-toluenesulfonates thereof. These compounds may be used in combination depending on the purpose of application.

In general, the color developing solution contains a pH buffer such as carbonate, borate, and phosphate of alkali metal, development inhibitor or fog inhibitor such as bromide, iodide, benzimidazoles, benzothiazoles, and mercapto compound, or the like. Other typical examples of compounds which can be optionally contained in the color developing solution include various preservatives such as hydroxylamine, diethylhydroxylamine, sulfite hydrazines, phenylsemicarbazides, triethanolamine, catecholsulfonic acids, and triethylenediamine (1,4-diazabicyclo[2,2,2]octanes, organic solvents such as ethyleneglycol, and diethyleneglycol, development accelerators such as benzylalcohol, polyethyleneglycol, quaternary ammonium salts, and amines, dye forming couplers, competing couplers, fogging agents such as sodium boron hydride, auxiliary developing agents such as 1-phenyl-3-pyrazolidone, thickening agents, and various chelating agents such as aminopolycarboxylic acids, aminopolyphosphonic acids, alkylphosphonic acids, and phosphonocarboxylic acids. Typical examples of such chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof.

If the reversal process is effected, the color development is normally effected after a black-and-white development. The solution to be used in the black-and-white development process may comprise known black-and-white developing agents such as dihydroxybenzenes, e.g., hydroquinone, 3-pyrazolidones, e.g., 1-phenyl-3-pyrazolidone, and aminophenols, e.g., N-methyl-p-aminophenol, singly or in combination.

In general, these color developing solutions and black-and-white developing solutions have a pH value of 9 to 12. The amount of these developing solutions to be filled up normally depends on the type of color photographic light-sensitive materials to be processed. It is normally in the range of 3 or less per 1 $m_2$ of light-sensitive material. If the bromide ion concentration of the solution to be filled up is lowered, the amount of the solution to be filled up can be reduced to 500 ml or less. In the case where the amount of the solution to be filled up is reduced, the evaporation and air oxidation of the solution is preferably prevented by reducing the contact area of the processing bath with air. Alternatively, the amount of the solution to be filled up can be reduced by a means for inhibiting the accumulation of bromide ions in the developing solution.

The photographic emulsion layer which has been color developed is normally subjected to bleach. The bleach may be effected simultaneously with or separately from fixing. (If the bleach is effected simultaneously with fixing, it is called blix.) In order to expedite the processing, the bleach may be followed by the blix. Alternatively, any other processing steps may be optionally used. For example, a blix bath made of two continuous tanks may be used. Furthermore, the blix may be preceded by the fixing. Moreover, the blix may be followed by the bleach. As bleaching agent there can be used compounds of polyvalent metals such as iron (III), cobalt (III), chromium (VI), and copper (II), peracids, quinones, and nitro compounds. Typical examples of bleaching agents which can be used in the present invention include ferricyanides, dichromates, organic complex salts of iron (III) or cobalt (III) With ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiaminetetraacetic acid, or other aminopolycarboxylic acids, or citric acid, tartaric acid, or malic acid, persulfates, bromates, permanganates, and nitrobenzenes. Preferred among these bleaching agents are ethylenediaminetetraacetic acid-iron (III) complex salts and other aminopolycarboxylic acid-iron (III) complex salts, and persulfates in view of rapidness of processing and prevention of environmental pollution. Furthermore, aminopolycarboxylic acid-iron (III) complex salts are also useful for bleaching bath and blix bath in particular. The bleaching solution or blix solution comprising such aminopolycarboxylic acid-iron (III) complex salts normally has a pH of 5.5 to 8. In order to expedite the processing, the bleaching solution or blix solution may be lower in pH value.

The bleaching solution, blix solution and their prebaths may optionally comprise any suitable bleach accelerators. Specific examples of useful bleach accelerators include compounds containing mercapto groups or disulfide groups as described in U.S. Pat. No. 3,893,858, West German Patent Nos. 1,290,812, and 2,059,988, Japanese Patent Application (OPI) Nos. 32,736/78, 57,831/78, 37,418/78, 72,623/78, 95,631/78, 104,232/78, 124,424/78, 141,623/78, and 28,426/78, and Research Disclosure No. 17,129 (July 1978), thiazolidine derivatives as described in Japanese Patent Application (OPI) No. 140,129/75, thiourea derivatives as described in Japanese Patent Publication No. 8,506/70, Japanese Patent Application (OPI) Nos. 20,832/77, and 32,735/78, and U.S. Pat. No. 3,706,561, iodides as described in West German Patent No. 1,127,715, and Japanese Patent Application (OPI) No. 16,235/83, polyoxyethylene compounds as described in West German Patent Nos. 966,410, and 2,748,430, polyamine compounds as described in Japanese Patent Publication No. 8836/70, compounds as described in Japanese Patent Application (OPI) Nos. 42,434/74, 59,644/74, 94,927/78, 35,727/79, 26,506/80, and 163,940/83, and bromides. Preferred among these compounds are compounds containing mercapto groups or disulfide groups in view of bleach accelerating effect. Particularly preferred among these compounds are compounds as described in U.S. Pat. No. 3,893,858, West German Patent No. 1,290,812, and Japanese Patent Application (OPI) No. 95,630/78. Furthermore, compounds as described in U.S. Pat. No. 4,552,834 can be preferably used. These bleach accelerators may be incorporated in the light-sensitive material. These bleach accelerators are useful particularly when color light-sensitive materials for photographing are subjected to blix.

As fixing agents there may be used thiosulfates, thiocyanates, thioether compounds, thioureas, and iodides in a large amount. In general, thiosulfates are commonly used. In particular, ammonium thiosulfate can be most widely used. As preservatives for blix solution there may be preferably used sulfites, bisulfites, or carbonylbisulfurous acid addition products.

In general, the silver halide color photographic material of the present invention is subjected to washing and/or stabilizing after desilvering. The amount of water to be used in washing can be widely determined depending on the properties of the light-sensitive material (given by elements used such as coupler), purpose, temperature of water to be used washing, number of washing tanks (number of stages), solution supplement system in which countercurrent, forwardcurrent, or the like is used, or other various conditions. In particular, the relationship between the number of washing tanks and the amount of water to be used in the multistage countercurrent system can be determined by a method as described in Journal of the Society of Motion Picture and Television Engineers (Vol. 64, pp. 248–253, May 1955).

The multistage countercurrent system described in the above cited reference enables saving of a large amount of wash water. However, this system is disadvantageous in that a longer retention of water in the tanks causes propagation of bacteria which will produce floating matters that can attach to the light-sensitive material. In the processing of the present color photographic light-sensitive material, a method as described in Japanese Patent Application No. 131,632/76 which comprises reducing calcium or magnesium ions can be extremely effectively used to eliminate such a disadvantage. Alternatively, isothiazolone compounds and cyabendazoles as described in Japanese Patent Application (OPI) No. 8,542/82, chlorine germicides such as chlorinated sodium isocyanurate, benzotriazole, or other germicides as described in "Anti-bacterial and Anti-funglal Chemistry" (edited by Hiroshi Horiguchi), "Technich for sterilization of microorganism" (edited by EISEI GIJUTSUKAI), and "Dictionary of Antibacterial and Anti-fungal Agents" (edited by NIPPON BOKIN BOBAI GAKKAI) may be used.

Wash water to be used in the processing of the light-sensitive material of the present invention has a pH value of 4 to 9, preferably 5 to 8. The temperature of wash water and washing time can be similarly widely determined depending on the properties of the light-sensitive material and the purpose. In general, these values are in the range of 15° to 45° C. for 20 seconds to 10 minutes, preferably 25° to 40° C. for 30 seconds to 5 minutes. Furthermore, the light-sensitive material of the present invention may be directly processed with a stabilizing solution instead of wash water. In such a stabilizing process, any known methods as described in Japanese Patent Application (OPI) Nos. 8,543/82, 14,834/83, and 220,345/85 can be used.

Alternatively, the above described washing may be optionally followed by a stabilizing process. For example, a stabilizing bath containing formalin and a surface active agent used as a final bath in the processing of color photographic light-sensitive material for photographing can be used. This stabilizing bath may comprise various chelating agents or anti-fungal agents.

The overflow solution given as wash water and/or stabilizing solution is filled up can be reused in other processes such as desilvering process.

In order to simplify and expedite the processing, the silver halide color photographic material of the present invention may comprise a color developing agent incorporated therein. The incorporation of such a color developing agent in the light-sensitive material is preferably effected by the use of various precursors of color developing agent. Examples of such color developing agent precursors include indoaniline compounds as described in U.S. pat. No. 3,342,597, Schiff base type compounds as described in U.S. Pat. No. 3,342,599, and Research Disclosure Nos. 14,850, and 15,159, aldol compounds as described in Research Disclosure No. 13,924, metal complexes as described in U.S. Pat. No. 3,719,492, and urethane compounds as described in Japanese Patent Application (OPI) No. 135,628/78.

In order to accelerate color development, the silver halide color light-sensitive material of the present invention may optionally comprise various 1-phenyl-3-pyrazolidones incorporated therein. Typical examples of such compounds are described in Japanese Patent Application (OPI) Nos. 64,339/81, 144,547/82, and 115,438/83.

In the present invention, various processing solutions may be used at a temperature of 10° to 50° C. The standard temperature range is normally between 33° C. and 38° C. A higher temperature can be used to accelerate the processing, reducing the processing time. On the contrary, a lower temperature can be used to improve the image quality or the stability of the processing solution. In order to save silver in the light-sensitive material, a processing method using a cobalt intensification or hydrogen peroxide as described in West German Patent No. 2,226,770 or U.S. Pat. No. 3,764,499 may be employed.

The present invention is explained in greater detail with reference to the following examples, but the present invention should not be construed as being limited thereto.

EXAMPLE (1)

Sample (A) according to the present invention was prepared in the following manner.

A solution composed of 10 g of Polymer (P-3) according to the present invention, 10 g of Coupler (C-1), 6 g of Coupler Solvent (S-16) and 50 ml of ethyl acetate was heated to 50° C. and added to 100 ml of an aqueous solution containing 15 g of gelatin and 1.0 g of sodium dodecylbenzenesulfonate, and the mixture was stirred using a high speed stirrer (Homogenizer manufactured by Nippon Seiki Seisakusho) to obtain a finely dispersed emulsified dispersion.

The emulsified dispersion thus obtained was mixed with a silver chlorobromide photographic emulsion (silver chloride 98 mol%), pH of the mixture was adjusted to 6.0, and the resulting mixture was coated on a paper support, both surfaces of which were laminated with polyethylene to prepare Sample (A) according to the present invention having the layer structure and the composition of main components shown in Table 1 below. As a gelatin hardener, 4,6-dichloro-2-hydroxy-s-trizine sodium salt was used.

TABLE 1

| | |
|---|---|
| Third Layer: Protective Layer | |
| Gelatin | 1,000 mg/m$^2$ |
| Second Layer: Ultraviolet Light Absorbing Layer | |
| Ultraviolet Light Absorbing Agent (*1) | 600 mg/m$^2$ |
| Ultraviolet Light Absorbing Agent Solvent (*2) | 300 mg/m$^2$ |
| Gelatin | 800 mg/m$^2$ |
| First Layer: Emulsion Layer | |
| Silver chlorobromide emulsion (silver chloride: 98 mol %) | 300 mg/m$^2$ (as silver) |
| Coupler (C-1) | 1.01 mmol/m$^2$ |
| Coupler Solvent (S-16) | 300 mg/m$^2$ |
| Polymer (P-3) | 500 mg/m$^2$ |
| Gelatin | 1,250 mg/m$^2$ |
| Support: | |
| Paper support, both surfaces of which were laminated with polyethylene | |

(*1) 2-(2-Hydroxy-3-sec-butyl-5-tert-butylphenyl)-benzotriazole
(*2) Dibutyl phthalate In the same manner as described above, Samples (B) to (Z) according to the present invention and Samples (1) to (6) for comparison were prepared. The kind and amount of polymer and the kind of coupler used are shown in Table 2 and the other components are the same as those described for Sample (A) shown in Table 1.

Further, the average particle sizes of the oleophilic fine particles composed of coupler, polymer and coupler solvent having a high boiling point used in Samples (A) to (Z) according to the present invention and the average particle sizes of oleophilic fine particles composed of the coupler and the coupler solvent having a high boiling point used in Samples (1) to (6) for comparison was in the range of from 0.10 μm to 0.17 μm.

These samples were subjected to continuous gradation exposure through an optical wedge for sensitometry and then processed as described below.

| | | | |
|---|---|---|---|
| 1. | Color Development | 35° C. | 45 sec |
| 2. | Bleach-Fixing | 35° C. | 1 min 00 sec |
| 3. | Washing with Water | 25 to 30° C. | 2 min 30 sec |

The composition of each processing solution used for the above color development processing steps was as follows.

| | |
|---|---|
| Color Developing Solution: | |
| Water | 800 ml |
| Ethylenediaminetetraacetic Acid | 1.0 g |
| Sodium Sulfite | 0.2 g |
| N,N-Diethylhydroxylamine | 4.2 g |
| Potassium Bromide | 0.01 g |
| Sodium Chloride | 1.5 g |
| Triethanolamine | 8.0 g |
| Potassium Carbonate | 30 g |
| N-Ethyl-N-(β-methanesulfonamidoethyl)-3-methyl-4-aminoaniline Sulfate | 4.5 g |
| 4,4'-Diaminostilbene Type Fluorescent Whitening Agent (Whitex 4 manufactured by Sumitomo Chemical Co., Ltd.) | 2.0 g |
| Water to make | 1,000 ml |
| Adjusted pH to 10.25 with KOH | |
| Bleach-Fixing Solution: | |
| Ammonium Thiosulfate (54% by weight aqueous solution) | 150 ml |
| $Na_2SO_3$ | 15 g |
| $NH_4$[Fe(III) (EDTA)] | 55 g |
| EDTA·2Na | 4 g |
| Glacial Acetic Acid | 8.61 g |
| Water to make | 1,000 ml |
| | pH 5.4 |
| Rinse Solution: | |
| EDTA·2Na·2$H_2O$ | 0.4 g |
| Water to make | 1,000 ml |
| | pH 7.0 |

After processing, the samples were subjected to the following tests in order to evaluate their light fastness, heat fastness and fastness to combined high humidity and heat. More specifically, each of the samples was stored in a dark place at 100° C. for 5 days, and at 60° C. for 9 months stored in a dark place at 80° C. and 70% RH for 12 days, and at 60° C. and 70% RH for 3 months or irradiated to light in a fluorescent lap Fade-Ometer (30,000 lux) for 5 months. Then, the rate of decrease in image density in the area on the photographic material having an initial density of 1.5 was determined wherein an initial density was 1.0 in a light fastness test. The results thus obtained are shown in Table 2.

| | |
|---|---|
| Color Developing Solution: | |
| Water | 800 ml |
| Ethylenediaminetetraacetic Acid | 1.0 g |
| Sodium Sulfite | 0.2 g |
| N,N-Diethylhydroxylamine | 4.2 g |
| Potassium Bromide | 0.01 g |
| Sodium Chloride | 1.5 g |
| Triethanolamine | 8.0 g |
| Potassium Carbonate | 30 g |
| N-Ethyl-N-(β-methanesulfonamidoethyl)-3-methyl-4-aminoaniline Sulfate | 4.5 g |
| 4,4'-Diaminostilbene Type Fluorescent Whitening Agent (Whitex 4 manufactured by Sumitomo Chemical Co., Ltd.) | 2.0 g |
| Water to make | 1,000 ml |
| Adjusted pH to 10.25 with KOH | |
| Bleach-Fixing Solution: | |

-continued

| | |
|---|---|
| Ammonium Thiosulfate (54% by weight aqueous solution) | 150 ml |
| $Na_2SO_3$ | 15 g |
| $NH_4$[Fe(III) (EDTA)] | 55 g |
| EDTA·2Na | 4 g |
| Glacial Acetic Acid | 8.61 g |
| Water to make | 1,000 ml |
| | pH 5.4 |
| Rinse Solution: | |
| EDTA·2Na·$2H_2O$ | 0.4 g |
| Water to make | 1,000 ml |
| | pH 7.0 |

After processing, the samples were subjected to the following tests in order to evaluate their light fastness, heat fastness and fastness to combined high humidity and heat. More specifically, each of the samples was stored in a dark place at 100° C. for 5 days, and at 60° C. for 9 months stored in a dark place at 80° C. and 70% RH for 12 days, and at 60° C. and 70% RH for 3 months or irradiated to light in a fluorescent lap Fade-Ometer (30,000 lux) for 5 months. Then, the rate of decrease in image density in the area on the photographic material having an initial density of 1.5 was determined wherein an initial density was 1.0 in a light fastness test. The results thus obtained are shown in Table 2.

TABLE 2

| Sample | Coupler | Polymer Compound (Formula) | Polymer Amount used mg/m² | Dark Fading >100° C. 5 Days | Dark Fading >60° C. 9 Months | Dark Fading >80° C., 70% RH 12 Days | Dark Fading >60° C., 70% RH 3 Months | Light Fading Fluorescent Lamp (30,000 Lux) 5 Months |
|---|---|---|---|---|---|---|---|---|
| A | C-1 | P-3 | 500 | 37% | 31% | 30% | 29% | 38% Comparison |
| B | " | P-3 | 1,000 | 28% | 22% | 19% | 18% | 32% Comparison |
| C | " | P-8 | 1,000 | 27% | 42% | 21% | 27% | 34% Comparison |
| D | " | P-14 | 1,000 | 29% | 46% | 22% | 24% | 35% Comparison |
| E | " | P-57 | 1,000 | 21% | 15% | 13% | 14% | 24% Comparison |
| F | " | P-64 | 1,000 | 23% | 15% | 15% | 14% | 24% Comparison |
| G | " | P-65 | 1,000 | 21% | 17% | 14% | 13% | 25% Comparison |
| H | " | P-129 | 1,000 | 23% | 21% | 15% | 14% | 27% Comparison |
| I | C-2 | P-64 | 1,000 | 11% | 5% | 7% | 4% | 30% Present Invention |
| J | C-3 | P-3 | 1,000 | 15% | 19% | 9% | 6% | 36% Present Invention |
| K | " | P-8 | 1,000 | 16% | 17% | 10% | 10% | 40% Comparison |
| L | " | P-57 | 500 | 18% | 10% | 12% | 9% | 42% Present Invention |
| M | " | " | 1,000 | 12% | 6% | 7% | 4% | 42% Present Invention |

| Sample | Coupler | Polymer Compound (Formula) | Polymer Amount used mg/m² | Discoloration in Dark >100° C. 5 Days | Discoloration in Dark >60° C. 9 Months | Discoloration in Dark >80° C., 70% RH 12 Days | Discoloration in Dark >60° C., 70% RH 3 Months | Fluorescent Lamp (30,000 Lux) Discoloration under light 5 Months |
|---|---|---|---|---|---|---|---|---|
| Present Invention | | | | | | | | |
| N | C-3 | P-64 | 1,000 | 13% | 6% | 8% | 4% | 32% |
| O | " | P-129 | 1,000 | 14% | 9% | 8% | 5% | 33% |
| P | C-11 | P-3 | 1,000 | 22% | 13% | 15% | 12% | 28% |
| Q | " | P-56 | 1,000 | 20% | 10% | 13% | 10% | 27% |
| R | " | P-57 | 1,000 | 19% | 9% | 11% | 7% | 24% |
| S | " | P-64 | 1,000 | 21% | 10% | 13% | 7% | 23% |
| T | " | P-117 | 1,000 | 22% | 15% | 16% | 14% | 28% |
| U | " | P-129 | 1,000 | 20% | 11% | 13% | 10% | 26% |
| V | C-14 | P-3 | 500 | 3% | 4% | 2% | 4% | 67% |
| W | C-50 | P-3 | 1,000 | 17% | 10% | 11% | 7% | 36% |
| X | " | P-57 | 1,000 | 13% | 7% | 8% | 5% | 29% |
| Y | " | P-64 | 1,000 | 15% | 7% | 10% | 5% | 31% |
| Z | " | P-129 | 1,000 | 16% | 9% | 10% | 7% | 35% |

| Sample | Coupler | Polymer Compound (Formula) | Polymer Amount used mg/m² | Discoloration in Dark 5 Days | Discoloration in Dark 9 Months | Discoloration in Dark 12 Days | Discoloration in Dark 3 Months | Flouorescent Lamp (30,000 Lux) Discoloration under light 5 Months |
|---|---|---|---|---|---|---|---|---|
| Comparison | | | | | | | | |
| 1 | C-1 | — | — | 57% | 52% | 37% | 35% | 51% |
| 2 | C-2 | — | — | 29% | 26% | 14% | 13% | 60% |
| 3 | C-3 | — | — | 27% | 25% | 13% | 13% | 59% |
| 4 | C-11 | — | — | 42% | 29% | 25% | 22% | 50% |
| 5 | C-14 | — | — | 5% | 7% | 4% | 6% | 95% |
| 6 | C-50 | — | — | 35% | 33% | 18% | 17% | 56% |

It is apparent from the results shown in Table 2 that heat fastness, humidity fastness and light fastness are improved according to the present invention.

Furthermore, the polymer which may be effective to improve the advantages of the present invention is a homopolymer or copolymer which is composed of a monomer such that a homopolymer of said monomer exhibits higher grass transition temperature (Tg). The advantages of the present invention becomes more remarkable when a silver halide photographic material is treated at a lower temperature which is practically important conditions.

The color fastness of dye images in heat and light is remarkably improved and, particularly, the overall fastness is improved by adopting a combination of a polymer having high Tg and a compound of formula (Cp-I) wherein $R^{32}$ is an alkyl group having 2 carbon atoms.

EXAMPLE (2)

Samples (A-1) to (A-27) were prepared in the same manner as described for Sample A in Table 1 (refer to) except for using a silver chlorobromide emulsion (silver bromide: 70 mol%) in place of the silver chlorobromide emulsion (silver chloride: 98 mol%) in Sample A and changing the coupler, the coupler solvent, the polymer and the amount of polymer as shown in Table 3 below.

These samples were subjected to continuous gradation exposure through an optical wedge for sensitometry and then developed by Process (A) or Process (B). The difference between Process (A) and Process (B) was only in the color development step wherein Color Developing Solution (A) was used in Process (A) and Color Developing Solution (B), which had the same composition as that of Color Developing Solution (A) except for eliminating benzyl alcohol, was used in Process (B), and the other processing steps were the same in both Process (A) and Process (B).

Color development processing was conducted using the following processing steps:

| Color development Processing Steps | | |
|---|---|---|
| 1. Color Development | 33° C. | 3 min 30 sec |
| 2. Bleach-Fixing | 33° C. | 1 min 30 sec |
| 3. Washing with Water | 28 to 35° C. | 3 min 30 sec |

The composition of each processing solution used for the above color development processing steps was as follows:

| | |
|---|---|
| Color Developing Solution (A): | |
| Diethylenetriaminepentaacetic Acid | 1.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine Sulfate | 5.0 g |
| $Na_2CO_3$ (monohydrate) | 30 g |
| Fluorescent Whitening Agent (4,4'-diaminostilbene type) | 1.0 g |
| Water to make | 1 liter |
| pH | 10.1 |
| Color Developing Solution (B): | |
| Diethylenetriaminepentaacetic Acid | 1.0 g |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine Sulfate | 5.0 g |
| $Na_2CO_3$ (monohydrate) | 30 g |
| Fluorescent Whitening Agent (4,4'-diaminostilbene type) | 1.0 g |
| Water to make | 1 liter |
| Bleach-Fixing Solution: | |
| Ammonium Thiosulfate (70% by weight aqueous solution) | 150 ml |
| $Na_2SO_3$ | 15 g |
| $NH_4$[Fe(III) (EDTA)] | 55 g |
| EDTA · 2Na | 4 g |
| Water to make | 1 liter |
| pH | 6.9 |

The maximum densities obtained from Process (A) and Process (B) are shown in Table 3.

TABLE 3

| Sample | Coupler | Coupler Solvent | Amount of Coupler Solvent (mg/m²) | Polymer | Amount of Polymer (mg/m²) | Reflective Density: Color Developing Solution (A) | Reflective Density: Color Developing Solution (B) | Remarks |
|---|---|---|---|---|---|---|---|---|
| A-1 | C-1 | — | — | — | — | 2.88 | 1.53 | Comparison |
| A-2 | C-1 | — | — | P-3 | 500 | 2.91 | 1.35 | " |
| A-3 | C-1 | — | — | — | 1000 | 3.06 | 1.17 | " |
| A-4 | C-1 | — | — | P-3 | 1500 | 2.97 | 0.95 | " |
| A-5 | C-1 | S-16 | 300 | — | — | 2.86 | 1.95 | " |
| A-6 | C-1 | " | 300 | P-3 | 500 | 3.04 | 2.02 | Present invention |
| A-7 | C-1 | " | 300 | P-3 | 1000 | 3.10 | 2.01 | Present invention |
| A-8 | C-1 | " | 500 | P-3 | 1500 | 2.98 | 2.03 | Present invention |
| A-9 | C-3 | — | — | — | — | 2.63 | 1.20 | Comparison |
| A-10 | C-3 | — | — | P-8 | 1000 | 2.61 | 0.90 | " |
| A-11 | C-3 | S-5 | 400 | P-8 | 1000 | 2.72 | 1.63 | Present invention |
| A-12 | C-3 | S-25 | 400 | P-8 | 1000 | 2.70 | 1.59 | Present invention |
| A-13 | C-3 | S-61 | 300 | P-8 | 1000 | 2.70 | 1.55 | Present invention |
| A-14 | C-3 | S-25 / S-56 | 300 / 200 | P-8 | 1000 | 2.82 | 2.49 | Present invention |
| A-15 | C-11 | — | — | — | — | 2.98 | 2.30 | Comparison |
| A-16 | C-11 | — | — | P-62 | 1000 | 2.96 | 2.40 | " |
| A-17 | C-11 | S-9 | 300 | P-62 | 1000 | 3.02 | 2.51 | Present invention |
| A-18 | C-2 | — | — | — | — | 2.65 | 1.32 | Comparison |
| A-19 | C-2 | — | — | P-57 | 1200 | 2.61 | 0.84 | " |
| A-20 | C-2 | S-16 | 150 | P-57 | 1200 | 2.71 | 1.63 | Present invention |
| A-21 | C-2 | S-16 | 300 | P-57 | 1200 | 2.79 | 1.71 | Present invention |
| A-22 | C-2 | S-56 | 150 | P-57 | 1200 | 2.76 | 1.68 | Present invention |

TABLE 3-continued

| Sample | Coupler | Coupler Solvent | Amount of Coupler Solvent (mg/m²) | Polymer | Amount of Polymer (mg/m²) | Reflective Density: Color Developing Solution (A) | Reflective Density: Color Developing Solution (B) | Remarks |
|---|---|---|---|---|---|---|---|---|
| A-23 | C-2 | S-16<br>S-56 | 300<br>150 | P-57 | 1200 | 2.84 | 2.41 | Present invention |
| A-24 | C-25 | — | — | — | — | 2.59 | 1.24 | Comparison |
| A-25 | C-25 | — | — | P-60 | 1000 | 2.48 | 0.68 | " |
| A-26 | C-25 | S-16 | 300 | P-60 | 1000 | 2.57 | 1.67 | Present invention |
| A-27 | C-25 | S-31 | 300 | P-60 | 1000 | 2.54 | 1.63 | Present invention |

It is apparent from the results shown in Table 3 that the samples according to the present invention containing the coupler solvent having a high boiling point and the polymer in accordance with the present invention are excellent in color forming ability and exhibit high color density even when developed with the color developing solution which does not contain benzyl alcohol in comparison with the samples for comparison.

EXAMPLE (3)

With Samples (A-1), (A-3), (A-5), (A-7), (A-9), (A-10), (A-12), (A-15), (A-16), (A-17), (A-18), (A-19), (A-21) and (A-23) processed with Color Developing Solution (A) in Example 2, light fastness, heat fastness and fastness to combined high humidity and heat were evaluated according to the test methods as shown in Example 1. The rate of decrease in image density in the area having an initial density of 1.5 was determined to investigate the degree of fading. The results thus obtained are shown in Table 4.

TABLE 4

| Sample | Coupler | Coupler Solvent | Coupler Solvent (mg/m²) | Polymer | Amount of Polymer (mg/m²) | Dark Fading: 100° C. 5 Days | Dark Fading: 80° C., 70% RH 12 Days | Light Fading: Xenon (85,000 Lux) 6 Days | Remark |
|---|---|---|---|---|---|---|---|---|---|
| A-1 | C-1 | — | — | — | — | 52% | 43% | 49% | Comparison |
| A-3 | C-1 | — | — | P-3 | 1000 | 27% | 23% | 40% | " |
| A-5 | C-1 | S-16 | 300 | — | — | 56% | 47% | 24% | " |
| A-7 | C-1 | S-16 | 300 | P-3 | 1000 | 26% | 20% | 12% | Present invention |
| A-9 | C-3 | — | — | — | — | 32% | 18% | 62% | Comparison |
| A-10 | C-3 | — | — | P-8 | 1000 | 19% | 14% | 50% | " |
| A-12 | C-3 | S-25 | 400 | P-8 | 1000 | 17% | 12% | 23% | Present invention |
| A-15 | C-11 | — | — | — | — | 49% | 40% | 56% | Comparison |
| A-16 | C-11 | — | — | P-62 | 1000 | 32% | 27% | 43% | " |
| A-17 | C-11 | S-9 | 300 | P-62 | 1000 | 21% | 16% | 12% | Present invention |
| A-18 | C-2 | — | — | — | — | 32% | 19% | 63% | Comparison |
| A-19 | C-2 | — | — | P-57 | 1200 | 16% | 10% | 50% | " |
| A-21 | C-2 | S-16 | 300 | P-57 | 1200 | 12% | 7% | 15% | Present invention |
| A-23 | C-2 | S-16<br>S-56 | 300<br>150 | P-57 | 1200 | 10% | 6% | 13% | Present invention |

As is apparent from the results shown in Table 4, heat fastness, humidity fastness and light fastness are improved for photographic materials prepared according to the present invention. When employing the polymer according to the present invention without using the coupler solvent having a high boiling point, light fastness is extremely poor, while heat fastness and humidity fastness are improved to some extent. On the contrary, heat fastness, humidity fastness and light fastness are greatly improved by employing the coupler solvent having a high boiling point together with the polymer according to the present invention as can be seen from the results shown in Table 4 above.

EXAMPLE (4)

9.2 g of Coupler (C-1) according to the present invention was dissolved in 55 ml of ethyl acetate by heating to 60° C. The resulting coupler solution was added to a mixture of 100 g of a 16% aqueous solution of gelatin and 10 ml of a 5% aqueous solution of sodium dodecylbenzenesulfonate at 50° C. with stirring, and the mixture was emulsified using a high speed stirrer (Homogenizer manufactured by Nippon Seiki Seisakusho). To the resulting emulsion was then added water so as to make 400 g whereby Emulsion (A) was prepared. The average particle size of Emulsion (A) was 0.14 μm.

In a manner similar to that as described above, Emulsions (B) to (K) were prepared. The particle size of the emulsion was controlled by changing the revolution rate of the stirring blade of the homogenizer. The average particle size was measured by Nanosizer manufactured by the Coal Tar Lte. in England.

Emulsions (A) to (K) were melted by heating to 40° C. with stirring. The stability of the emulsions with the lapse of time was evaluated. The results obtained are shown in Table 5.

TABLE 5

| Emulsion | Coupler | Amount of Coupler (g) | Coupler Solvent | Amount of Coupler Solvent (g) | Polymer | Amount of Polymer (g) | Average Particle Size: Just After Preparation (μ) | After 24 hs. (μ) | After 48 hs. (μ) | After 72 hs. (μ) | Remark |
|---|---|---|---|---|---|---|---|---|---|---|---|
| A | C-1 | 9.2 | — | — | — | — | 0.14 | 0.25 | 0.56 | 1.10 | Comparison |
| B | C-1 | 9.2 | — | — | P-3 | 18 | 0.13 | 0.18 | 0.42 | 0.90 | Comparison |
| C | C-1 | 9.2 | — | — | P-63 | 15 | 0.16 | 0.19 | 0.70 | 1.08 | " |
| D | C-1 | 9.2 | S-16 | 3 | P-3 | 18 | 0.17 | 0.18 | 0.17 | 0.18 | Present invention |
| E | C-1 | 9.2 | S-16 | 6 | P-3 | 18 | 0.16 | 0.18 | 0.18 | 0.18 | Present invention |
| F | C-1 | 9.2 | S-31 | 4 | P-63 | 15 | 0.14 | 0.14 | 0.14 | 0.16 | Present invention |
| G | C-2 | 9.4 | — | — | — | — | 0.17 | 0.19 | 0.36 | 0.49 | Comparison |
| H | C-2 | 9.4 | — | — | P-52 | 12 | 0.19 | 0.22 | 0.45 | 0.93 | " |
| I | C-2 | 9.4 | — | — | P-57 | 12 | 0.15 | 0.21 | 0.61 | 0.87 | " |
| J | C-2 | 9.4 | S-16 | 8 | P-52 | 12 | 0.14 | 0.14 | 0.15 | 0.17 | Present invention |
| K | C-2 | 9.4 | S-25 | 6 | P-57 | 12 | 0.18 | 0.18 | 0.20 | 0.21 | Present invention |

It is apparent from the results shown in Table 5 that the oleophilic fine particles composed of the coupler, the coupler solvent having a high boiling point and the polymer according to the present invention exhibit substantially no change in particle size even after 72 hours. On the contrary, it can be recognized that the particle size of the emulsion for comparison increases over time. These results clearly indicate that the emulsions according to the present invention have excellent stability.

EXAMPLE (5)

On a paper support, both surfaces of which were laminated with polyethylene, were coated layers as shown in Table 6 below in order to prepare a multilayer color photographic light-sensitive material for printing paper, which was designated Light-Sensitive Material (a). The coating solutions used were prepared in the following manner.

The Coating Solution for the First Layer:

19.1 g of Yellow Coupler (a) and 4.4 g of Color Image Stabilizer (b) were dissolved in a mixture of 27.2 ml of ethyl acetate and 10.9 ml of Solvent (c) and the resulting solution was added to 185 ml of a 10% aqueous solution of gelatin containing 16 ml of a 10% aqueous solution of sodium dodecylbenzenesulfonate. The mixture was emulsified and dispersed using a homogenizer to obtain an emulsified dispersion. Separately, to a silver chlorobromide emulsion (having a bromide content of 80 mol% and containing 70 g of silver per kg of the emulsion) was added $7.0\times10^{-4}$ mol of a blue-sensitive sensitizing dye shown below per mol of the silver chlorobromide to prepare 90 g of a blue-sensitive emulsion. The dispersion was mixed with emulsion, with the concentration of the resulting mixture being controlled with gelatin, to form the composition shown in Table 6 below,.i.e., the coating solution for the first layer.

Coating solutions for the second layer to the seventh layer were prepared in a similar manner as described for the coating solution for the first layer. 2,4-Dichloro-6-oxy-s-triazine sodium salt was used as a gelatin hardener in each layer.

The following spectral sensitizing dyes were employed in the emulsion layers, respectively.

Blue-Sensitive Emulsion Layer

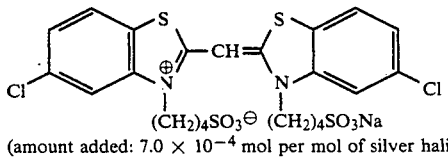

(amount added: $7.0\times10^{-4}$ mol per mol of silver halide)

Green-Sensitive Emulsion Layer

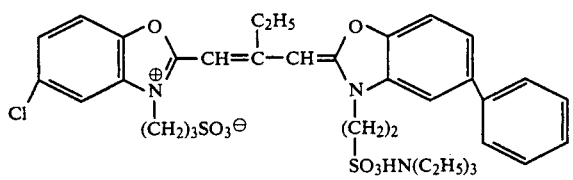

(amount added: $4.0\times10^{-4}$ mol per mol of silver halide)

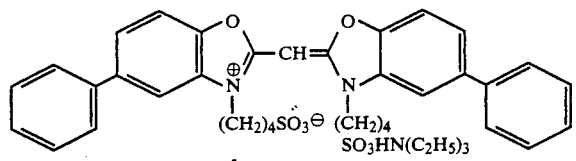

(amount added: $7.0\times10^{-5}$ mol per mol of silver halide)

Red-Sensitive Emulsion Layer

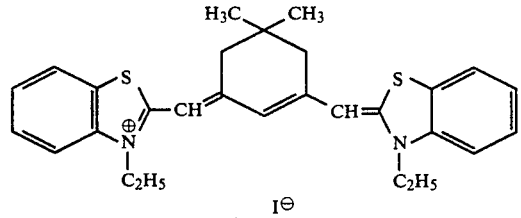

(amount added: $1.0\times10^{-4}$ mol per mol of silver halide)

The following dyes were employed as irradiation preventing dyes in the emulsion layers, respectively.

Green-Sensitive Emulsion Layer

-continued

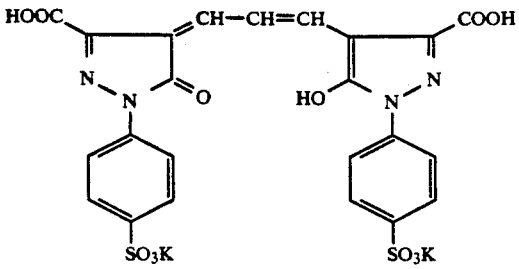

Red-Sensitive Emulsion Layer

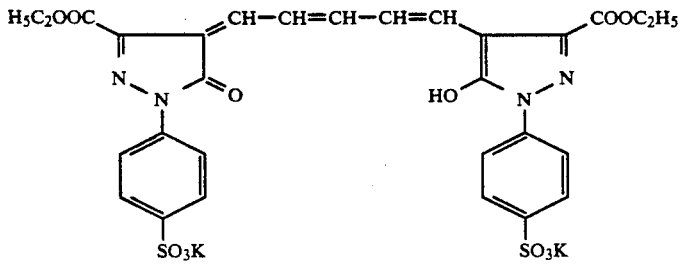

The compounds used in the above-described layers have the structures shown below, respectively.

(a) Yellow Coupler

Yellow Coupler (Y-2)

(b) Color Image Stabilizer

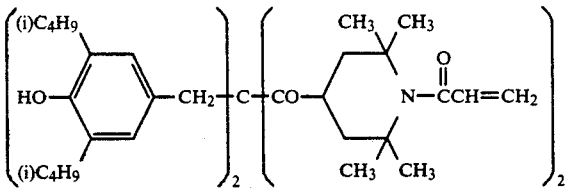

(c) Solvent

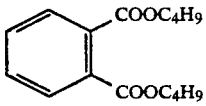

(d) Color Mixing Preventing Agent

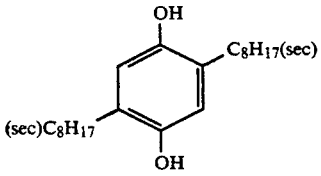

(e) Magenta Coupler

Magenta Coupler (M-3)

(f) Color Image Stabilizer

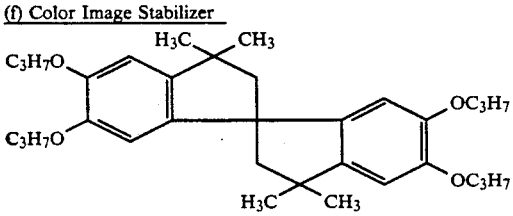

(g) Solvent

-continued

A mixture of $(C_8H_{17}O)_3P{=}O$ and 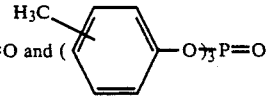 in a weight ratio of 2:1

(h) Ultraviolet Light Absorbing Agent

A mixture of

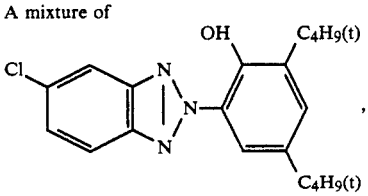

,

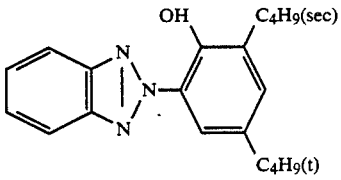

, and

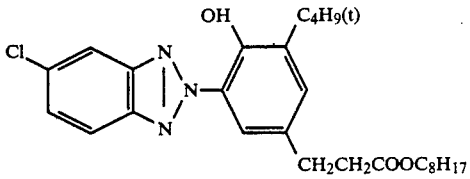

in a molar ratio of 1:5:3, in the respective order listed above.

(i) Color Mixing Preventing Agent

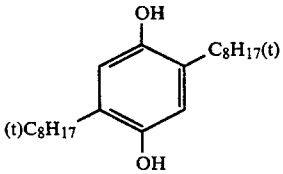

(j) Solvent $(iso\text{-}C_9H_{19}O)_3P{=}O$ (k) Cyan Coupler

Cyan Coupler (C-2)

(l) Solvent

-continued

Coupler solvent having high boiling point (S-16)

(m) Antistaining Agent

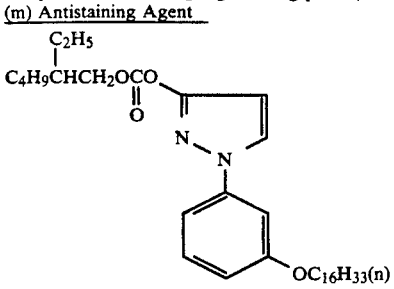

TABLE 6

| | Amount Used |
|---|---|
| Seventh Layer: Protective Layer | |
| Gelatin | 1.33 g/m$^2$ |
| Acryl-modified polyvinyl alcohol copolymer (degree of modification: 17%) | 0.17 g/m$^2$ |
| Sixth Layer: Ultraviolet Light Absorbing Layer | |
| Gelatin | 0.54 g/m$^2$ |
| Ultraviolet Light Absorbing Agent (h) | 0.21 g/m$^2$ |
| Solvent (j) | 0.09 ml/m$^2$ |
| Fifth Layer: Red-Sensitive Layer | |
| Silver chlorobromide emulsion (silver bromide: 70 mol %) | 0.26 g/m$^2$ (as silver) |
| Gelatin | 0.98 g/m$^2$ |
| Cyan Coupler (k) | 0.41 g/m$^2$ *1 |
| Solvent (l) | 0.20 ml/m$^2$ |
| Fourth Layer: Ultraviolet Light Absorbing Layer | |
| Gelatin | 1.60 g/m$^2$ |
| Ultraviolet Light Absorbing Agent (h) | 0.62 g/m$^2$ |

TABLE 6-continued

| | Amount Used |
|---|---|
| Color Mixing Preventing Agent (i) | 0.05 g/m$^2$ |
| Solvent (j) | 0.22 ml/m$^2$ |
| Third Layer: Green-Sensitive Layer | |
| Silver chlorobromide emulsion (silver bromide: 75 mol %) | 0.16 g/m$^2$ (as silver) |
| Gelatin | 1.80 g/m$^2$ |
| Magenta Coupler (e) | 0.34 g/m$^2$ |
| Color Image Stabilizer (f) | 0.20 g/m$^2$ |
| Solvent (g) | 0.60 g/m$^2$ |
| Antistaining Agent (m) | 0.08 g/m$^2$ |
| Second Layer: Color Mixing Preventing Layer | |
| Gelatin | 0.99 g/m$^2$ |
| Color Mixing Preventing Agent (d) | 0.08 g/m$^2$ |
| First Layer: Blue-Sensitive Layer | |
| Silver chlorobromide emulsion (silver bromide: 80 mol %) | 0.30 g/m$^2$ (as silver) |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.47 ml/m$^2$ |
| Support: | |
| Polyethylene laminated paper (the polyethylene coating containing a white pigment ($TiO_2$) and a bluish dye (ultramarine) on the first layer side) | |

*1: 0.80 mmol/m$^2$

Light-Sensitive Materials (b) to (Y) for comparison or according to the present invention were prepared in the same manner as described for Light-Sensitive Material (a) except that the composition of coupler oil droplets in the fifth layer (red-sensitive layer) of Light-Sensitive Material (a) was changed to those as shown in Table 7 below, respectively.

TABLE 7

| Light Sensitive Material | Coupler | Amount of Coupler (mmol/m$^2$) | Polymer | Amount of Polymer (g/m$^2$) | Coupler Solvent | Coupler Solvent (g/m$^2$) | Other Additives | Amount of Other Additives | Remark |
|---|---|---|---|---|---|---|---|---|---|
| a | C-2 | 0.80 | — | — | S-16 | 0.20 | — | — | Comparison |
| b | " | " | P-21 | 1.0 | — | — | — | — | " |
| c | " | " | P-21 | 1.0 | S-16 | 0.20 | — | — | Present Invention |
| d | C-2 | 0.80 | P-21 | 1.0 | S-16 | 0.20 | X-7 | 0.05 | Present Invention |
| e | C-2 | 0.80 | P-21 | 1.0 | S-16 | 0.10 | X-11 | 0.20 | Present Invention |
| f | C-2 | 0.80 | P-3 | 1.0 | — | — | — | — | Comparison |
| g | " | " | P-3 | 1.0 | S-16 | 0.10 | X-7<br>X-11 | 0.05<br>0.20 | Present Invention |
| h | C-2 | 0.80 | — | — | S-25 | 0.20 | — | — | Comparison |
| i | " | " | P-57 | 1.0 | — | — | — | — | |
| j | " | " | P-57 | 1.0 | S-25 | 0.20 | — | — | Present Invention |
| k | C-2 | 0.80 | P-62 | 1.0 | S-25 | 0.20 | X-11 | 0.20 | Present Invention |
| l | C-3 | 0.80 | — | — | S-16 | 0.15 | — | — | Comparison |
| m | " | " | P-3 | 1.0 | S-16 | 0.15 | — | — | Present Invention |
| n | C-3 | 0.80 | P-21 | 1.0 | S-16 | 0.20 | — | — | Present Invention |
| o | C-3 | 0.80 | P-57 | 1.0 | S-16 | 0.20 | X-7<br>X-11 | 0.05<br>0.20 | Present Invention |
| p | C-3 | 0.80 | P-62 | 1.0 | S-16 | 0.20 | — | — | Present Invention |
| q | C-1 | 0.80 | — | — | S-16 | 0.20 | — | — | Comparison |
| r | " | " | P-3 | 1.5 | S-16 | 0.20 | — | — | Present Invention |
| s | C-1 | 0.80 | P-3 | 1.5 | S-16 | 0.20 | X-6<br>P*1 | 0.07<br>0.25 | Present Invention |
| t | C-1 | 0.80 | P-57 | 1.2 | S-16 | 0.25 | — | — | Present Invention |
| u | C-1 | 0.80 | P-62 | 1.2 | S-16 | 0.25 | — | — | Present Invention |
| v | C-11 | 0.80 | — | — | S-16 | 0.20 | — | — | Comparison |
| w | " | " | P-3 | 1.2 | — | — | — | — | " |
| x | " | " | P-3 | 1.2 | S-16 | 0.20 | — | — | Present |

TABLE 7-continued

| Light Sensitive Material | Coupler | Amount of Coupler (mmol/m²) | Polymer | Amount of Polymer (g/m²) | Coupler Solvent | Coupler Solvent (g/m²) | Other Additives | Amount of Other Additives | Remark |
|---|---|---|---|---|---|---|---|---|---|
| y | C-11 | 0.80 | P-57 | 1.2 | S-16 | 0.20 | — | — | Invention Present Invention |

*1P indicated a mixture of X-9, X-10 and X-11 in a molar ratio of 1:5:3.

These light-sensitive materials thus prepared were subjected to stepwise exposure for sensitometry through each of blue, green and red filters using a sensitometer (FWH Type manufactured by Fuji Photo Film Co., Ltd.; color temperature of light source: 3,200° K.). Exposure time as 0.5 second in an exposure amount of 250 CMS.

Then the exposed light-sensitive materials were treated using Process (B) as described in Example 2. Fastness of the images obtained was evaluated for yellow, magenta and cyan fastness using the same test methods as shown in Examples 1 and 3. The rate of decrease in density in the area having an initial density of 1.0 was determined to establish the degree of fading. The results thus obtained are shown in Tables 8 and 9.

TABLE 8

| | Yellow and Magenta*1 | | |
|---|---|---|---|
| | Dark Fading | | |
| | 100° C., 5 Days | 80° C., 70% RH 12, Days | Light Fading Xenon, 6 Days |
| Yellow | 2 to 4 | 3 to 4 | 12 to 14 |
| Magenta | 2 to 5 | 2 to 3 | 14 to 16 |

*1The rate of fading of yellow and magenta of all Light-Sensitive Materials (a) to (y) was within the ranges shown in Table 8.

TABLE 9

| | Cyan | | | |
|---|---|---|---|---|
| Light-Sensitive Material | Dark Fading 100° C. 5 Days | Dark Fading 80° C., 70% RH 12 Days | Light Fading Xenon 6 Days | Remark |
| a | 29% | 16% | 34% | Comparison |
| b | 17% | 12% | 56% | Comparison |
| c | 11% | 7% | 20% | Present Invention |
| d | 9% | 6% | 17% | Present Invention |
| e | 8% | 6% | 16% | Present Invention |
| f | 18% | 11% | 54% | Comparison |
| g | 9% | 7% | 17% | Present Invention |
| h | 31% | 17% | 36% | Comparison |
| i | 15% | 10% | 50% | Comparison |
| j | 7% | 6% | 17% | Present Invention |
| k | 6% | 6% | 17% | Present Invention |
| l | 31% | 17% | 37% | Comparison |
| m | 12% | 9% | 19% | Present Invention |
| n | 10% | 6% | 18% | Present Invention |
| o | 6% | 6% | 16% | Present Invention |
| p | 7% | 7% | 16% | Present Invention |
| q | 50% | 47% | 21% | Comparison |
| r | 21% | 18% | 12% | Present Invention |
| s | 18% | 16% | 8% | Present Invention |
| t | 16% | 17% | 8% | Present |

TABLE 9-continued

| | Cyan | | | |
|---|---|---|---|---|
| Light-Sensitive Material | Dark Fading 100° C. 5 Days | Dark Fading 80° C., 70% RH 12 Days | Light Fading Xenon 6 Days | Remark |
| u | 15% | 16% | 8% | Invention Present Invention |
| v | 36% | 32% | 27% | Comparison |
| w | 43% | 32% | 32% | Comparison |
| x | 17% | 12% | 14% | Present Invention |
| y | 11% | 10% | 11% | Present Invention |

It is apparent from the results shown in Tables 8 and 9 that with the multilayer color printing papers according to the present invention, light fading and dark fading are controlled with good color balance and the fading balance of yellow, magenta and cyan is excellent in total as compared with the comparison color printing papers. Thus, it can be seen that the dye images obtained according to the present invention can be preserved for a long period of time.

The same procedures as described above were conducted using Yellow Couplers (Y-1), (Y-3), (Y-4) and (Y-5), and Magenta Couplers (M-1), (M-2) and (M-4) in place of (Y-2) and (M-3), respectively, and similar results as described above were obtained. It was again observed that the light-sensitive materials according to the present invention have an excellent balance between yellow, magenta and cyan fading.

EXAMPLE 6

A multilayer color paper (1) was prepared by coating layers having the following formulations on a paper support.

(Preparation of coating composition for 1st layer)

In 27.2 cc of ethyl acetate and 15 ml of a high-boiling solvent system (S-9/S-16-1/1 by weight) were dissolved 10.2 g of Yellow Coupler (Y-1), 9.1 g of Yellow Coupler (Y-2), and 2.1 g of Dye Image Stabilizer (Cpd-2), and the resulting solution was dispersed in 185 cc of a 10% gelatin aqueous solution containing 8 cc of a 10% sodium dodecylbenzenesulfonate aqueous solution. The dispersion was mixed with Emulsions (EM-1) and (EM-2), and a gelatin concentration was adjusted so as to have a prescribed composition to prepare a coating composition for the 1st layer. Coating compositions for the 2nd to 7th layers were prepared in the similar manner. Each of the layers further contained 1-oxy-3,5-dichloro-s-triazine sodium salt as a gelatin hardener. Further, (Cpd-1) was used as a thickening agent. (Layer constitution)

The constitution of each layer is shown below:

In the descriptions neumerals show an amount of coatings in g/m² and an amount of silver halide emulsion shows calculated amount of silver coated therein.

| | |
|---|---|
| 1st Layer (Blue-Sensitive Layer) | |
| Mono-dispersed silver chlorobromide emulsion (EM-1) spectrally sensitized with Sensitizing Dye (ExS-1) | 0.13 |
| Mono-dispersed silver chlorobromide emulsion (EM-2) spectrally sensitized with Sensitizing Dye (ExS-1) | 0.13 |
| Gelatin | 1.86 |
| Yellow Coupler (Y-1) | 0.44 |
| Yellow Coupler (Y-2) | 0.39 |
| Dye Image Stabilizer (Cpd-2) | 0.08 |
| Solvent (S-9) | 0.35 |
| Solvent (S-16) | 0.35 |
| Color Mixing Inhibitor (Cpd-18) | 0.01 |
| 2nd Layer (Color Mixing Preventing Layer) | |
| Gelatin | 0.99 |
| Color Mixing Inhibitor (Cpd-3) | 0.08 |
| 3rd Layer (Green-Sensitive Layer) | |
| Mono-dispersed silver chlorobromide emulsion (EM-3) spectrally sensitized with Sensitizing Dyes (ExS-2 & 3) | 0.05 |
| Mono-dispersed silver chlorobromide emulsion (EM-4) spectrally sensitized with Sensitizing Dyes (ExS-2 & 3) | 0.11 |
| Gelatin | 1.80 |
| Magenta Coupler (M-35) | 0.39 |
| Dye Image Stabilizer (Cpd-4) | 0.20 |
| Dye Image Stabilizer (Cpd-5) | 0.02 |
| Dye Image Stabilizer (Cpd-6) | 0.03 |
| Solvent (S-16) | 0.12 |
| Solvent (S-7) | 0.25 |
| 4th Layer (Ultraviolet Absorbing Layer) | |
| Gelatin | 1.60 |
| Ultraviolet Absorbent (Cpd-7/Cpd-9/Cpd-16 = 3/2/6 by weight) | 0.70 |
| Color Mixing Inhibitor (Cpd-11) | 0.05 |
| Solvent (S-69) | 0.27 |

-continued

| | |
|---|---|
| 5th Layer (Red-Sensitive Layer) | |
| Mono-dispersed silver chlorobromide emulsion (EM-5) spectrally sensitized with Sensitizing Dyes (ExS-4 & 5) | 0.07 |
| Mono-dispersed silver chlorobromide emulsion (EM-6) spectrally sensitized with Sensitizing Dyes (ExS-4 & 5) | 0.16 |
| Gelatin | 0.92 |
| Cyan Coupler (C-2) | 0.32 |
| Dye Image Stabilizer (Cpd-8/Cpd-9/Cpd-10 = 3/4/2 by weight) | 0.17 |
| Color Mixing Inhibitor (Cpd-18) | 0.02 |
| Color Mixing Inhibitor (Cpd-3) | 0.02 |
| Solvent (S-9) | 0.10 |
| Solvent (S-16) | 0.10 |
| Solvent (S-5) | 0.10 |
| 6th Layer (Ultraviolet Absorbing Layer) | |
| Gelatin | 0.54 |
| Ultraviolet Absorbent (Cpd-7/Cpd-8/Cpd-9 = 1/5/3 by weight) | 0.21 |
| Solvent (S-69) | 0.08 |
| 7th Layer (Protective Layer) | |
| Gelatin | 1.33 |
| Acryl-modifed polyvinyl alcohol (degree of modification: 17%) | 0.17 |
| Liquid paraffin | 0.03 |

In the emulsion layers, (Cpd-12) and (Cpd-13) were used as anti-irradiation dyes.

In each layer, Alkanol XC (produced by E. I. Du pont), sodium alkylbenzenesulfonate, succinic ester, and Megafac F-120 (produced by Dai-Nippon Ink K.K.) were used as dispersing agents or coating aids; and (Cpd-14), (Cpd-15), and (Cpd-17) were used as stabilizers for silver halide.

The compounds used in the sample preparation are shown below:

Cpd-1

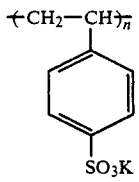

Cpd-2

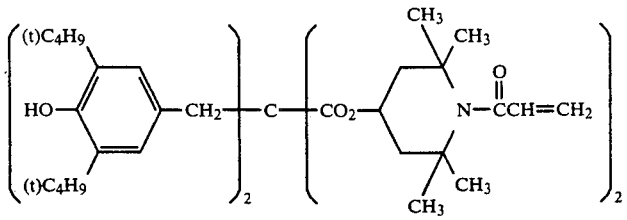

Cpd-3

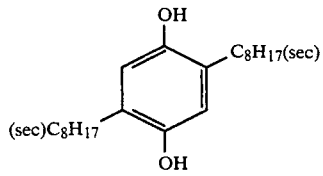

-continued
Cpd-4
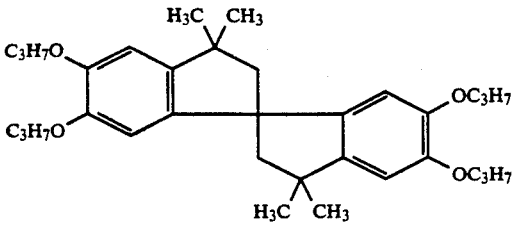
Cpd-5
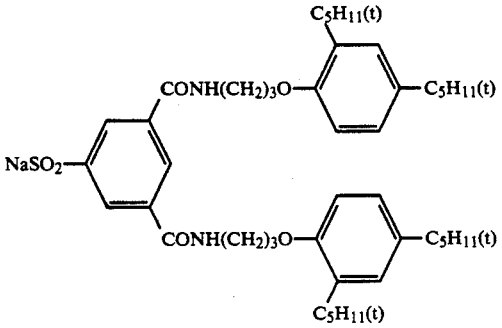
Cpd-6
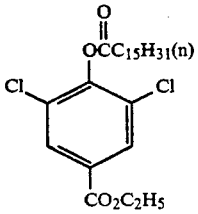
Cpd-7
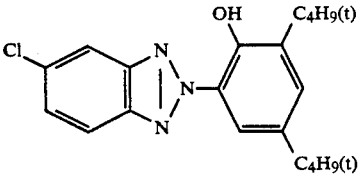
Cpd-8
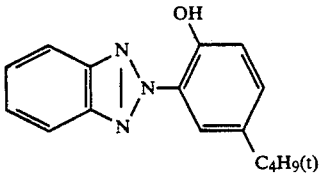
Cpd-9
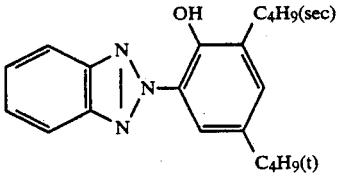
Cpd-10
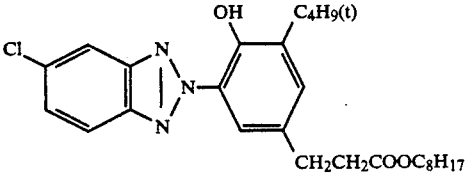
Cpd-11
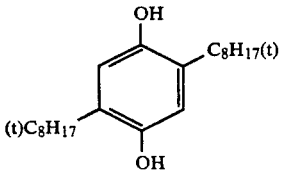

-continued
Cpd-12
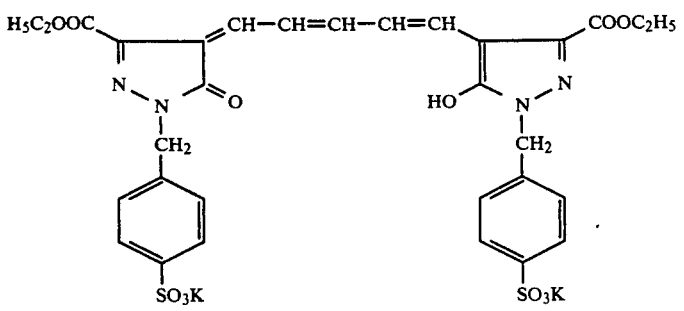
Cpd-13
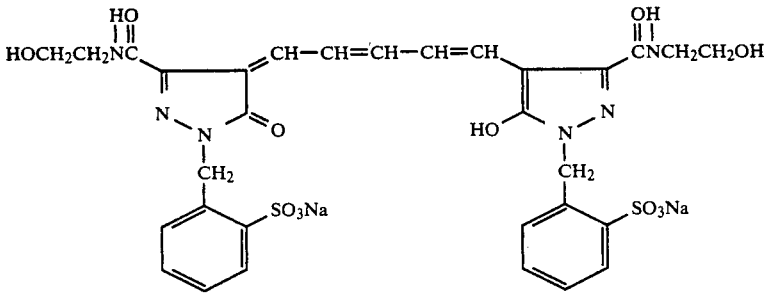
Cpd-14
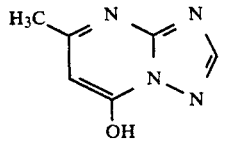
Cpd-15
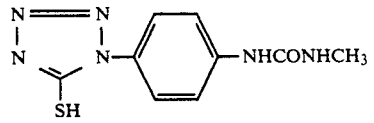
Cpd-16
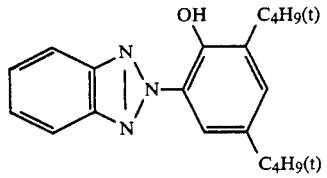
Cpd-17
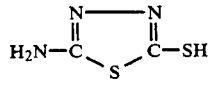
Cpd-18
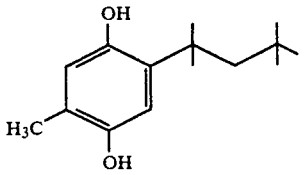
ExS-1
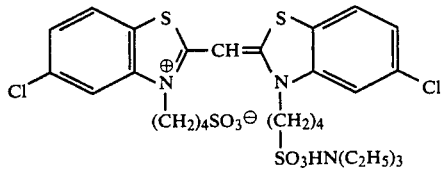

-continued

ExS-2

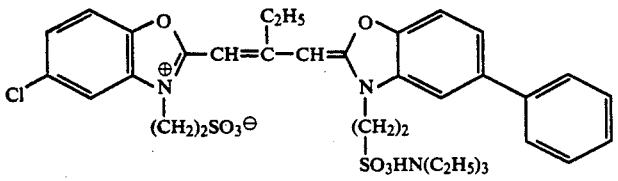

ExS-3

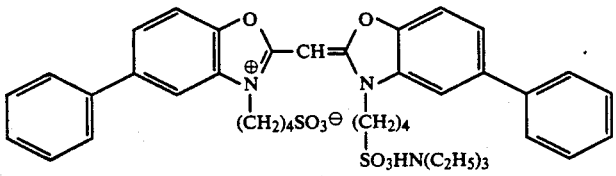

ExS-4

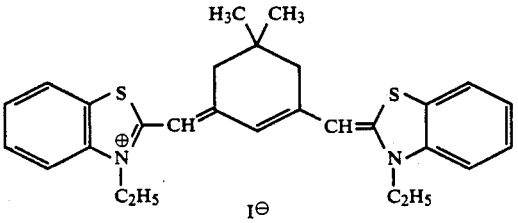

ExS-5

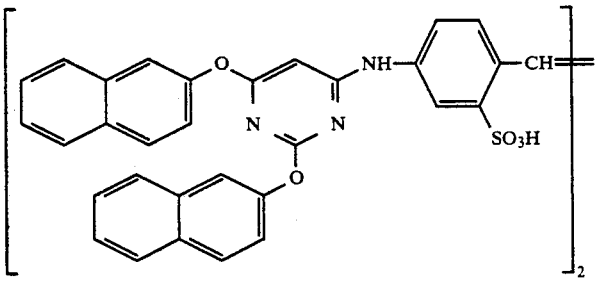

Emulsions used in the sample preparation are tabulated below.

| Emulsion No. | Shape of Grains | Mean Grain Size* (μm) | Br Content (mol %) | Coefficient of Variation** |
|---|---|---|---|---|
| EM-1 | cubic | 1.0 | 80 | 0.08 |
| EM-2 | cubic | 0.75 | 80 | 0.07 |
| EM-3 | cubic | 0.5 | 83 | 0.09 |
| EM-4 | cubic | 0.4 | 83 | 0.10 |
| EM-5 | cubic | 0.5 | 73 | 0.09 |

-continued

| Emulsion No. | Shape of Grains | Mean Grain Size* (μm) | Br Content (mol %) | Coefficient of Variation** |
|---|---|---|---|---|
| EM-6 | cubic | 0.4 | 73 | 0.10 |

Note:
*A mean of an edge length based on a projected area.
**A ratio of a standard deviation(s) to a mean grain size ($\bar{d}$), which represents ($s/\bar{d}$).

Samples (2) to 13) were produced in the same manner as for Sample (1) except for alteration shown in Table 10 shown.

TABLE 10

| Sample No. | Alteration on Sample (1) Blue-Sensitive Layer | Green-Sensitive Layer | Red-Sensitive Layer |
|---|---|---|---|
| (1) | — | — | — |
| (2) | — | — | P-56 (0.30 g/m$^2$) was added. |
| (3) | — | — | P-56 (0.90 g/m$^2$) was added. |
| (4) | P-57 (0.30 g/m$^2$) was added. | P-57 (0.30 g/m$^2$) was added. | P-57 (0.90 g/m$^2$) was added. |
| (5) | P-57 (0.30 g/m$^2$) was added. | P-57 (0.30 g/m$^2$) was added. | P-3 (0.90 g/m$^2$) was added. |
| (6) | P-57 (0.30 g/m$^2$) was added. | P-57 (0.30 g/m$^2$) was added. | P-5 (0.90 g/m$^2$) was added. |
| (7) | P-57 (0.30 g/m$^2$) was added. | P-57 (0.30 g/m$^2$) was added. | P-57 (0.90 g/m$^2$) was added, and C-11 was replaced with C-2. |
| (8) | P-57 (0.30 g/m$^2$) was added. | P-57 (0.30 g/m$^2$) was added. | P-57 (0.90 g/m$^2$) was added, and C-11 was replaced with C-1. |
| (9) | P-57 (0.30 g/m$^2$) was added. | P-57 (0.30 g/m$^2$) was added. | P-57 (0.90 g/m$^2$) was added, and all the solvents were |

TABLE 10-continued

| Sample No. | Alteration on Sample (1) Blue-Sensitive Layer | Green-Sensitive Layer | Red-Sensitive Layer |
|---|---|---|---|
| | | | replaced with S-69. |
| (10) | P-57 (0.30 g/m$^2$) was added. | P-57 (0.30 g/m$^2$) was added, and all the solvents were replaced with S-25. | P-57 (0.90 g/m$^2$) was added, and all the solvents were replaced with S-25. |
| (11) | P-57 (0.30 g/m$^2$) was added | P-57 (0.30 g/m$^2$) was added, and M-35 was replaced with M-1. | P-57 (0.90 g/m$^2$) was added. |
| (12) | P-57 (0.30 g/m$^2$) was added. | P-57 (0.30 g/m$^2$) was added, and M-35 was replaced with M-2. | P-57 (0.90 g/m$^2$) was added. |
| (13) | P-57 (0.30 g/m$^2$) was added. | P-57 (0.30 g/m$^2$) was added, M-35 was replaced with M-1, and all the solvents were replaced with S-25. | P-57 (0.90 g/m$^2$) was added, C-11 was replaced with C-1, and all the solvents were replaced with S-25. |

Each of Samples above was exposed to light through an optical wedge and subjected to development processing according to the following procedure.

| Processing Step | Temperature | Time |
|---|---|---|
| Color Development | 38° C. | 1'40" |
| Blix | 30–34° C. | 1'00" |
| Rinsing (1) | 30–34° C. | 20" |
| Rinsing (2) | 30–34° C. | 20" |
| Rinsing (3) | 30–34° C. | 20" |
| Drying | 70–80° C. | 50" |

Rinsing was carried out in a counter-current system using three tanks from (3) toward (1).

The processing solutions used in the development had the following formulations.

| | |
|---|---|
| Color Developer Formulation: | |
| Water | 800 ml |
| Diethylenetriaminepentaacetic acid | 1.0 g |
| 1-Hydroxyethylidene-1,1-diphosphonic acid | 2.0 g |
| Nitrilotriacetic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-Ethyl-N-(-methanesulfonamido-ethyl)-3-methyl-4-aminoaniline sulfate | 5.5 g |
| Hydroxylamine sulfate | 3.0 g |
| Fluorescent brighteing agent ("WHITEX 4 B" produced by Sumitomo Chemical Co., Ltd.) | 1.5 g |
| Water to make | 1000 ml |
| pH = 10.25 | (25° C.) |
| Blix Bath Formulation: | |
| Water | 400 ml |
| Ammonium thiosulfate (70%) | 200 ml |
| Sodium sulfite | 20 g |
| Ammonium (ethylenediaminetetra-acetato) iron (III) | 60 g |
| Disodium ethylenediaminetetraacetate | 10 g |
| Water to make | 1000 ml |
| pH = 7.00 | (25° C.) |
| Rinsing Solution: | |
| Benzotriazole | 1.0 g |
| Ethylenediamine-N,N,N',N'-tetra-methylenephosphonic acid | 0.3 g |
| Water to make | 1000 ml |
| pH = 7.50 | (25° C.) |

In order to evaluate the thus processed samples for image fastness to heat, wet heat, and light, the samples were allowed to stand in a dark place under a dry heat condition (80° C.) for 1 month or under a wet heat condition (80° C., 70% RH) for 2 weeks or exposed to light in a xenontest apparatus (ca. 100,000 lux) for 8 days. The degree of discoloration was determined by obtaining a reduction percentage in cyan (G), magenta (R) or yellow (B) color density from the initial density of 1.5 in the case of the heat and wet heat tests or the initial density of 1.0 in the case of the light test. The results obtained are shown in Tables 11–13.

TABLE 11

| Sample No. | Decoloration under dark and high temperature 80° C., for 1 Month B | G | R |
|---|---|---|---|
| (1) | 4 | 2 | 43 |
| (2) | 4 | 2 | 28 |
| (3) | 4 | 2 | 11 |
| (4) | 4 | 0 | 10 |
| (5) | 4 | 0 | 17 |
| (6) | 4 | 0 | 34 |
| (7) | 4 | 0 | 7 |
| (8) | 4 | 0 | 20 |
| (9) | 4 | 0 | 19 |
| (10) | 4 | 0 | 18 |
| (11) | 4 | 10 | 11 |
| (12) | 4 | 12 | 11 |
| (13) | 3 | 10 | 35 |

TABLE 12

| Sample No. | Decoloration under humidity and hot temperature 80° C., 70% RH, for 2 Wks. B | G | R |
|---|---|---|---|
| (1) | 4 | 2 | 18 |
| (2) | 4 | 2 | 9 |
| (3) | 4 | 2 | 4 |
| (4) | 3 | 0 | 3 |
| (5) | 3 | 0 | 6 |
| (6) | 3 | 0 | 14 |
| (7) | 3 | 0 | 2 |
| (8) | 3 | 0 | 25 |
| (9) | 3 | 0 | 3 |
| (10) | 3 | 2 | 7 |
| (11) | 3 | 12 | 3 |
| (12) | 3 | 6 | 3 |
| (13) | 3 | 14 | 30 |

TABLE 13

| Sample No. | Decoloration with light Xenon, for 8 Days B | G | R |
|---|---|---|---|
| (1) | 26 | 22 | 30 |
| (2) | 26 | 22 | 25 |
| (3) | 26 | 22 | 19 |
| (4) | 18 | 17 | 18 |
| (5) | 18 | 17 | 24 |
| (6) | 18 | 17 | 26 |
| (7) | 18 | 17 | 21 |
| (8) | 18 | 17 | 19 |
| (9) | 18 | 17 | 17 |
| (10) | 18 | 35 | 22 |
| (11) | 18 | 64 | 18 |
| (12) | 18 | 35 | 18 |
| (13) | 18 | 66 | 21 |

The following considerations can be derived from the results of Tables 11–13.

(1) The discoloration inhibitory effect of the polymer according to the present invention can be enhanced as the amount of the polymer added increases, as can be seen from the results of Samples (1), (2), and (3).

(2) The higher the glass transition point of the polymer, the higher the discoloration inhibitory effect, as can be seen from the results of Samples (4), (5), and (6).

(3) Compounds of formula (Cp-I) wherein $R^{32}$ is an ethyl group are superior than those wherein $R^{32}$ is a methyl group in terms of inclusive dye image fastness and color balance of discoloration when used in combination with the polymers, as can be seen by comparing Samples (5), (7), and (8).

(4) Phthalic esters as high-boiling solvents for couplers are inferior in performances to phosphoric esters and fatty acid esters, as can be seen by comparing Samples (5), (9), and (10) and comparing Samples (8) and (13).

(5) Four-equivalent pyrazolone couplers undergo serious discoloration as compared with yellow and cyan couplers even when used in combination with the polymer of the present invention, thus resulting in poor color balance, as can be seen from the results of Samples (11) and (13).

(6) With the glass transition points (Tg) being close to each other, polymers comprising an acrylamide monomer tend to produce greater effects than those comprising an acrylate monomer, as can be seen by comparing Samples (3) and (5).

EXAMPLE 7

Multilayer color papers were produced in the same manner as for Samples (1) to (13) of Example 6, except that the silver halide emulsions used in Example 6 (EM-1 to EM-6) were replaced with EM-7 to EM-12 as tabulated below, respectively. The resulting color papers were designated as Samples (14) to (26).

Each of Samples was processed according to the proceeding steps stated below.

| Emulsion No. | Shape of Grains | Mean Grain Size* (μm) | Br Content (mol %) | Coefficient of Variation** |
|---|---|---|---|---|
| EM-7 | cubic | 1.1 | 1.0 | 0.10 |
| EM-8 | cubic | 0.8 | 1.0 | 0.10 |
| EM-9 | cubic | 0.45 | 1.5 | 0.09 |
| EM-10 | cubic | 0.34 | 1.5 | 0.09 |
| EM-11 | cubic | 0.45 | 1.5 | 0.09 |
| EM-12 | cubic | 0.34 | 1.6 | 0.10 |

-continued

| Processing Step | Temperature | Time |
|---|---|---|
| Color Development | 35° C. | 45" |
| Blix | 30–35° C. | 45" |
| Rinsing (1) | 30–35° C. | 20" |
| Rinsing (2) | 30–35° C. | 20" |
| Rinsing (3) | 30–35° C. | 20" |
| Rinsing (4) | 30–35° C. | 30" |
| Drying | 70–80° C. | 60" |

Note:
*, **The same meanings as in Example 6.

The rinsing was carried out in a counter-current system using three tanks from (4) toward (1).

The processing solutions used in the development processing had the following formulations.

| | |
|---|---|
| Color Developer Formulation: | |
| Water | 800 ml |
| Ethylenediamine-N,N,N,N-tetramethylenephosphonic acid | 1.5 g |
| Triethylenediamine(1,4-diaza- | 5.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| Fluorescent brightening agent ("UVITEX CK" produced by Chiba Geigy) | 2.0 g |
| Water to make | 1000 ml |
| pH = 10.10 | (25° C.) |
| Blix Bath Formulation: | |
| Water | 400 ml |
| Ammonium thiosulfate (70%) | 100 ml |
| Sodium sulfite | 18 g |
| Ammonium (ethylenediaminetetraacetato)iron (III) | 55 g |
| Disodium ethylenediaminetetraacetate | 3 g |
| Ammonium bromide | 40 g |
| Glacial acetic acid | 8 g |
| Water to make | 1000 ml |
| pH = 5.5 | (25° C.) |
| Rinsing Solution Formulation: | |
| Deionized water (Ca content and Mg content each is 3 ppm or less) | |

What is claimed is:

1. A silver halide color photographic material comprising a support having thereon at least one silver halide photographic emulsion layer containing a dispersion of oleophilic fine particles containing at least one diffusion resistant oil-soluble coupler which forms a substantially nondiffusible dye upon coupling with an oxidation product of an aromatic primary amine developing agent and at least one water-immiscible coupler solvent having a melting point of not more than 100° C. and a boiling point of not less than 140° C., wherein said oil-soluble coupler is represented by formula (Cp-I), (Cp-II), or (Cp-III), defined below, and the dispersion of oleophilic fine particles is a dispersion obtained by emulsifying or dispersing a solution containing at least one of said couplers, at least one of said coupler solvents, and at least one water-insoluble and an organic solvent-soluble polymer, which is a homopolymer or copolymer composed of at least one repeating unit in an amount of not less than 35 mol% which does not have an acid group in the main chain or side chain thereof, wherein the repeating unit is a repeating unit which, when the polymer is a homopolymer having a molecular weight of at least 20,000 formed exclusively by the repeating unit, provides a polymer having a glass transition temperature (Tg) of 50° C. or higher;

General formula (Cp-I)

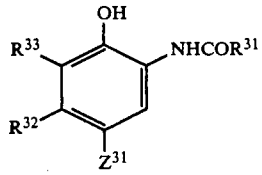

wherein $R^{31}$ represents an alkyl group, a cycloalkyl group, an aryl group or a heterocyclic group; $R^{32}$ represents an acylamino group, or an alkyl group having 2 or more carbon atoms; $R^{33}$ represents a hydrogen atom, a halogen atom, an alkyl group or an alkoxy group; with proviso $R^{31}$ represents an aryl group where $R^{32}$ is an acylamino group; $Z^{31}$ represents a hydrogen atom, or a releasable group when $Z^{31}$ reacts with an oxidation products of an aromatic primary amine color developing agent General formula (Cp-II)

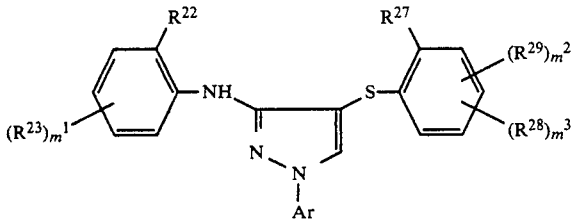

wherein Ar represents an aryl group; $R^{21}$ represents a hydrogen atom; an acyl group, or an aliphatic or aromatic sulfonyl group; $R^{22}$ represents a halogen atom, or an alkoxy group; $R^{23}$ represents an alkyl group, an aryl group, a halogen atom, an alkoxy group, an aryloxy group, an acylamino group, an imido group, a sulfonamido group, an alkoxycarbonyl group, a carbamoyl group, a sulfamoyl group, an alkylthio group, or a sulfonyl group; $R^{27}$ represents an alkyl group, an alkoxy group, or an aryloxy group; $R^{29}$ represents a hydrogen atom, a halogen atom, a hydroxyl group, an alkyl group, an alkoxy group, or an aryl group; $R^{28}$ represents an amino group, acylamino group, an ureido group, an alkoxy carbonylamino group, an imido group, a sulfonamido group, a sulfamylamino group, an alkoxycarbonyl group, a carbamoyl group, an acyl group, a cyano group, or an alkylthio group; provided that at least one of $R^{27}$ and $R^{29}$ represents an alkoxy group; $m^1$ and $m^2$ each represents an integer of 1 to 4; and $m^3$ represent 0 or an integer of 1 to 3

General formula (Cp-III)

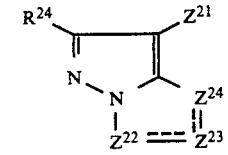

wherein $R^{24}$ represents a hydrogen atom or a substituent group; $Z^{21}$ represents a hydrogen atom or a releasable group when $Z^{21}$ reacts with an oxidation product of an aromatic primary amine color developing agent; $Z^{22}$, $Z^{23}$ and $Z^{24}$ each represents

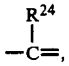

—N' or —NH—, including that at least one of bondings $Z^{24}$–$Z^{23}$ and $Z^{23}$–$Z^{22}$ is double-bond and the rest thereof is a single-bond, and a bonding $Z^{23}$–$Z^{22}$ is a part of an aromatic ring when $Z^{23}$–$Z^{22}$ is a carbon to carbon double-bond.

2. The silver halide color photographic material as claimed in claim 1, wherein the repeating unit which does not have an acid group has a group of

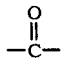

in the main chain or side chain thereof.

3. The silver halide color photographic material as claimed in claim 2, wherein the repeating unit which does not have an acid group has a group of

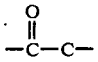

in the main chain or side chain thereof.

4. The silver halide color photographic material as claimed in claim 2, wherein the repeating unit which does not have an acid group has a group of

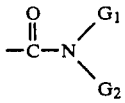

in the main chain or side chain thereof (wherein $G_1$ and $G_2$ each represents a hydrogen atom, substituted or unsubstituted alkyl group, or substituted or unsubstituted aryl group, provided that $G_1$ and $G_2$ do not simultaneously represent a hydrogen atom).

5. A silver halide color photographic material according to claim 1, wherein at least one coupler of formula (Cp-I) as a cyan coupler, and at least one coupler of formulae (Cp-II) and (Cp-III) as magenta coupler are contained respectively.

* * * * *